US011077010B2

(12) United States Patent
Heller

(10) Patent No.: US 11,077,010 B2
(45) Date of Patent: Aug. 3, 2021

(54) SOFT TISSUE MOBILIZATION DEVICE

(71) Applicant: Marc Robert Heller, West Hollywood, CA (US)

(72) Inventor: Marc Robert Heller, West Hollywood, CA (US)

( * ) Notice: Subject to any disclaimer, the term of this patent is extended or adjusted under 35 U.S.C. 154(b) by 0 days.

(21) Appl. No.: 16/184,816

(22) Filed: Nov. 8, 2018

(65) Prior Publication Data

US 2019/0142685 A1 May 16, 2019

Related U.S. Application Data

(60) Provisional application No. 62/584,697, filed on Nov. 10, 2017.

(51) Int. Cl.
*A61H 7/00* (2006.01)
*B25B 5/06* (2006.01)
(Continued)

(52) U.S. Cl.
CPC ..... *A61H 7/001* (2013.01); *A61H 1/008* (2013.01); *A61H 7/007* (2013.01); *A61H 39/04* (2013.01); *B25B 5/067* (2013.01); *B25B 5/068* (2013.01); *B25B 5/163* (2013.01); *A61H 2201/0173* (2013.01); *A61H 2201/0192* (2013.01); *A61H 2201/1253* (2013.01); *A61H 2201/164* (2013.01); *A61H 2201/1614* (2013.01); *A61H 2201/1619* (2013.01); *A61H 2201/1623* (2013.01); *A61H 2201/1628* (2013.01); *A61H 2201/1635* (2013.01); *A61H 2201/1645* (2013.01); *A61H 2201/1685* (2013.01); *A61H 2205/06* (2013.01); *A61H 2205/062* (2013.01); *A61H 2205/081* (2013.01);
(Continued)

(58) Field of Classification Search
CPC ..... B25B 5/163; A61H 7/00; A61H 7/001; A61H 7/003; A61H 7/007
See application file for complete search history.

(56) References Cited

U.S. PATENT DOCUMENTS 6,190,339 B1 * 2/2001 Imazaike ..... A61H 7/005 601/133
2007/0198054 A1 * 8/2007 Hecht ..... A61B 17/132 606/204
2014/0358045 A1 * 12/2014 Toto ..... A61F 7/08 601/18

OTHER PUBLICATIONS

ProSqueeze Inc., "ProSqueeze—Arm Massager, Hand Massager, Forearm Massager, Leg Massager, Calf Massager." Retrieved from: https://www.prosqueeze.com/, Jun. 3, 2020. (Note: This is for reference only. The current version of the web page is not prior art.).
(Continued)

*Primary Examiner* — Steven O Douglas

(57) ABSTRACT

The present soft tissue mobilization device has a quick-release bar clamp and various attachments for its jaws that exert pressure on soft tissue to improve mobility. The bar clamp allows for applying sustained and incremental pressure at various angles. The shape of the attachment surfaces that contact the soft tissue are either complementary toward each other, when they are intended to squeeze the targeted soft tissue between them, or to the body structure against which they are intended to press. Combining a more helpful means of generating and exerting pressure with the right surface contours significantly improves the overall effectiveness of the device, diminishes any associated pain and discomfort, and reduces the time necessary to achieve results.

64 Claims, 37 Drawing Sheets

(51) Int. Cl.

| | |
|---|---|
| ***B25B 5/16*** | (2006.01) |
| ***A61H 1/00*** | (2006.01) |
| ***A61H 39/04*** | (2006.01) |

(52) U.S. Cl.
CPC .. *A61H 2205/083* (2013.01); *A61H 2205/085* (2013.01); *A61H 2205/086* (2013.01); *A61H 2205/088* (2013.01); *A61H 2205/102* (2013.01); *A61H 2205/108* (2013.01)

(56) References Cited

OTHER PUBLICATIONS

Therabody Technologies, "ProSqueeze: The World's Best Tool for Relieving Tension by TheraBody Technologies—Kickstarter." Kickstarter campaign. Retrieved from: https://www.kickstarter.com/projects/86676737/prosqueeze-the-worlds-best-tool-for-relieving-tens, Jun. 3, 2020. (Note: This is for reference only. The current version of the web page is not prior art).

ProSqueeze Inc., "ProSqueeze." Retrieved from: https://web.archive.org/web/20171009222949/http://www.prosqueeze.com/, Jun. 3, 2020. (Note: This is an incomplete archive of https://www.prosqueeze.com/ from Oct. 9, 2017.).

ProSqueeze Inc., "ProSqueeze—Arm Massager, Hand Massager, Forearm Massager, Leg Massager, Calf Massager." Retrieved from: https://www.prosqueeze.com/learn, Jun. 3, 2020. (Note: This is for reference only. The current version of the web page is not prior art.).

ProSqueeze Inc., "ProSqueeze—Arm Massager, Hand Massager, Forearm Massager, Leg Massager, Calf Massager." Retrieved from: https://web.archive.org/web/20170325235305/http://www.prosqueeze.com/learn, Jun. 3, 2020. (Note: This is an incomplete archive of https://www.prosqueeze.com/learn from Mar. 25, 2017.).

* cited by examiner

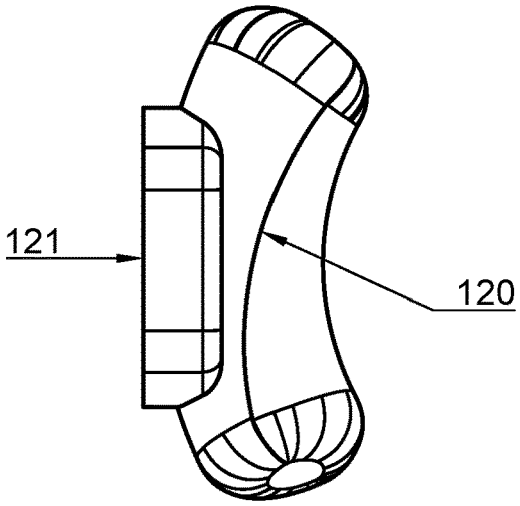
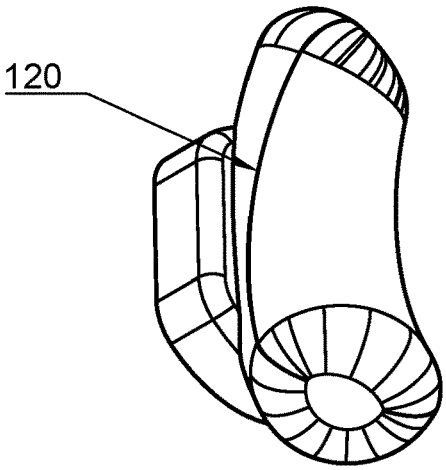
FIG. 29A
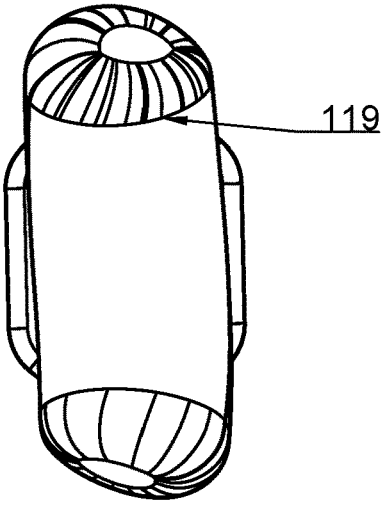
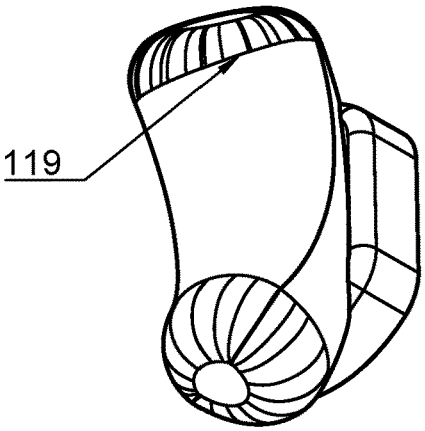
FIG. 29B
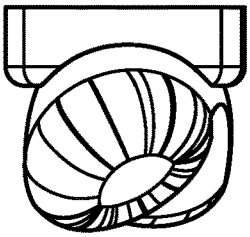
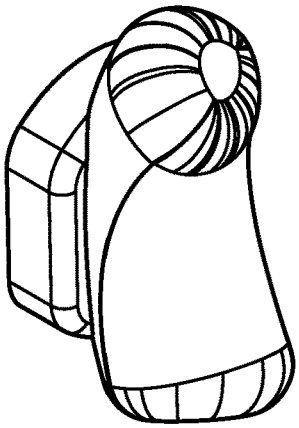
FIG. 29C
FIG. 29D

SOFT TISSUE MOBILIZATION DEVICE

REFERENCE TO RELATED APPLICATIONS

This application is a Nonprovisional Utility Patent Application claiming priority to U.S. Provisional Application No. 62/584,697, entitled SOFT TISSUE MOBILIZATION DEVICE, filed on Nov. 10, 2017, with inventor Marc Robert Heller, which is herein incorporated by reference in its entirety.

TECHNICAL FIELD OF THE INVENTION

The present invention relates to devices relating to and methods for soft tissue mobilization.

BACKGROUND OF THE INVENTION

Soft tissue mobilization is a technique used on muscles, fascia, tendons and ligaments to help alleviate tension, stiffness and pain and improve both range of motion and quality of movement, including decreased resistance and increased fluidity and stability. These goals are pursued by applying sustained pressure to stiff tissue or trigger points, which are sensitive areas that often manifest as tender nodules or taut bands of fiber. The pressure often elicits pain or discomfort at first but then dissipates as it continues to be applied. Optimal results require the right amount of pressure. Too little and it will not effect change. Too much and the tissue will tense up in reaction and be unable to relax. Once relaxed, one can keep going deeper, repeating the process as one increases the applied pressure in a step-wise fashion.

Self-myofascial release tools that already exist include foam and plastic rollers, balls and massage sticks. They rely on gravity or muscle exertion to apply pressure to the soft tissue. Their inherent drawbacks are multifold. Using them, one often must maintain an awkward position to apply pressure to the targeted area that may well be hard to sustain. The best achievable position also may be suboptimal to deliver pressure at the most effective angle. Due to both size and ineffective shape they may well not reach or sufficiently press up against the targeted area. It is often difficult or impossible to pin the desired area down, as the soft tissue shifts from one side of the tool to the other or simply gets displaced away from the tool if no hard tissue or other bodily tissue prevents it. Achieving the right amount of pressure may also be difficult as the force of gravity is obviously not adjustable and muscle exertion may well not be consistent or sustainable. What's more, increasing the pressure beyond a certain point will invariably become problematic. Not to mention, the muscle exertion itself is counterproductive to relaxing. All these difficulties limit the effectiveness of existing tools.

Physical therapists, massage therapists and chiropractors may apply pressure for myofascial release using a combination of their fingers, knuckles, palms, forearms, elbows or other body part, but such manual manipulation also has its drawbacks. Without having the benefit of self-sensory feedback, the practitioner often applies too little or too much pressure for optimal results. The mobilizer may be unable to generate enough pressure or sustain a consistent level of it. Simple fatigue may well set in before the pressed-upon tissue relaxes. The utilized body part may not be a good match in size or shape for its target, reducing how effective it can be, as well as possibly causing undue discomfort or pain that is extraneous to the work at hand. Additionally, such services are costly and not always readily available when needed.

Quick-release bar clamps are a staple of artisans and woodworkers. They secure objects in place between a fixed jaw and a second moveable one, both secured on a slide bar. With the use of a trigger handle that drives a lever which engages the slide bar surface, the moveable jaw can be incrementally repositioned closer to the fixed one, increasing the pressure on the held object. This driving lever disengages, by spring force, from the slide bar and returns to its original position after each stroke of the trigger handle. A separate braking lever, biased to engage the slide bar, prevents the movable jaw from moving in the reverse direction, farther away from the fixed jaw. A release handle, which disengages the braking lever, frees the moveable jaw and allows for the quick liberation of the object from the pressure exerted by the two jaws. U.S. Pat. Nos. 4,926,722, 5,009,134 and 5,022,137 are some of a series to J. Sorensen et al. covering a quick-release bar clamp. There also exists in the art numerous variations and improvements.

BRIEF SUMMARY OF THE INVENTION

An objective of a soft tissue mobilization device according to the current invention is to modify a quick-release bar clamp to overcome the myriad disadvantages of existing tools and techniques and thereby deliver more effective relief. Combined with new mobilization tools that take advantage of its unique possibilities, the bar clamp can be used to apply consistent and sustainable pressure to soft tissue with the ability to increase it in step-wise fashion. With legs, arms or other body parts in its grasp, the pressure may be applied at a wide spectrum of angles and is not constrained by the one-directional downward force of gravity, the upward counterforce of floors, or the lateral counterforce of walls. The variety of possible angles renders difficult and awkward positions no longer necessary. The freedom of angular placement also significantly broadens the possibilities for the size and shape of mobilization tool surfaces and allows them to much better match the targeted soft tissue, avoiding unnecessary pain and improving overall effectiveness. The bar clamp furthermore does not require any muscle exertion to sustain its pressure, freeing muscle and other soft tissue to fully relax. In addition, the amount of pressure that can be applied is increased beyond what is otherwise possible.

Even better, the device can apply pressure directly to the targeted soft tissue in a bidirectional way, squeezing it between complementary contact surfaces that are either fixed or coupled to its jaws, without relying on bones or other tissue that existing tools need to counteract their sole surface. Indeed, bones or other tissue are ill-adapted for the purpose, as their fixed nature often puts them in a poor position to act as a counterforce, while their shape in most instances is not complementary to the surface of existing tools, which only apply pressure in a unidirectional manner, requiring bones or other tissue to act as such. This pinching of soft tissue between complementary surfaces of the device is key to pinning it down and not allowing for its escape. Pain and discomfort, moreover, often arise from bone or other tissue when they are relied upon as a counterforce, with pressure being applied to them. By foregoing this reliance, the device alleviates such undue suffering and allows an individual to apply greater pressure to the targeted tissue than would otherwise be tolerable, leading to better results. The bidirectional, squeezing ability of devices according to the invention is a component of its greater effectiveness.

The disclosed concept includes many variations, and the invention is not limited by this Brief Summary. A further understanding of the nature and advantages will become apparent by reference to the remaining portions of the specification and drawings.

BRIEF DESCRIPTION OF THE DRAWINGS

For a fuller understanding of the invention, reference is had to the following description taken in connection with the accompanying drawings, in which:

FIG. 29A is a side view of an attachment intended primarily for use as an anchor on the upper chest.

FIG. 29B is a front view of the attachment of FIG. 29A.

FIG. 29C is a top view of the attachment of FIG. 29A.

FIG. 29D is three perspective views of the attachment of FIG. 29A.

FIG. 31B is four perspective views of the aligned attachments of FIG. 31A.

FIG. 32A is a front view of an attachment intended primarily for use on the upper back.

FIG. 32B is a back view of the attachment of FIG. 32A.

FIG. 32C is a left-side view of the attachment of FIG. 32A.

FIG. 32D is a right-side view of the attachment of FIG. 32A.

FIG. 32E is a top view of the attachment of FIG. 32A.

FIG. 32F is a bottom view of the attachment of FIG. 32A.

FIG. 32G is two perspective views of the attachment of FIG. 32A.

FIG. 33 shows possible positions of the attachment of FIG. 32A on the upper back.

FIG. 34A is a front view of an attachment intended primarily for tight bodily junctures and recesses.

FIG. 34B is a side view of the attachment of FIG. 34A.

FIG. 34C is a top view of the attachment of FIG. 34A.

Figure 34A:
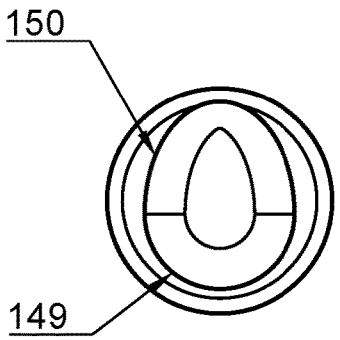
Figure 34B:
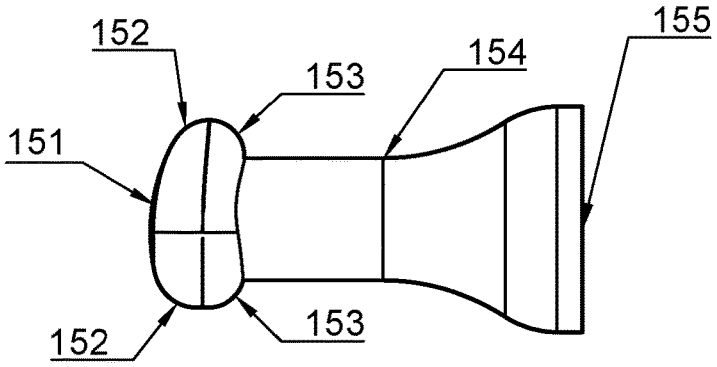
Figure 34C:
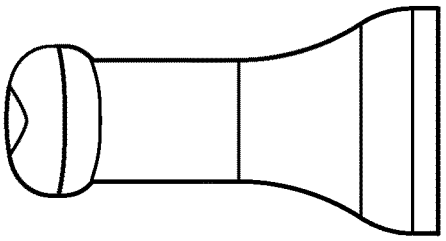
Figure 34D:
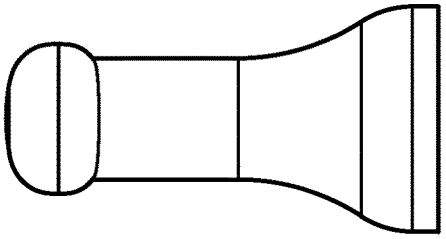

FIG. 34D is a bottom view of the attachment of FIG. 34A.

Figure 34E:
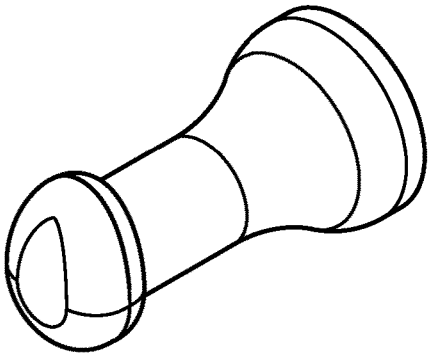
Figure 34E:
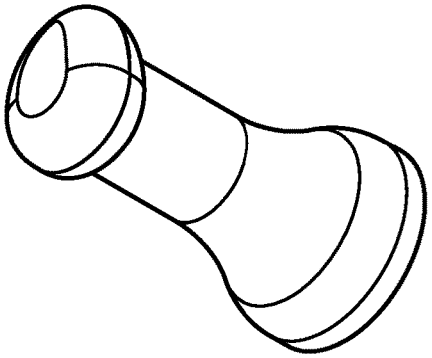

FIG. 34E is two perspective views of the attachment of FIG. 34A.

Figure 35A:
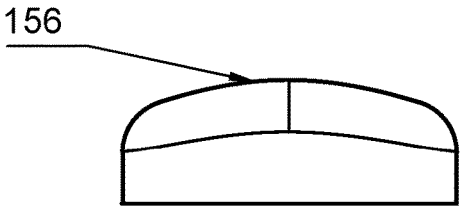

FIG. 35A is a top view of an attachment intended for general use.

Figure 35B:
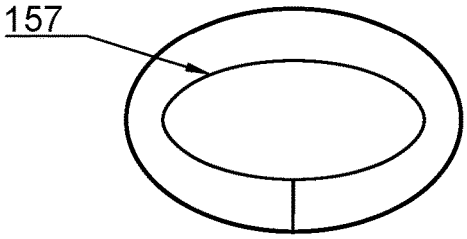

FIG. 35B is a front view of the attachment of FIG. 35A.

Figure 35C:
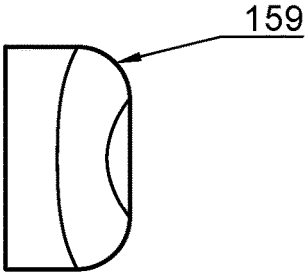

FIG. 35C is a side view of the attachment of FIG. 35A.

Figure 35D:
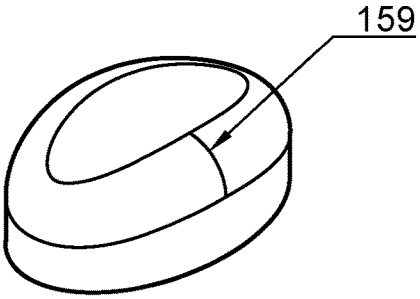

FIG. 35D is a perspective view of the attachment of FIG. 35A.

Figure 36A:
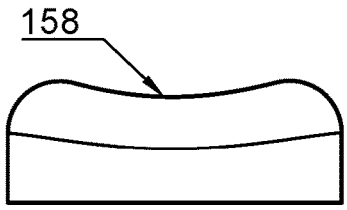

FIG. 36A is a top view of an attachment intended for general use.

Figure 36B:
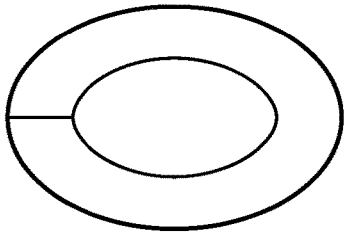

FIG. 36B is a front view of the attachment of FIG. 36A.

Figure 36C:
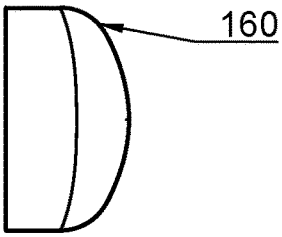

FIG. 36C is a side view of the attachment of FIG. 36A.

Figure 36D:
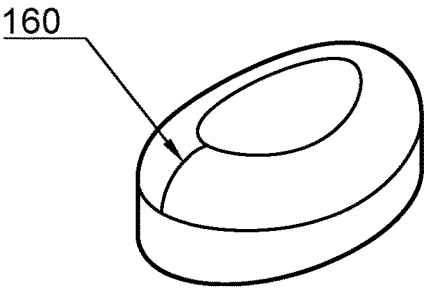

FIG. 36D is a perspective view of the attachment of FIG. 36A.

Figure 37A:
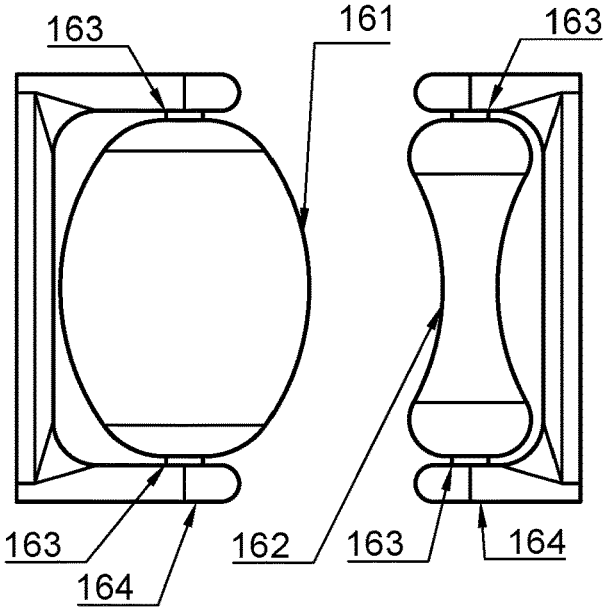

FIG. 37A is a side view of a pair of aligned attachments intended for use on the limbs.

Figure 37B:
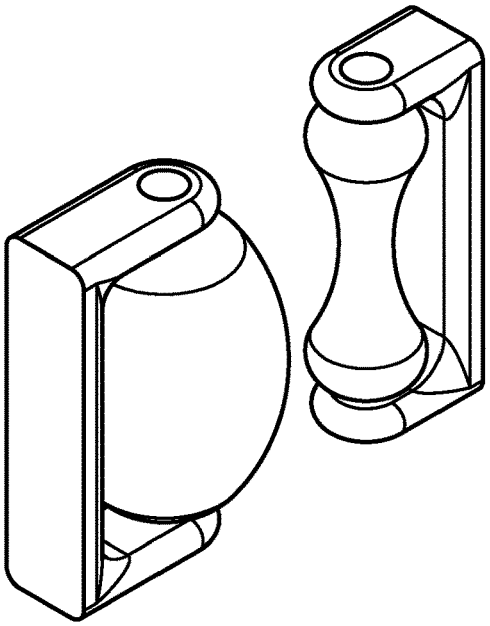
Figure 37B:
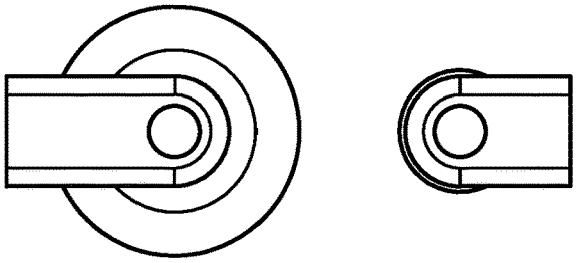

FIG. 37B is a top view of the aligned attachments of FIG. 37A.

Figure 37E:
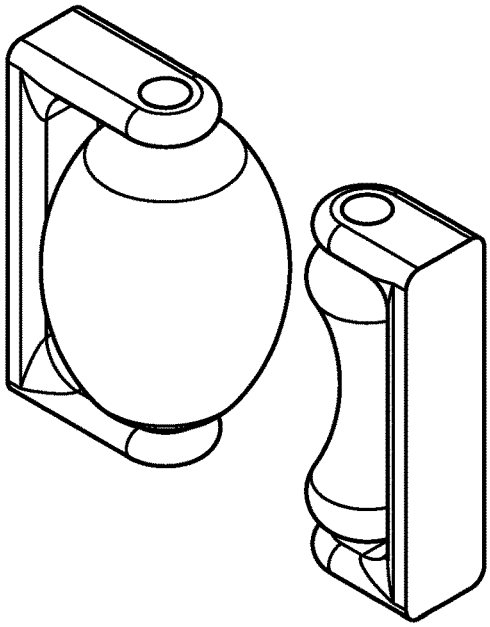
Figure 37C:
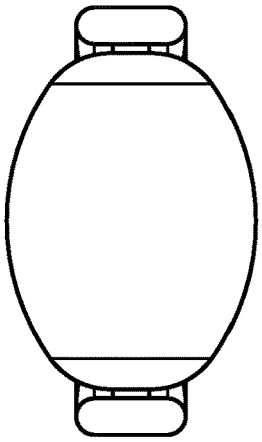

FIG. 37C is a front view of the attachment on the left of FIG. 37A.

Figure 37D:
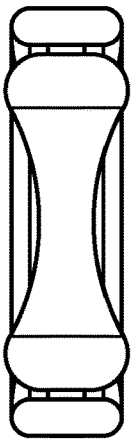

FIG. 37D is a front view of the attachment on the right of FIG. 37A.

FIG. 37E is two perspective views of the aligned attachments of FIG. 37A.

Figure 38A:
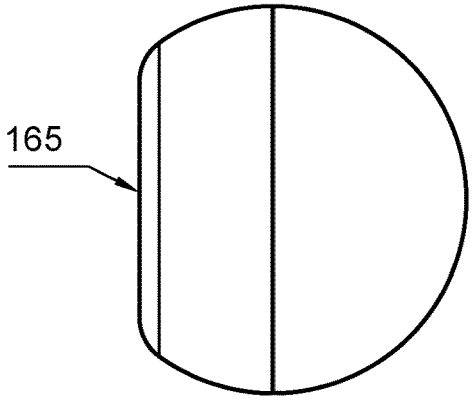

FIG. 38A is a side view of an attachment intended for general use.

Figure 38B:
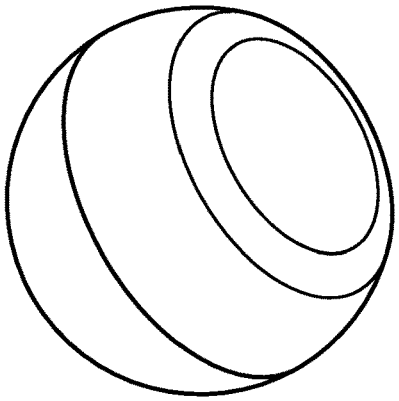

FIG. 38B is a perspective view of the attachment of FIG. 38A.

Figure 38C:
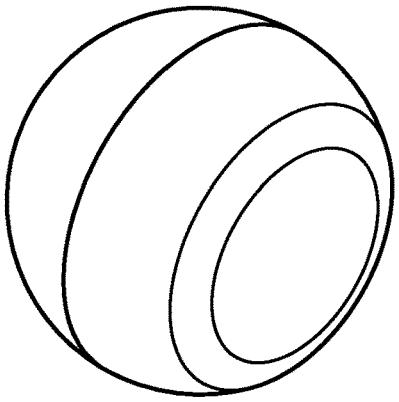

FIG. 38C is another perspective view of the attachment of FIG. 38A.

Figure 39A:
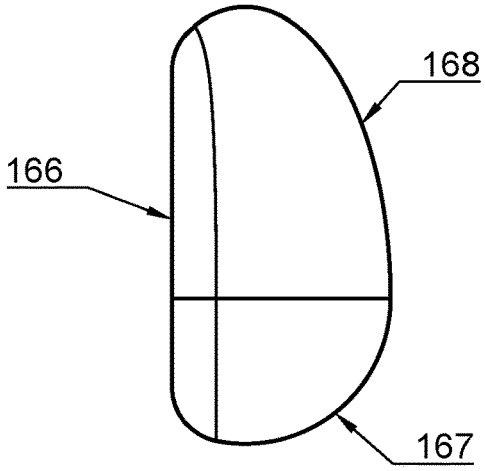

FIG. 39A is a side view of an attachment intended for general use.

Figure 39B:
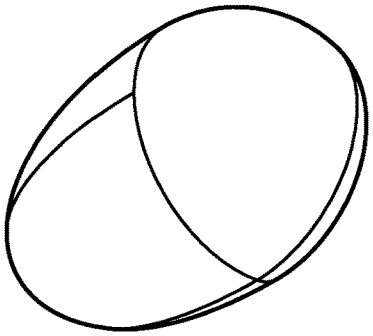

FIG. 39B is a perspective view of the attachment of FIG. 39A.

Figure 39C:
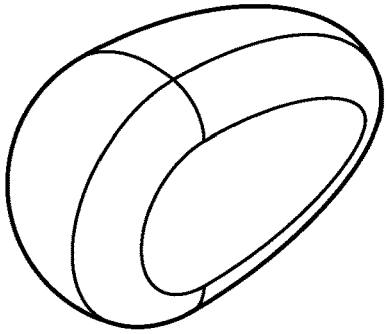

FIG. 39C is another perspective view of the attachment of FIG. 39A.

DETAILED DESCRIPTION OF THE INVENTION

Figure 1A:
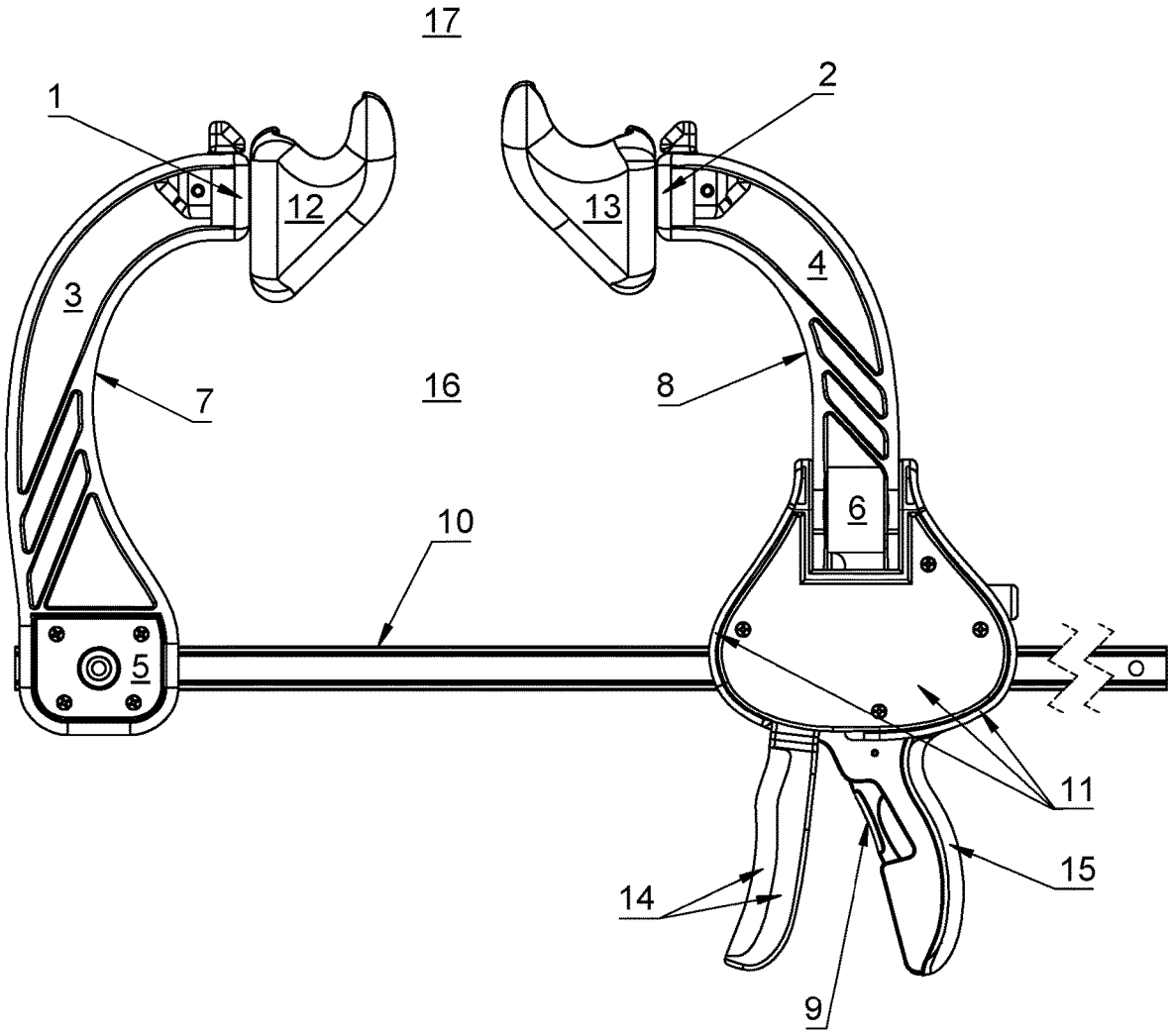
FIG. 1A is a side view of a modified quick-release bar clamp with example attachments.
Figure 2:
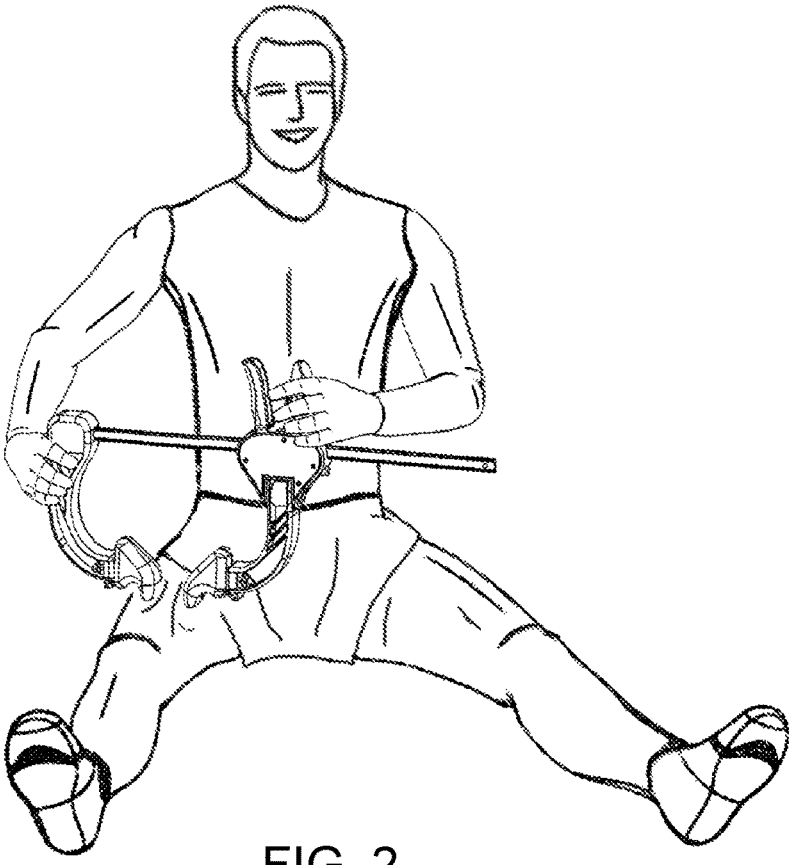
FIG. 2 shows a person using the device of FIG. 1A on his quadriceps.
Figure 3:
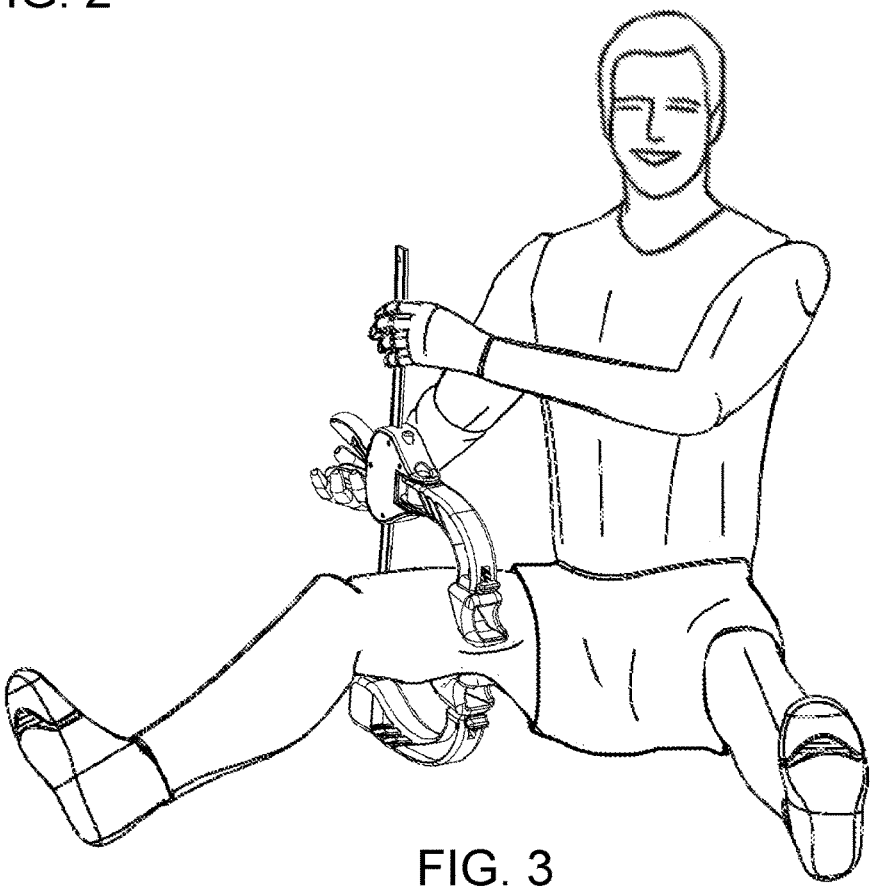
FIG. 3 shows a person using the device of FIG. 1A on his hip adductors.
Figure 4:
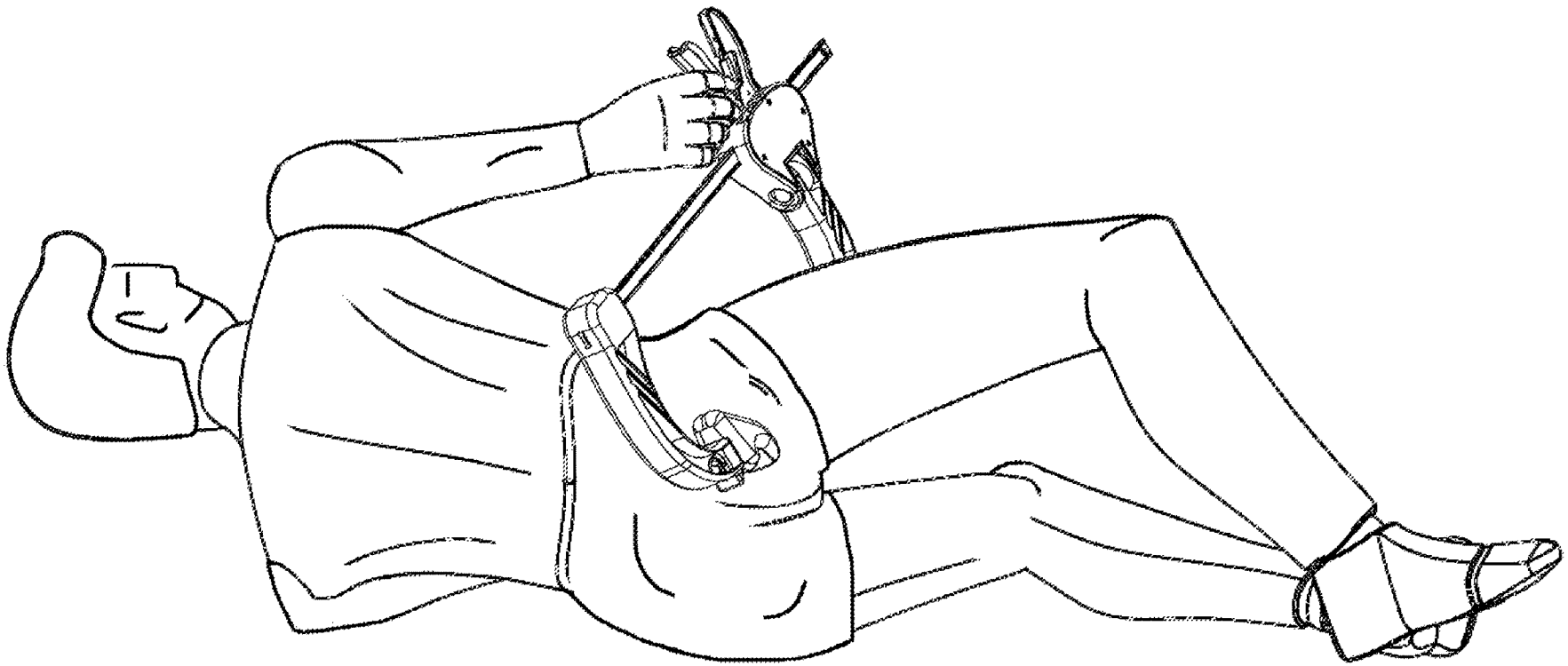
FIG. 4 shows a person using the device of FIG. 1A on his lower buttocks.

The traditional quick-release bar clamp benefits from several structural modifications in its new application to soft tissue mobilization. The modified version is illustrated in FIG. 1A. The traditional clamp has a short throat depth, which is routinely less than 95 mm, with minimal horizontal distance between the free end of the jaw and the supporting jaw body. Increasing the throat depth enables the clamp to engage a wider array of body parts that may otherwise be unreachable and provides the slide bar with more room to clear the body without pressing into it. A throat depth of up to 250 mm is sufficient in most cases where the person is not morbidly obese. The ultimate length of reach that is needed depends upon the given body part and its size for any specific individual. Reaching the midline of the torso, for instance, requires a much greater throat depth than gripping the forearm. While a greater throat depth covers more body placements, it makes for a larger assembly that is heavier and harder to maneuver. Depending upon the orientation of the assembly, it may also make it more difficult to reach the trigger handle and handgrip. In due course, the preferred embodiment allows for the jaws to be swapped for ones of different lengths. On the other hand, increasing the protrusion of the free ends 1, 2 of the jaws 3, 4 from their bases 5, 6 and instituting curved recesses 7, 8 allows the clamp to go around body parts that would otherwise get in the way. Examples include having the clamp go around a leg for it to be used on the buttocks or around the top of the shoulder for it to be used on the upper back. Increasing the throat depth and the protrusion of the free jaw ends in combination dramatically improves the maneuverability of the clamp in its placement on any number of body parts. FIGS. 2 and 3 illustrate a seated person using the assembly of FIG. 1A on his upper leg, while FIG. 4 shows a recumbent person using it on his lower buttocks.

The bar clamp is also better adapted for its new purpose with the elimination of all sharp edges and corners as they can cause unnecessary pain if they happen to be pressed into the human body. The smoothness of all the clamp's surfaces with no small protuberances or niches is similarly preferred. The slide bar 10 is likewise free of sharp edges to avoid undue discomfort if pushed against the body.

The release handle 9 must be placed in a readily accessible position. The trigger handle 14 and handgrip 15 may be positioned perpendicular to the slide bar on the opposite side of the jaws as shown in FIG. 1A or they may be positioned on the same side of the jaws as depicted in FIG. 1 of U.S. Pat. No. 5,853,168. In addition, the trigger handle and handgrip may run parallel to the bar as illustrated in FIG. 1 of U.S. Pat. No. 5,094,131 or even at an angle to the bar. They also may be situated in a different plane than the jaws. The configuration of FIG. 1A, however, is perhaps the most useful overall because it allows the device to be operated on the upper arm, shoulder, back or chest by the ipsilateral hand while the wrist is in a neutral and comfortable position. With the correct angular placement on the upper body, it also puts the handles within easier reach of the contralateral hand.

Producing the slide bar in separate segments that can be united to form a whole is useful for device portability. In addition, the entire apparatus ought to be lightweight to make it easier to transport and improve manipulability and ease of use.

Depending upon the placement of the clamp on the body, the jaws may well encounter strong torsional stress as the anatomy, owing either to its possibly curved or otherwise unlevel shape or either to its uneven density or makeup, potentially exerts force in a direction that is at an angle to the slide bar rather than just directly backwards along it in parallel fashion, as is the case with most applications of the traditional bar clamp that is used to hold inanimate objects, such as a piece of wood, which are typically uniform in density with flat and rectilinear surfaces. The torsion at play works to move the jaws and their attachments away from one another as it tries to rotate them in opposite directions about the axis of the slide bar. The torsion makes it more difficult to release the holding force in the traditional bar clamp as it creates friction along the longer lateral sides of the slide bar that the release mechanism in existing clamps does not address. The prototypical bar clamp employs holes in its drive and brake levers with contours that match the outline of the slide bar and just allow it to pass, leaving a limited space vertically to allow them to engage and disengage from the slide bar with a slight variation in angle. There is no wiggle room, however, horizontally, and the slide bar cannot rotate or move laterally. The torsion hence creates unwanted horizontal friction between the sides of the slide bar, even if they are indented, and the levers that is unrelieved by pressing the release handle, which simply frees the bar from the levers vertically.

Figure 5A:
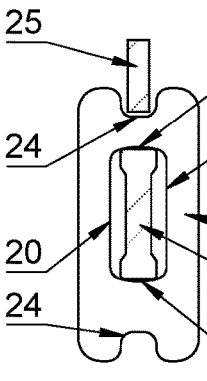
FIG. 5A is a front view of a drive or brake lever with cross sections of both the slide bar, as it passes through the hole in the lever, and the edge of an adjacent housing wall.
Figure 5B:
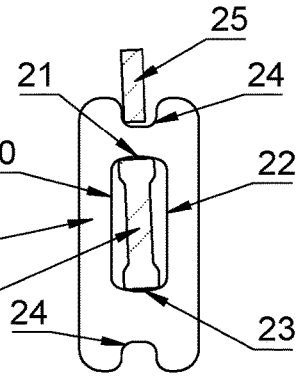
FIG. 5B is the same as FIG. 5A except the slide bar and the adjacent housing wall are rotated to the maximum degree in relation to the drive or brake lever.

To solve this problem, the current invention enlarges the hole in the drive and brake levers to enable the slide bar to rotate to a certain degree toward either side. FIGS. 5A and 5B depict one such lever 18 along with a cross section of the slide bar 19 as it passes through the enlarged hole 20-23. The hole cannot simply be larger horizontally to prevent lateral contact with the slide bar as this would cause the vertical distance between the slide bar and the lever to vary as it rotates, changing the angles necessary for engagement and disengagement of the slide bar in its normal operation and potentially rendering the handgrip body unable to lock into place or to release. What is necessary is a circular arc at the top 21 and bottom 23 of the hole that preserves a constant distance between the levers and the slide bar as it rotates, keeping the aforementioned angles the same regardless of position, preserving the primary function of the bar clamp.

Since an entirely circular opening that would allow full rotation would require the levers to be rather wide, necessitating the trigger handle and the handgrip body that houses them to be concomitantly wider to accommodate them, notches 24 are instead introduced in the top and bottom edges of the levers. One or the other notch, depending upon the lever's orientation, straddles the edge of a wall 25 in the housing of the handgrip body, limiting how far the slide bar is able to rotate in relation to the housing and preventing it from contacting the straight lateral edges 20, 22 of the opening in the lever, generating unwanted friction. To prevent this undesired friction, the amount of possible rotation of the notch before it hits the wall, as seen in FIG. 5B, needs to be less than the degree of possible rotation of the slide bar in the opening. FIG. 5B demonstrates the maximum possible rotation, in contrast to FIG. 5A, which shows none. The resultant friction generated by the contact between the levers and the housing is of no consequence, because they move together in unison along the slide bar upon release.

Figure 6:
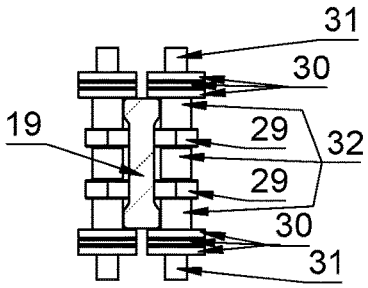
FIG. 6 is a front view of a cross section of the slide bar sandwiched in between a pair of assemblies, comprised of radial and thrust ball bearings, spacers and a shaft.
Figure 7A:
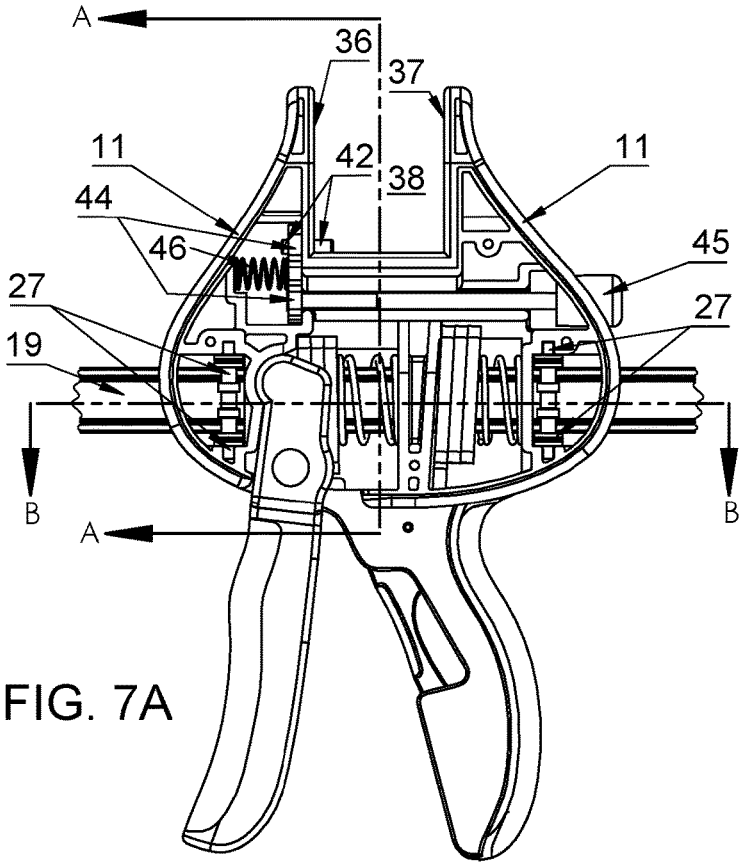
FIG. 7A is a side view of the trigger handle and handgrip body that are part of the modified quick-release bar clamp of FIG. 1A with both the handgrip body cover and blocks, covering the ball bearing assemblies, removed to reveal the handgrip body's contents.
Figure 7B:
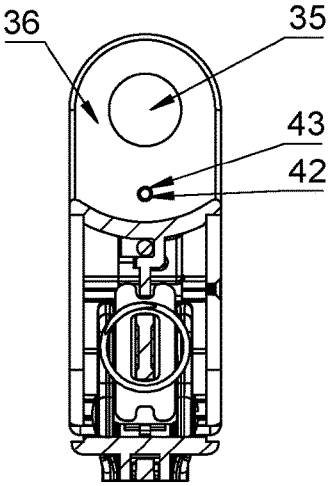
FIG. 7B is a cross-sectional view of the handgrip body of FIG. 7A and its contents taken along the line A-A of FIG. 7A.
Figure 7C:
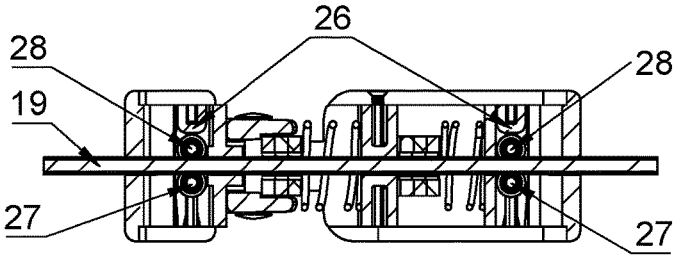
FIG. 7C is a cross-sectional view of the handgrip body of FIG. 7A and its contents taken along the line B-B of FIG. 7A.
Figure 8A:
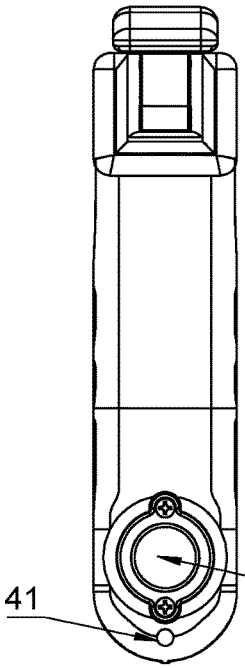
FIG. 8A is a front view of the moveable jaw that is featured as part of the modified quick-release bar clamp of FIG. 1A.
Figure 8B:
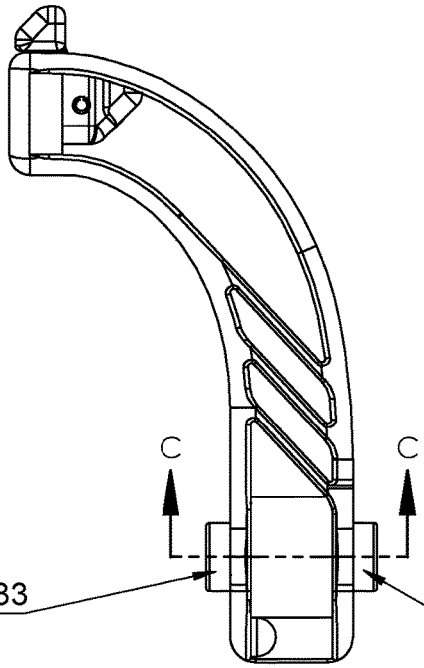
FIG. 8B is a side view of the moveable jaw of FIG. 8A.
Figure 8C:
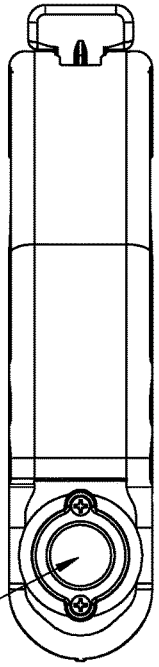
FIG. 8C is a back view of the moveable jaw of FIG. 8A.
Figure 8D:
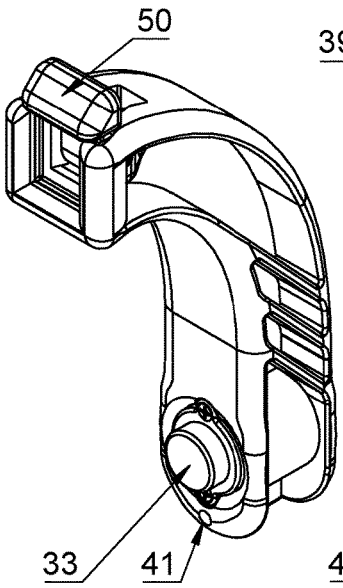
FIG. 8D is a perspective view of the moveable jaw of FIG. 8A.
Figure 8E:
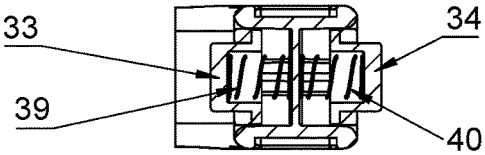
FIG. 8E is a cross-sectional view of the moveable jaw of FIG. 8B taken along the line C-C of FIG. 8B.
Figure 8F:
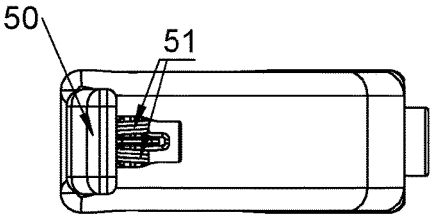
FIG. 8F is a top view of the moveable jaw of FIG. 8B.
Figure 8G:
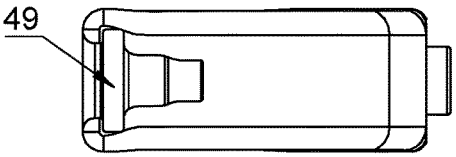
FIG. 8G is another top view of the moveable jaw of FIG. 8B with the lever, double torsion spring and pin removed to reveal the recess intended for the insertion of an attachment end.
Figure 9A:
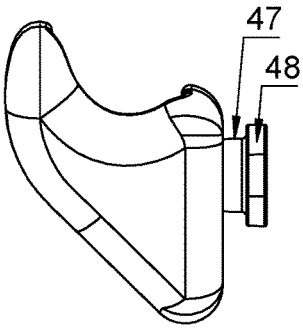
FIG. 9A is a side view of one of the attachments featured as part of the modified quick-release bar clamp of FIG. 1A, complete with an attachment end.
Figure 9B:
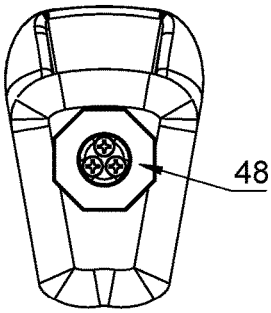
FIG. 9B is a back view of the complete attachment of FIG. 9A.

While these changes to the levers address the friction that any torsional stress may generate between them and the slide bar, there is still the matter of the friction between the slide bar and handgrip body through which it passes. To reduce this friction and make it easier to pull back the handgrip body upon release, the invention employs ball bearings in a manner that is opposite in nature to how they usually work. Assemblies comprised of one or more ball bearings, which are stacked on a shaft with or without separating spacers, are positioned on either side of the slide bar at both ends of the handgrip body. FIG. 6 depicts a cross section of the slide bar 19 that is sandwiched in this way between a pair of such ball bearing assemblies, while FIGS. 7A and 7C together show how four of these assemblies 27, 28 are arranged in this manner next to the slide bar within the handgrip body. The blocks 26 that secure the assemblies in place have been removed from one side of the slide bar to allow the assemblies to be seen. This particular assembly consists of a pair of radial ball bearings 29 stacked in the middle of two thrust ball bearings 30 on a round shaft 31 with three spacers 32 separating them all from each other. In this configuration, the slide bar contacts the ball bearings instead of the housing of the handgrip body, which utilizes openings for the slide bar that are big enough to ensure that is the case. The thrust ball bearings on the top end of the two left shafts and the bottom end of the two right shafts are not essential as the clamp force will not exert any undue pressure on them.

The use of radial ball bearings serves to relieve any friction against the sides of the slide bar generated by the previously noted torsional stress, while the employment of thrust ball bearings addresses any friction against the top and bottom edges of the slide bar. While radial ball bearings typically work by relieving the friction from the radial load of a shaft assembly as it rotates in tandem with the inner ring, in this arrangement, the shaft assembly and inner ring both remain stationary while the outer ring rotates and rolls against the track of the slide bar as it moves linearly along, functioning like a yoke-type track roller. In a similar fashion, while thrust ball bearings usually relieve the friction from an axial load placed on the shaft washer by a rotating shaft assembly, in this scenario, the shaft assembly remains stationary as the washer spins on its own against the track of the slide bar as it moves linearly along. The normal arrangement of the shaft and housing washers is flipped in the latter case with the washer with a tight fit, usually referred to as the "shaft" washer, now arranged next to the housing of the handgrip body and the washer with the looser fit, usually referred to as the "housing" washer, now placed against the slide bar in order that it may spin freely. The use of other types of bearings or bushings, including, but not limited to, combined radial thrust, angular contact, self-aligning, roller, needle, linear, track rollers, and cam followers, is also possible.

Other possible ways of reducing the friction between the sides of the slide bar and the handgrip body include making the sides of the slide bar as smooth and frictionless as possible and applying an anti-friction coating to them.

As a fail-safe measure to ensure that release of soft tissue from the jaws is not a problem, the moveable jaw 4 can incorporate a quick-release mechanism to disconnect it from the handgrip body 11. One such mechanism is illustrated in FIGS. 1B, 7A, 7B, and 8A-8E. The moveable jaw, isolated in FIGS. 8A-8G, features two round coaxial buttons 33, 34 on opposite sides, each of which fit into a through hole 35 in the top of each of the side walls 36, 37 forming a gap 38 in the handgrip body 11 into which the base of said jaw fits. The buttons are outfitted with springs 39, 40 that allow them to be depressed far enough to remove or insert the jaw into the gap. When the spring-loaded buttons are aligned with the holes upon insertion, they pop into place. The two inserted buttons in the holes also serve as a revolute joint that allows the moveable jaw to rotate about their mutual axis. The moveable jaw in addition features a hole 41 below one of the buttons 33 intended for insertion of a pin 42 that sticks out of a hole 43 in the side wall 36 of the gap of the handgrip body. When inserted, the pin locks the jaw into place, preventing it from rotating. The pin is connected to a spring-loaded plate 44, which in turn is connected to a button 45 that protrudes from the handgrip body. The pin is held in place in its locking position by the force of the spring 46. When the button 45 is pressed, the pin retracts into the handgrip body and the moveable jaw is free to rotate. When the clamp is on someone's body, doing so relieves the torsional stress and the friction that it generates, allowing for the handgrip body and jaw to be more easily pulled away from the soft tissue in the clamp's grasp. It is also possible to rotate the jaw enough to be able to wiggle the soft tissue free. The mechanism accomplishes both of these objectives while keeping the jaw safely attached to the rest of the device without letting it hit the ground or another part of the user's body.

Just as the moveable jaw can be disengaged in the preferred embodiment, the stationary jaw can be as well to allow both to be swapped for ones of different length. There are times when it is desirable to have different length jaws in opposition to each other to allow asymmetrical positioning on the body, as well as the application of torsional force to twist the soft tissue in its grasp.

Different attachments to the stationary and moveable jaws allow for devices according to the invention to change their soft tissue contact surfaces to be better suited for varying parts of the body and to interact with them in differing ways. The attachments (e.g. 12, 13) themselves should be able to connect with the jaws in multiple orientations, including, but not limited to, right-side up and upside down, to allow for better ease of reach to the trigger handle 14 and handgrip 15 when positioning the device on the body. One such mechanism is depicted in FIGS. 1B, 8A-8G, 9A and 9B. The attachment end is comprised of a stem 47 that terminates in an insert 48 in the shape of an octagon. Other shapes are also possible, including, but not limited to, a square and hexagon. The stem can be either perpendicular to the tab, as illustrated, or at an angle to it. The insert fits into a slot 49 that is part of a recess at the free end of the stationary or moveable jaw. Using a polygonal shape for the insert allows the attachment to be put into the recess in a number of orientations, equal to how many sides the polygon has, without allowing for any farther rotation or other movement of the attachment after its insertion. The midsections of the slot's longer walls are removed for part of the way down to accommodate both the attachment stem, jutting out of the free end of the jaw, on one side and a lever on the other. One end of the lever 50 protrudes out over the insert, holding it in place, while the other end of the lever is anchored to the jaw by a pin about which it may rotate away from the insert. The bottom edge of the lever is partially rounded to allow it to rotate in this way and partially flat to prevent it from rotating any farther than perpendicular in the opposite direction. The pin also serves as a mandrel for a double torsion spring 51 that keeps the lever from rotating until one pulls it back, against the force of the spring, to insert or remove the attachment end. The rate of the spring needs to be high enough to resist any upward pressure resulting from the holding force of the bar clamp and prevent the attachment from slipping out while the clamp is in use on the body. Other mechanisms are also possible for holding the attachment end in place and allowing it to be inserted and removed.

Unless otherwise noted, in the subsequent figures for all the various attachments to the assembly, the spots where they are to be connected to the free ends of the jaws are indicated in the left or lone side views by simple flat surfaces on the left edge of the left or lone attachment and the right edge of the right one. The shape and construction of these surfaces and any additions thereon will vary depending upon the particularities of the ultimate mechanism chosen for connecting the attachments with the jaws.

The attachments are preferably constructed with a rigid core made of one or more hard, solid materials covered by an outer layer, extending over at least the soft tissue contact surfaces, that is made of one or more softer, compressible materials. Examples of such hard, solid materials include, but are not limited to, plastic, long fiber reinforced thermoplastic, metal or wood, while examples of such softer, compressible materials include, but are not limited to, thermoplastic elastomer (TPE), rubber or foam. The rigid core can support a substantial compressive load without deforming its shape which is imparted to a more malleable outer layer. If the outer layer were to be responsible alone for imparting the shape of the attachment, with either the rigid core not mirroring its shape or not being present at all, the benefits of the attachment's shape would be largely lost as its contours would readily deform under pressure. The reasons for incorporating the outer layer into the attachment though are to distribute pressure against a potentially uneven tissue density and constitution, thereby reducing pain; to protect the skin from damage; and to generate greater friction against the skin. The outer layer may also have a tread-like groove pattern to further enhance its grip on the skin, helping to prevent the device from squeezing out the soft tissue in its grasp and slipping off the body. While inclusion of the outer layer is preferred, it is not essential.

The attachments may be modified by the addition of a mechanism that heats, cools, and/or vibrates the soft tissue contact surface. Such mechanisms are known in the art and, most commonly, would be housed inside the attachment, although other configurations are possible.

The pair of attachments featured in FIGS. 10A-10G are of general utility. The shape of their soft tissue contact surfaces resembles the opposing contours of the thumb and forefinger when their finger pads are used in a pincer grasp, as seen in FIG. 11. Since sharp curves or edges cause undue pain, the convex surfaces 52 have a gentle curve where they are meant to press directly into soft tissue. The surfaces are relatively flat at their maximum protrusion, creating complementary contours in direct opposition to each other, wherein the maximum pressure is exerted on the soft tissue in its grasp. The top contours 53 or 54, 55 are tangentially rounded away from the gentle curve 52 and continue in a wave-like fashion to create an almost 180-degree bend. In this way, the surface is not likely to cause undue pain when positioning it on the body or when a suboptimal angle of contact with the body is employed. The hourglass-like contours 55, 52, 56 or 57 of the opposing surfaces creates a pinching effect in the middle 52 that makes it less likely for the surfaces to slip off the grasped soft tissue than if they were flatter, because the soft tissue that is not indented forms a physical barrier to slippage. Since the contours diverge from each other on both ends 55, 56 or 57, this occurs regardless of the side from which the device is placed. For example, if employing the device on the hamstrings or triceps, the rest of the leg or arm can be positioned either inside 16 the assembly or outside 17 of it. The choice of positioning will depend not only upon the ease of reach to the trigger handle 14 and handgrip 15 but also the desired depth in the soft tissue for exerting pressure. FIG. 2 provides an example of a person positioning his leg outside of the assembly of FIG. 1A to use it on his quadriceps, while FIG. 3 shows a person placing his leg inside the same assembly to use it on his hip adductors. FIGS. 2 and 3 both feature the assembly equipped with the attachments of FIG. 1A, which are shown in greater detail in FIGS. 10A-10G, demonstrating their pinching effect on the targeted muscles.

The deeper in the soft tissue and the closer to bone that the contact surfaces are positioned, the more advantageous it becomes to place the limb on the outside 17 of the assembly, so as the bottom angled portion of the surface 58 does not impede how far the moveable jaw can be advanced and how close the maximum protruding surfaces 52 can be approximated, primarily from interference from bone and the greater amount of cross-sectional tissue mass near it. The angular displacement of the protruding surfaces 52 from the jaws also divides the pressure they exert into perpendicular force vectors with one component directed toward the opposing surface and the other aimed toward the body, helping to keep the device in place.

On the other hand, the shallower in the soft tissue and the farther away from bone that the contact surfaces are positioned, the more advantageous it becomes to place the limb on the inside 16 of the assembly, so as the bottom angled portion of the surfaces 58 grips the limb and helps prevent the device from slipping off the body. The angled portion 58 purposefully drops away from the protruding surfaces 52 to accommodate, and to be able to circumvent, the greater cross-sectional mass that arises between them when the attachments are positioned in this way. If that angled portion 58 ran parallel to the protruding surfaces, they would not be able to go around the bulkier portion of the limb, while if they ran perpendicular, they would not grip it at all. If the limb were dissimilarly positioned on the outside 17 of the assembly and grabbed at a shallow depth, resulting in only a minimal amount of tissue in its grasp, there would be no tissue present between the bottom of the hourglass-like contours 56, 57 to help prevent slippage, making it that much more likely.

One more feature that counteracts the undesired effect of the contact surfaces squeezing out the soft tissue in their grasp is their offset nature. One attachment of the pair extends the end of its contact surface 54 out farther than the opposing one 53 does and likewise also begins it 57 after the opposing one 56. This offsetting helps prevent slippage as it creates a greater indentation of the grasped tissue on one side, while the tissue is blocked more from getting squeezed out by the jutting out of the surface on the opposing side. The slight size difference of the opposing surfaces has a similar effect. This offsetting and size difference are similar to that seen between the thumb and forefinger when they are used in a pincer grasp. On another note, the rounds 59 between the top edges 53, 54 and the lateral ones 60 cannot be too gradual, large or wide or else they will encourage slippage. On the other hand, if they are too sharp, small or narrow, they will cause undue discomfort or pain. The right balance in curvature must be struck. In addition, the side edges 60 are tapered inward to allow for better placement of the contact surface in body regions such as the axilla and groin where there is less room to maneuver.

The degree of curvature of the contact surfaces 55, 52, 56 or 57, 58 allows for their positioning on the body in a range of angles, as may be desired when there is more than soft tissue in their grasp. Such is the case when one surface is placed on the posterior of the body and the other surface, which could be an altogether different attachment, is positioned on the anterior of the body with the slide bar 10 of the assembly either going over the shoulder, through the legs or lateral to the body. In these instances, the targeted tissue will be compressed against the bone or other bodily structure that comes between it and the opposing contact surface. The breadth of degree of curvature allows for greater freedom in what positions are possible.

By way of contrast to all of these benefits inherent in the unique contours of this pair of attachments, if the opposing contact surfaces were both simply spherical in shape, they would compress a more limited amount of soft tissue in their grasp as their contours would recede more quickly from the single point where they would potentially meet (an effect that is made progressively worse with a decreasing spherical radius); the radial symmetry of the contact surfaces around this single point, which consequently lacks any unobstructed surrounding space, such as occurs around 53, 54, 59 and 60, would impede them from pinching off soft tissue that is more proximal to either bone or skin, considering that either the bone itself or the deeper tissue respectively would get in the way of the greater approximation of the contact surfaces (an effect that is made progressively worse with an increasing spherical radius); and the opposing spherical contact surfaces would be more prone to slippage as the aforementioned effect of hourglass-like contours could only be achieved with the placement of over half the contact surfaces on the body in order for at least some soft tissue to reside at both ends of the "hourglass."

On the other hand, if the opposing contact surfaces were both simply concave contours, they would not be complementary in shape, would not approximate as they got closer to each other, and would not be able to produce the pinching effect. Therefore, they would need to be placed on opposite sides of hard tissue to use it as the counterforce for compression instead. For example, they could be placed on opposite sides of the upper leg with the femur between them. Beyond the prior discussed shortcomings of this approach, the degree of concavity would only fit certain body parts with a similar convexity well, and the more ill-fitting that they are, the less effective that the surfaces would be.

The features of the pair of attachments in FIGS. 10A-10G, however, relieve all of these problems associated with simply spherical or concave contours.

Figure 1B:
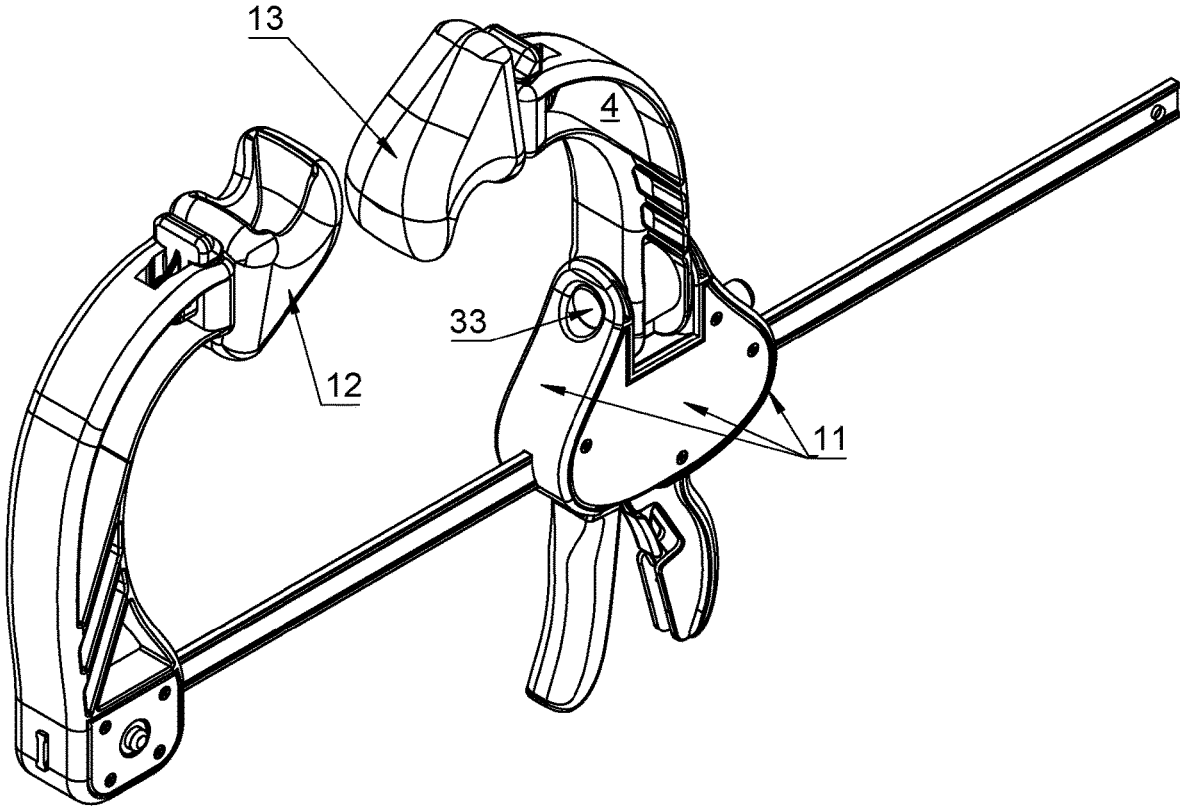
FIG. 1B is a perspective view of the modified quick-release bar clamp of FIG. 1A with a different orientation of the same example attachments.
Figure 13A:
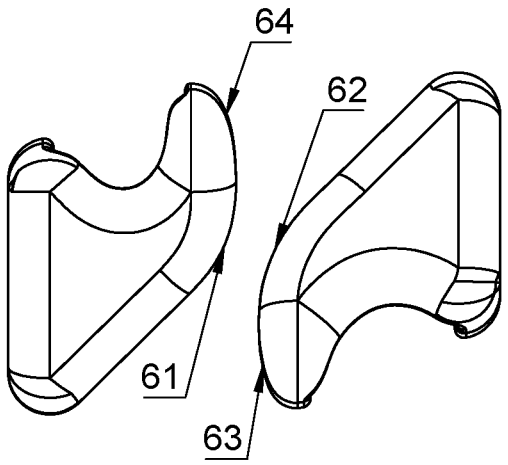
FIG. 13A is a side view of a different possible alignment for the attachments of FIG. 10A.
Figure 13B:
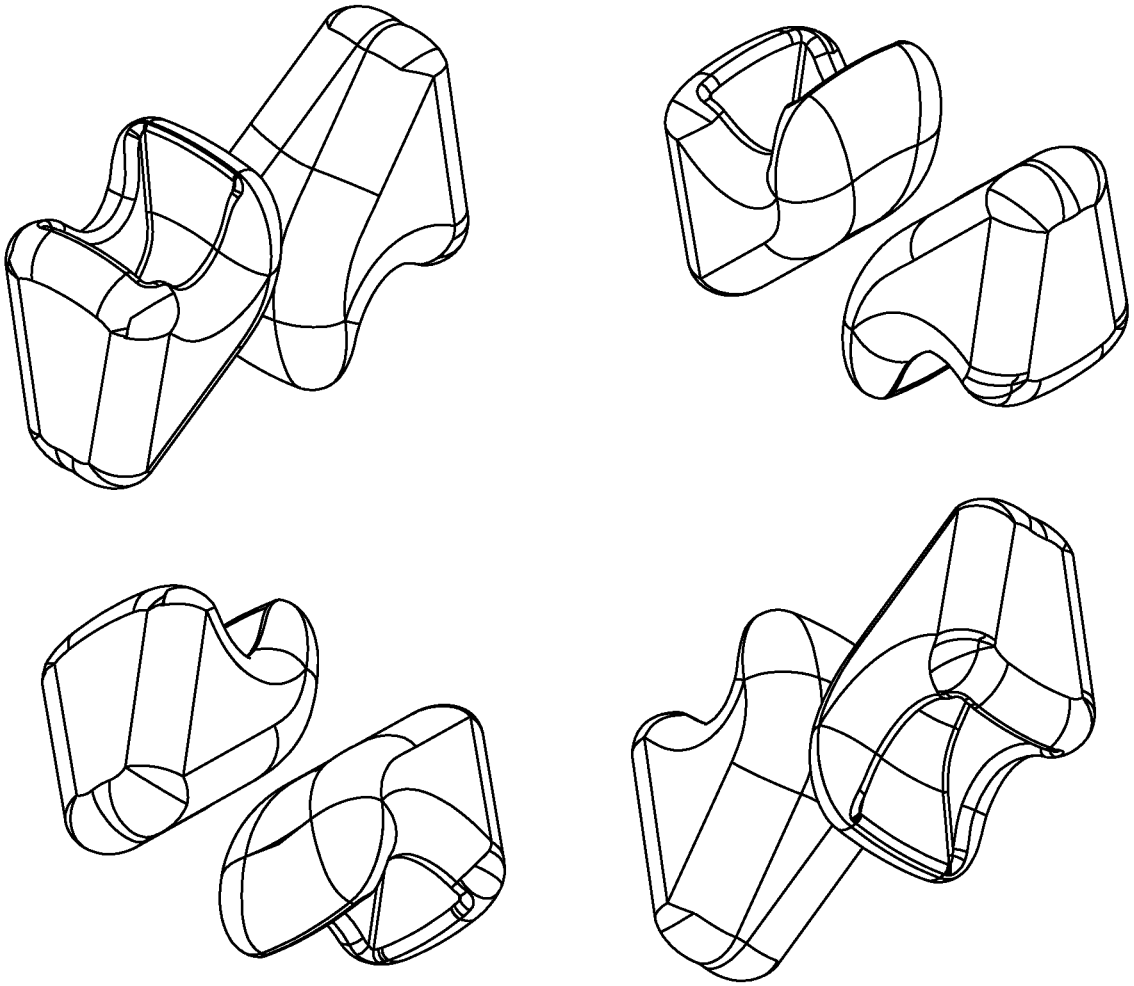
FIG. 13B is four perspective views of the aligned attachments of FIG. 13A.

Yet another method of utilization for this pair of attachments is made possible when inverting one of them before connecting it to a jaw, as illustrated in the full assembly in FIG. 1B, as well as independently in FIGS. 13A and 13B. In this configuration, the portions of the contact surfaces that come into closest proximity to each other shift to 61 and 62. The effect of this realignment is to generate a shearing force on the grasped tissue with the crest 63 of the wave pushing it one way and the opposite crest 64 shoving it the other, leaving the compressed tissue in between 61 and 62 to be pulled in opposite directions, thereby stretching it. This shearing force aids in breaking up scar tissue and relieving the tension of stiff tissue or trigger points. Other embodiments achieving this effect are also possible. The key feature in this arrangement is having complementary surfaces that protrude toward the opposing surface at one end where the opposing surface draws back, and similarly recedes at the other end where the opposing surface advances.

Figure 14A:
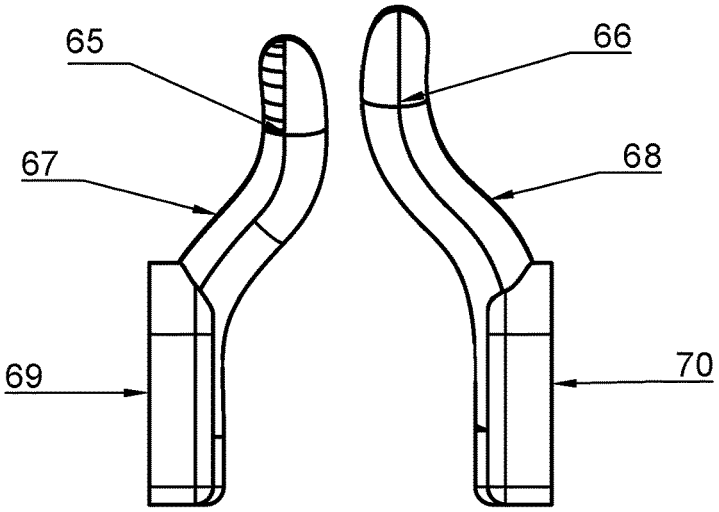
FIG. 14A is a side view of a different embodiment of the aligned attachments of FIG. 10A.
Figure 14B:
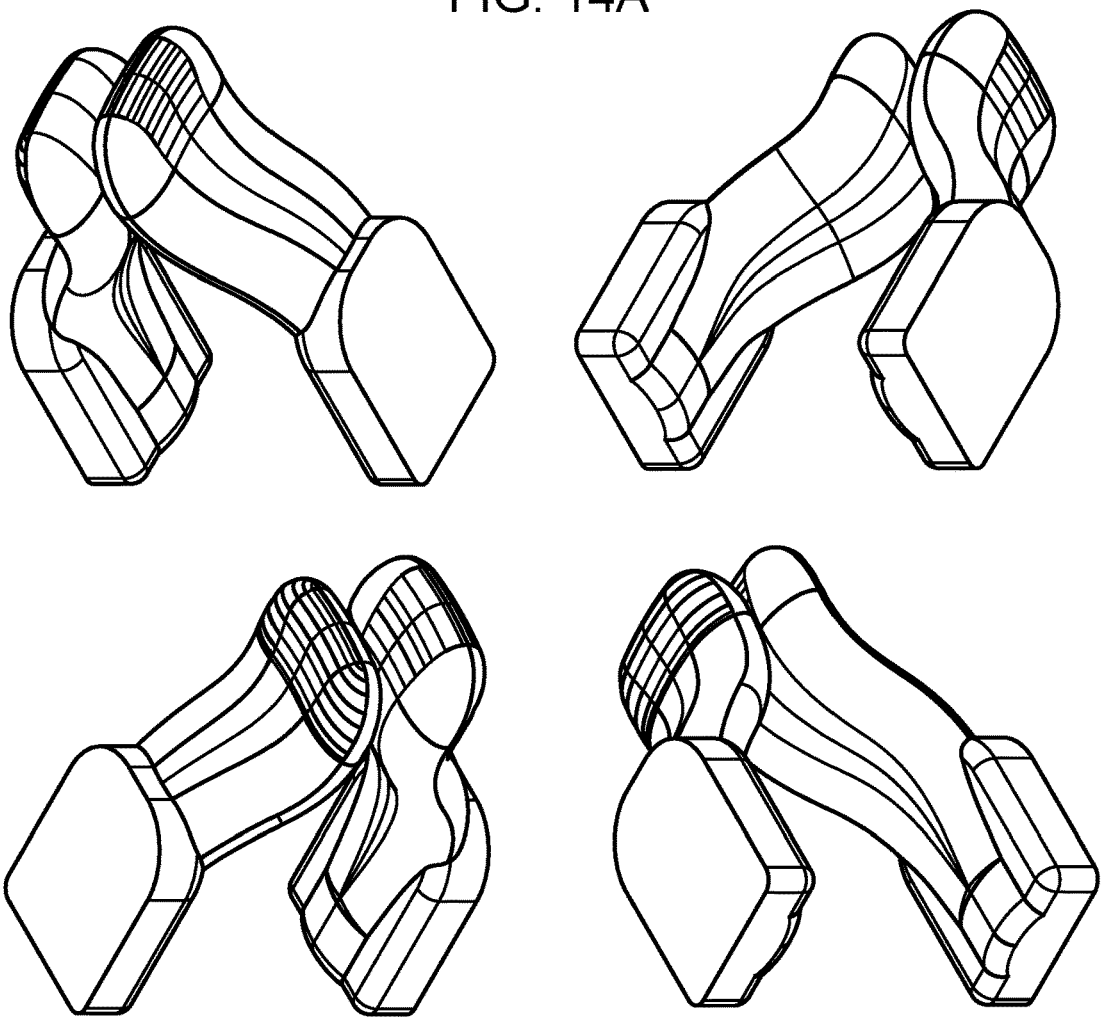
FIG. 14B is four perspective views of the aligned attachments of FIG. 14A.

In an altered embodiment of this pair of attachments, as shown in FIGS. 14A and 14B, their top ends 65, 66 and contact surfaces remain the same while the spots 69, 70 where they connect to the jaws are placed lower down than they were before, to clear the space above 67 and 68. Doing so allows the contact surfaces to be placed on either side of one cheek of the buttocks or the posterior wall of the axilla without encumbrance. The tradeoff is that the new location of the connection spots narrows the positioning possibilities elsewhere.

Figure 10A:
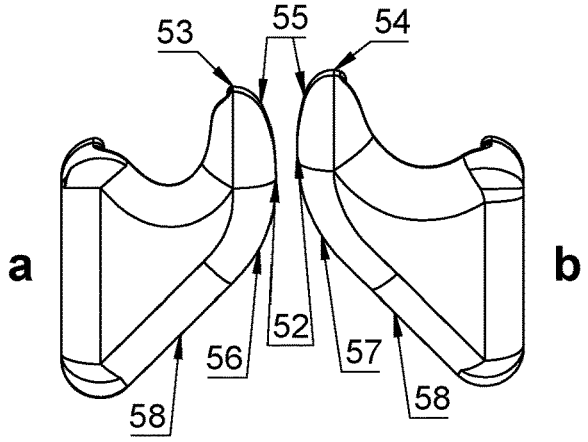
FIG. 10A is a side view of an aligned pair of attachments (a and b) intended for general use.
Figure 10B:
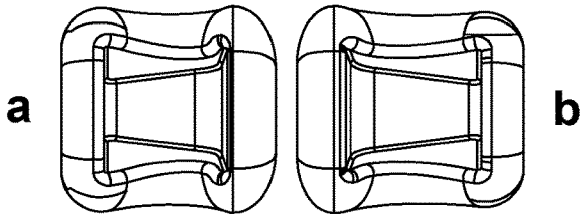
FIG. 10B is a top view of the aligned attachments of FIG. 10A.
Figure 10C:
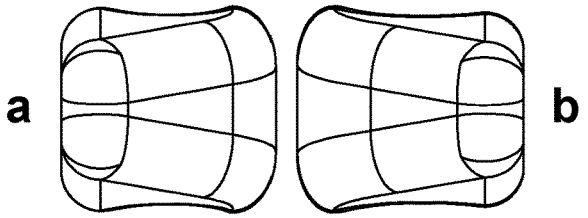
FIG. 10C is a bottom view of the aligned attachments of FIG. 10A.
Figures 10D, 10E:
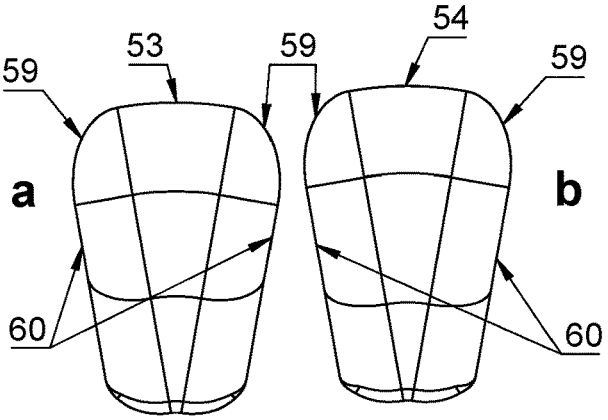
FIG. 10D is a front view of the attachment (a) on the left of FIG. 10A.
FIG. 10E is a front view of the attachment (b) on the right of FIG. 10A.
Figure 10F:
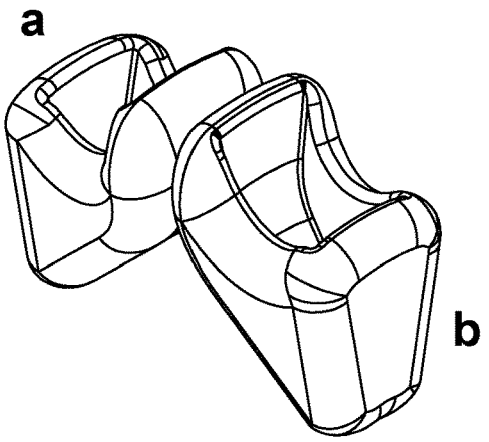
FIG. 10F is a perspective view of the aligned attachments of FIG. 10A.
Figure 10G:
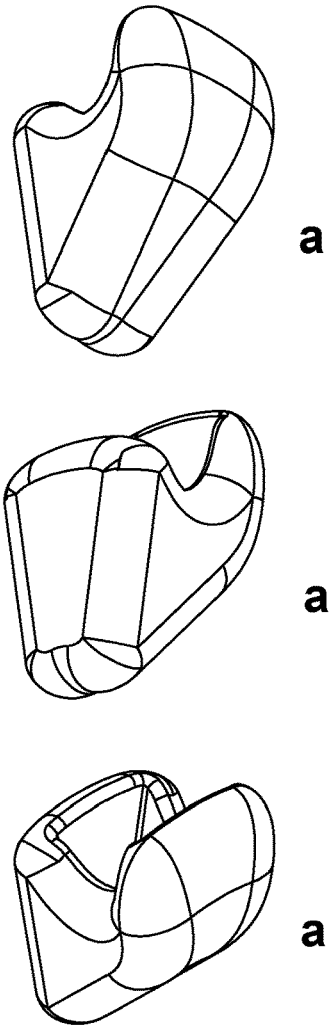
FIG. 10G is three perspective views of the attachment (a) on the left of FIG. 10A.
Figure 11:
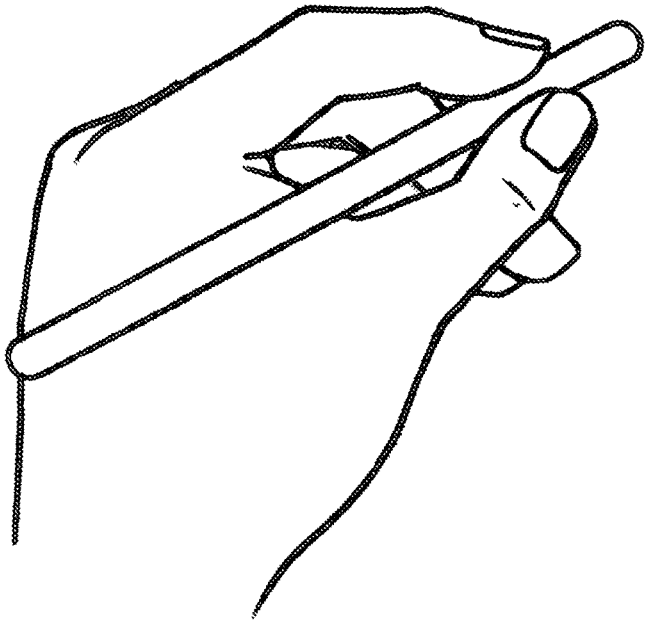
FIG. 11 is a perspective view of a hand holding a rod between the finger pads of the forefinger and thumb in a pincer grasp.
Figure 12:
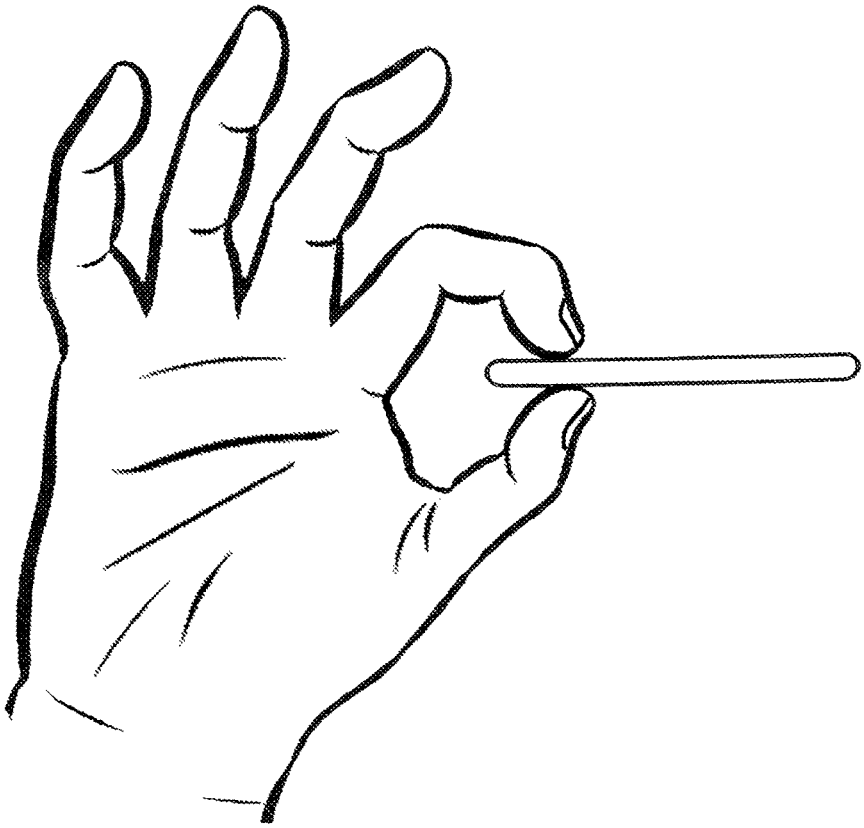
FIG. 12 is a perspective view of a hand holding a rod between the fingertips of the forefinger and thumb in a pincer grasp.

The next pair of attachments in FIGS. 15A-15H is also of general utility and applies the principles demonstrated by the pair in FIG. 10A to much shorter soft tissue contact surfaces 71 that are about the width of a finger. The shape of their surfaces indeed resembles the opposing contours of the thumb and forefinger when their fingertips are used in a pincer grasp, as illustrated in FIG. 12, rather than their finger pads as is the case with the pair in FIG. 10A. The result is a shape that, when inverted, resembles a slightly curled tongue sticking out of a mouth, whereas the attachments in FIG. 10A look more like the portion of a mitten with four fingers inside it. The carried-over principles include their offset nature, the hourglass-like contours 72, 71, 73, the tapered side edges 78, the bottom angled portion of the contact surfaces 76, and rounds that are neither too sharp nor too gradual 77. Furthermore, the convex curves along the top 75 help the contact surfaces to deflect and ride over bone and lift soft tissue away from its periosteum, making it much easier and less uncomfortable to target the insertion and origins of muscle. On the other hand, with the limb positioned inside 16 the assembly, the concave surfaces 74 along the underside facilitate the grasping of soft tissue near the epidermis, as their curves direct pressure centripetally, rendering slippage less likely. Their curved recesses also create room for displaced tissue to reside, allowing for greater compression, and additionally mold it into a ridge that acts as a barrier to prevent slippage of the contact surfaces off the body. On top of that, the curved ends make it easier to target tissue under a boney edge, such as the clavicle or pelvic brim, as they can hook over or dig under the edge, depending upon their orientation. Alternate not-as-versatile embodiments of this pair of attachments replace the underside concavity 74 with either a convexity or flat surface, or substitute either a concavity or flat surface for the top convexity 75.

The shorter surfaces of this pair of attachments are advantageous in places where the soft tissue has little depth, such as lateral to the femur and humerus, as well as the top edge of the trapezius. They are also useful in grabbing narrow tendons or taut bands of muscle; maneuvering into tighter spaces such as under the pectoralis major and minor; fitting into creases such as the medial and lateral bicipital grooves; and slipping in between adjacent layers of muscle, facilitating the breakup of adhesions. Furthermore, the overall diminished size is better suited for smaller muscles like the deltoid. Since the shortened surfaces translate to a smaller area of contact, the pressure per square inch increases accordingly and it's possible to apply even greater pressure to stubborn trigger points.

A largely similar but somewhat narrower embodiment is illustrated in FIGS. 16A-16H. With a width that is nearly as short as its height, the contact surfaces 79, 80 may now be positioned at angles that the former longer width precluded. They may also fit into even tighter junctures that arise especially around joints such as the shoulder, elbow, hip and knee. The nooks around the acromion and coracoid process are prime examples. The freedom to rotate the orientation of the assembly without much effecting the targeting of the contact surfaces brings the trigger handle 14 and handgrip 15 into easier reach and thereby increases the maneuverability and positioning possibilities of the whole assembly. The smaller area of the contact surfaces also increases the pressure per square inch even more.

Figure 15A:
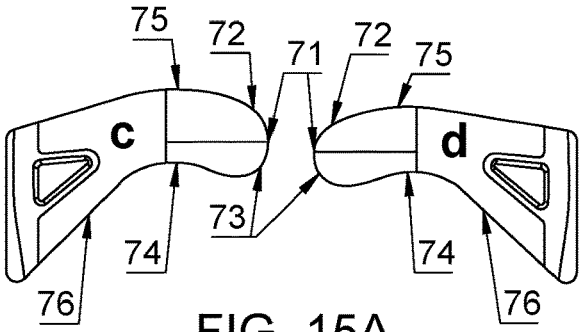
FIG. 15A is a side view of an aligned pair of attachments also intended for general use.
Figure 15B:
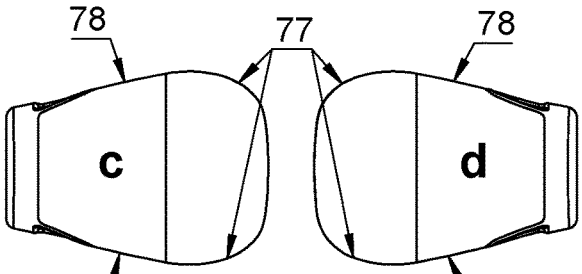
FIG. 15B is a top view of the aligned attachments of FIG. 15A.
Figure 15C:
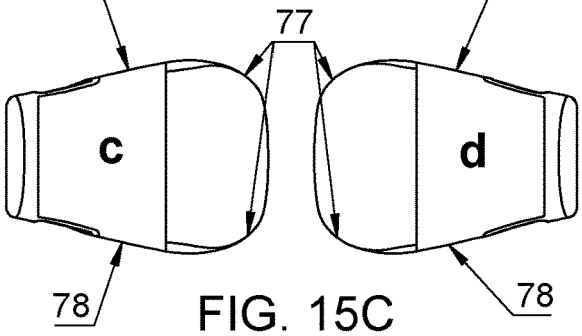
FIG. 15C is a bottom view of the aligned attachments of FIG. 15A.
Figure 15H:
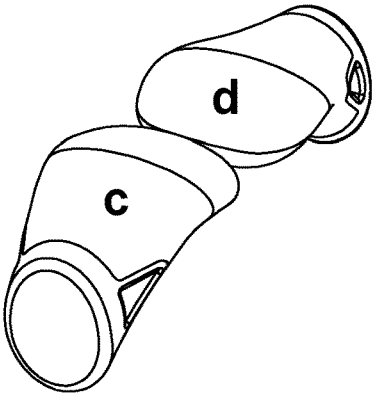
FIG. 15H is three perspective views of the aligned attachments of FIG. 15A.
Figure 15H:
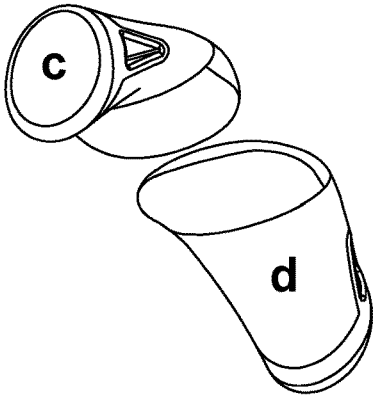
Figure 15H:
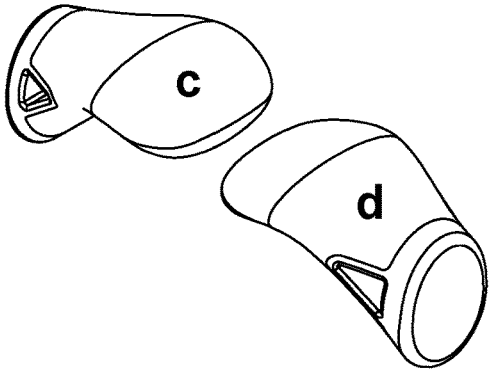
Figure 15D:
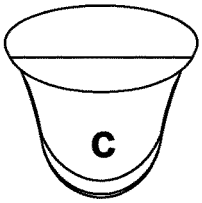
FIG. 15D is a front view of the attachment (c) on the left of FIG. 15A.
Figure 15E:
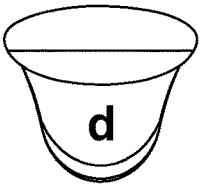
FIG. 15E is a front view of the attachment (d) on the right of FIG. 15A, vertically aligned with the attachment (c) of FIG. 15D.
Figure 15F:
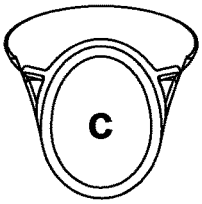
FIG. 15F is a back view of the attachment (c) on the left of FIG. 15A.
Figure 15G:
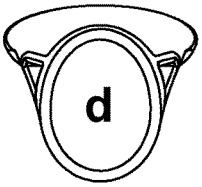
FIG. 15G is a back view of the attachment (d) on the right of FIG. 15A, vertically aligned with the attachment (c) of FIG. 15F.
Figure 16A:
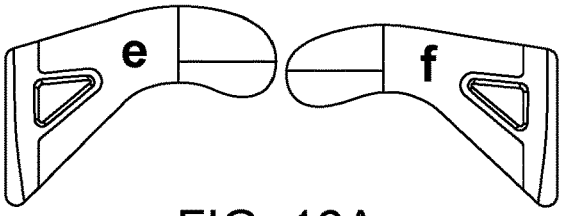
FIG. 16A is a side view of different embodiments (e and f) of the aligned attachments of FIG. 15A.
Figure 16B:
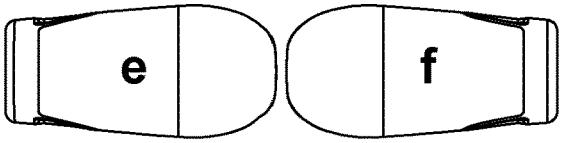
FIG. 16B is a top view of the aligned attachments of FIG. 16A.
Figure 16C:
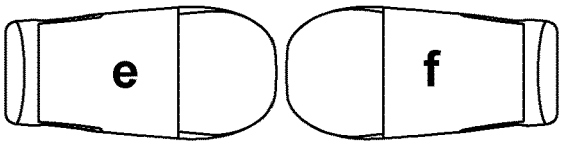
FIG. 16C is a bottom view of the aligned attachments of FIG. 16A.
Figure 16D:
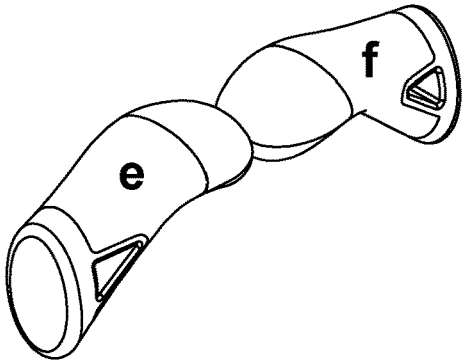
FIG. 16D is a front view of the attachment (e) on the left of FIG. 16A.
Figure 16D:
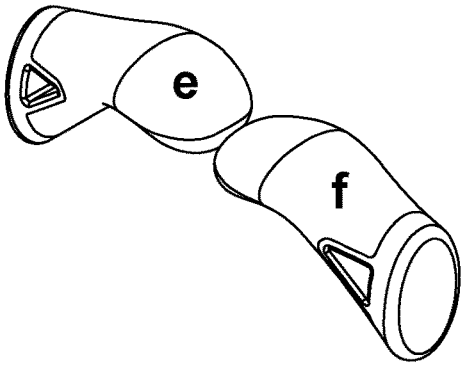
Figure 16D:
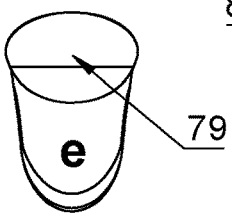
Figure 16E:
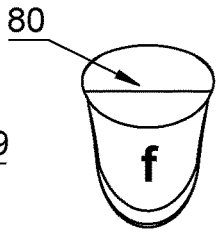
FIG. 16E is a front view of the attachment (f) on the right of FIG. 16A, vertically aligned with the attachment (e) of FIG. 16D.
Figure 16H:
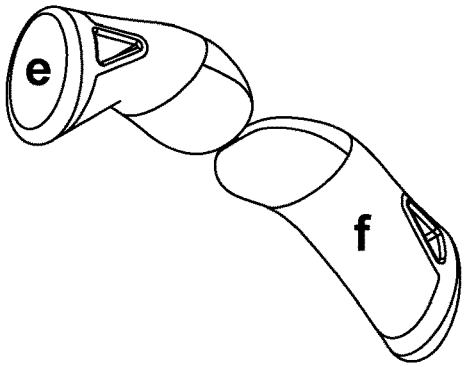
FIG. 16H is three perspective views of the aligned attachments of FIG. 16A.
Figure 16F:
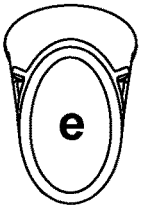
FIG. 16F is a back view of the attachment (e) on the left of FIG. 16A.
Figure 16G:
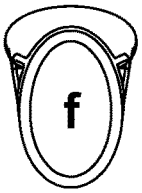
FIG. 16G is a back view of the attachment (f) on the right of FIG. 16A, vertically aligned with the attachment (e) of FIG. 16F.
Figure 17A:
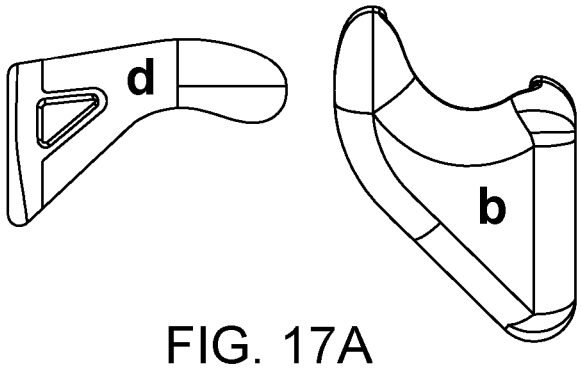
FIG. 17A is a side view of the attachment (d) on the right of FIG. 15A paired with the attachment (b) on the right of FIG. 10A.
Figure 17B:
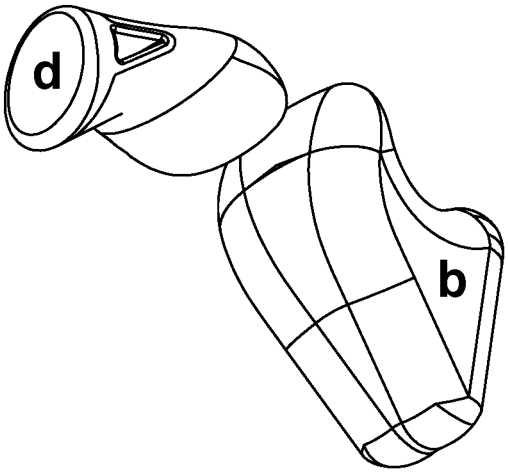
FIG. 17B is a perspective view of the aligned attachments of FIG. 17A.
Figure 17D:
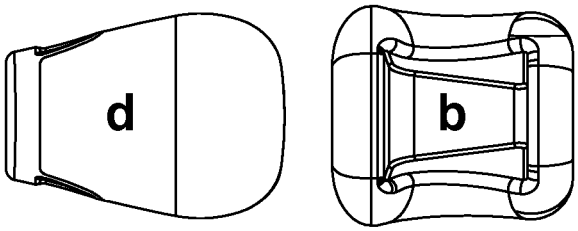
FIG. 17D is a top view of the aligned attachments of FIG. 17A.
Figure 17C:
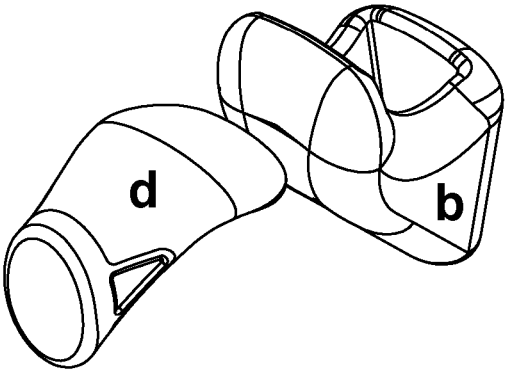
FIG. 17C is another perspective view of the aligned attachments of FIG. 17A.
Figure 17E:
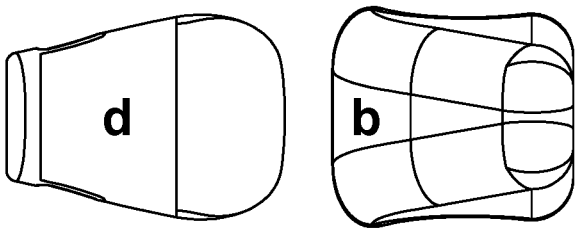
FIG. 17E is a bottom view of the aligned attachments of FIG. 17A.
Figure 18A:
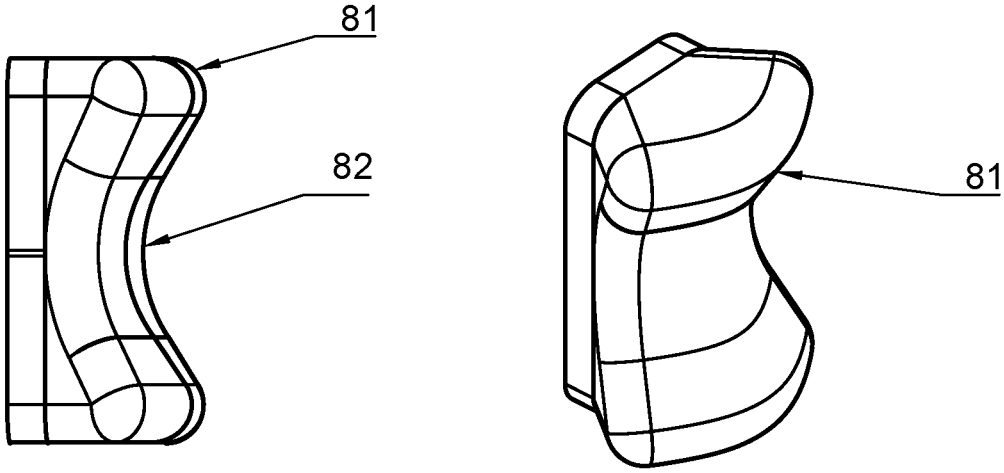
FIG. 18A is a side view of an attachment intended primarily for use over the anterior axillary fold.
Figure 18B:
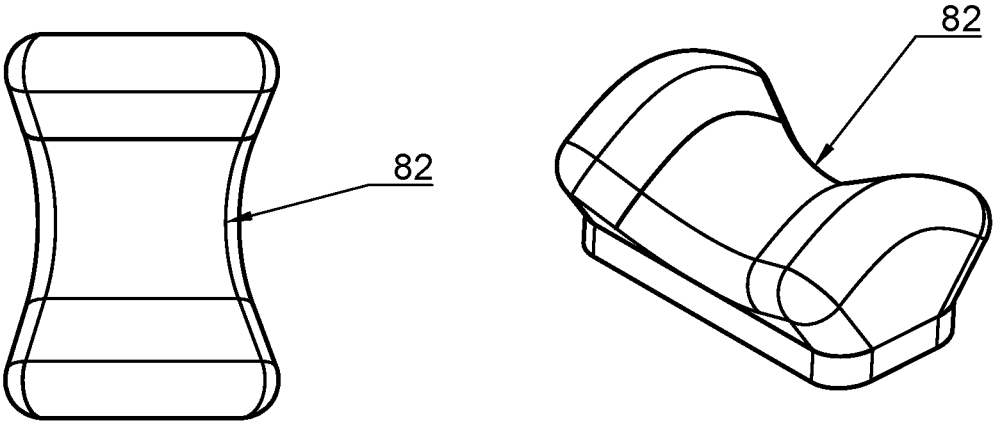
FIG. 18B is a front view of the attachment of FIG. 18A.
Figure 18C:
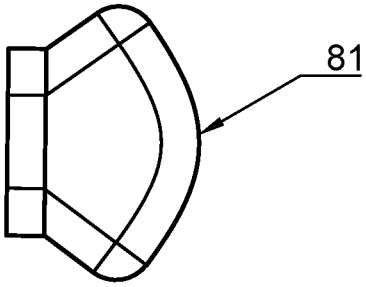
FIG. 18C is a top view of the attachment of FIG. 18A.
Figure 18D:
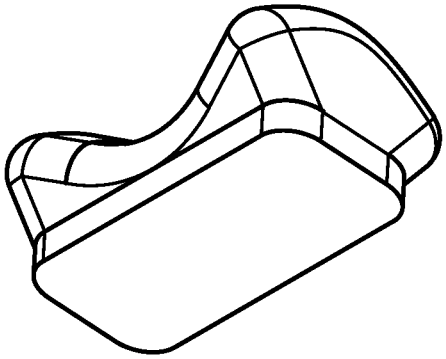
FIG. 18D is three perspective views of the attachment of FIG. 18A.

FIGS. 17A-17E feature the attachment (d) on the right of FIG. 15A paired with the attachment (b) on the right of FIG. 10A as its opposing surface. This combination retains many of the characteristics and benefits of their initially described pairings, including their offset nature and hourglass-like contours, among others. The difference is that the attachment (b) from FIG. 10A helps shove soft tissue up and away from any hard tissue that could interfere with the shorter one (d) from FIG. 15A pressing into said soft tissue, which it can accomplish in a deeper and more focused manner than the broader surface area of the initial opposing attachment (a) from FIG. 10A can. The larger contact surface area of the attachment (b) from FIG. 10A also better prevents displacement of tissue in its direction, leading to greater compression. The tradeoff in the new pairing is that this larger attachment might not fit into spaces, such as fossae and creases, that are as tight or constricted. The narrower embodiment of the one (d) from FIG. 15A, illustrated on the right (f) in FIG. 16A, can also be paired with the taller and broader one (b) on the right of FIG. 10A to similar but even deeper and more focused effect. The taller one (b) from FIG. 10A also makes for a more comfortable and less intense counterpart when using the shorter ones (d, f) from FIG. 15A or 16A to compress soft tissue against bone or some other bodily structure.

Figure 19:
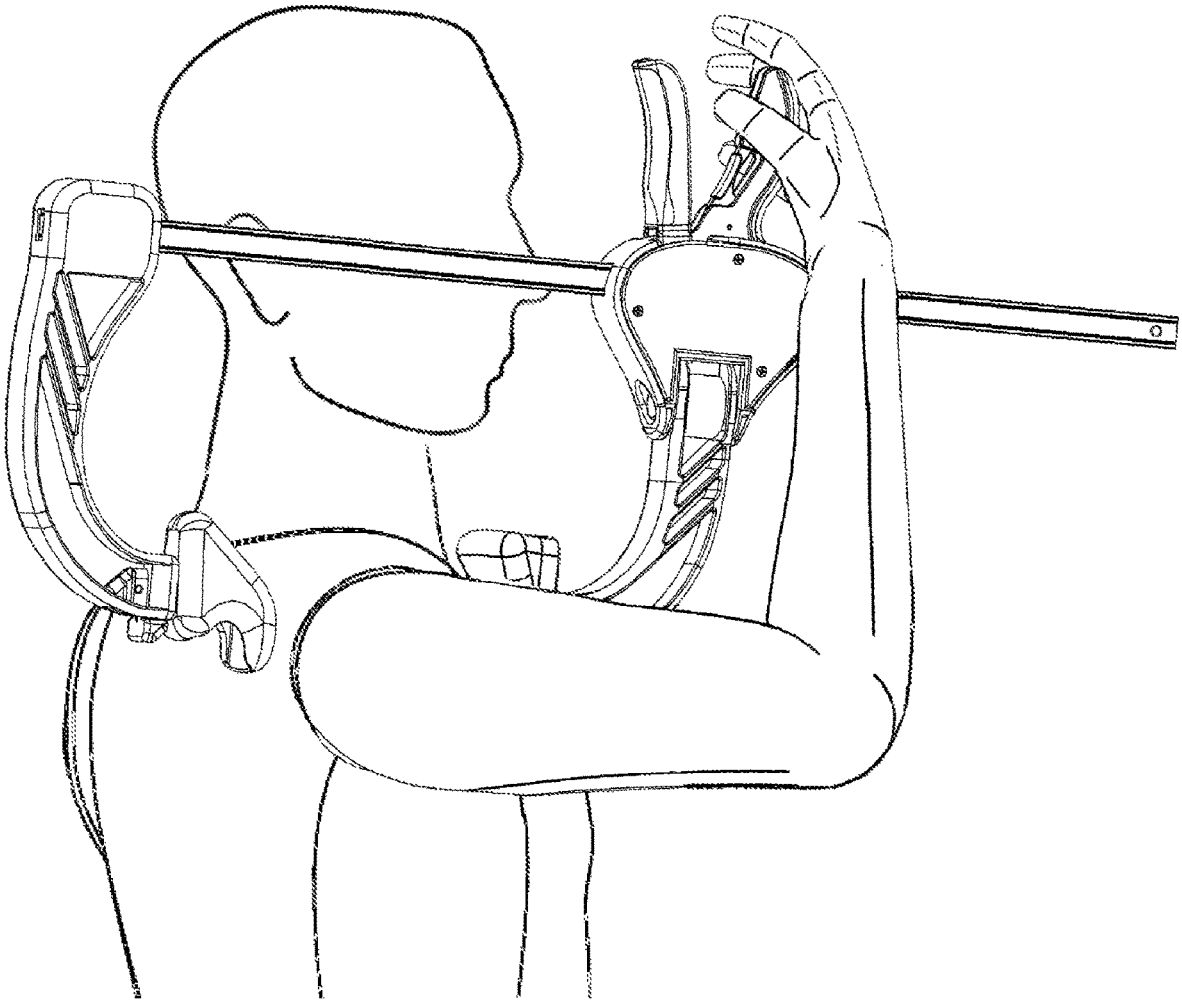
FIG. 19 shows a person using the assembly of FIG. 1A, equipped with both the attachment of FIG. 18A, which is positioned over his anterior axillary fold, and the attachment on the left of FIG. 10A, which is pressing into his upper back.
Figure 20A:
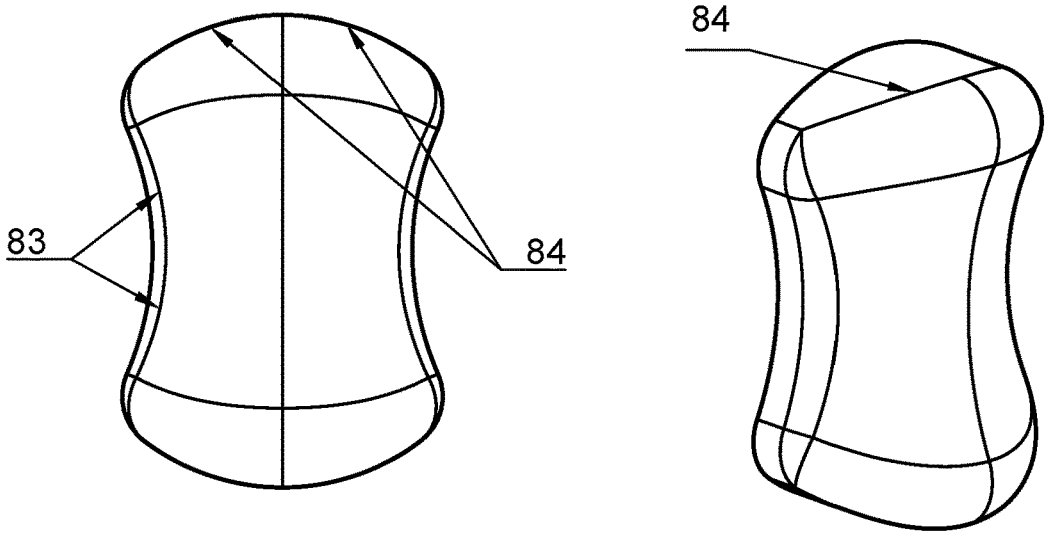
FIG. 20A is a front view of a different embodiment of the attachment of FIG. 18A intended primarily for use over the inguinal crease.
Figure 20B:
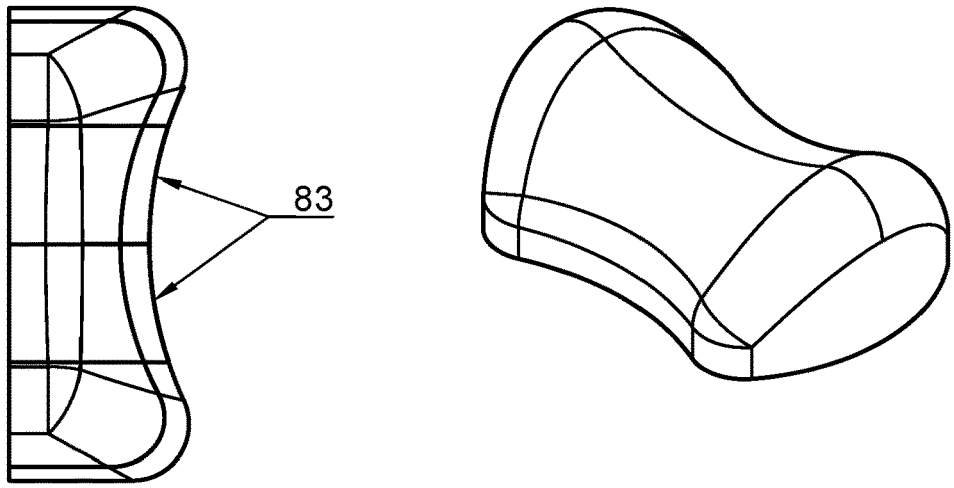
FIG. 20B is a side view of the attachment of FIG. 20A.
Figure 20C:
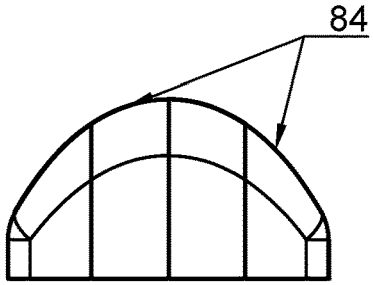
FIG. 20C is a top view of the attachment of FIG. 20A.
Figure 20D:
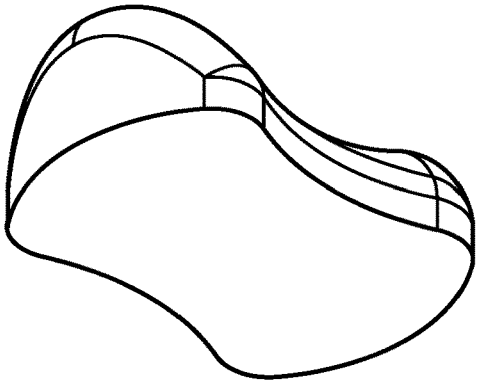
FIG. 20D is three perspective views of the attachment of FIG. 20A.

The attachment shown in FIGS. 18A-18D is designed primarily for use over the anterior axillary fold around the glenohumeral joint, both as a means for direct compression and as an anchor for positioning the opposing surface on the posterior of the body. The contact surface is formed by sweeping a shorter convex curve 81 along a longer concave one 82 and then rounding all edges. The convex curve is shaped to fit the transverse cross section of the apex of the axilla, while the concave one conforms to its sagittal cross section. The protrusion of the top and bottom ends helps anchor the attachment in position with one end hooking under the anterior axillary fold into the axilla and the other end going over the fold into the clavipectoral triangle. The molded fit is designed to let the attachment pivot either transversely or sagittally, allowing for the whole assembly to be rotated around two separate axes. With the slide bar going over the shoulder, this rotational ability enables the opposing contact surface to be placed on any area of the ipsilateral upper back or posterior shoulder. The longer throat depth and the curved recess of the jaw on the modified bar clamp makes this maneuver possible. FIG. 19 illustrates a person using the device positioned in this way with the foregoing attachment of FIG. 18A over his anterior axillary fold and the opposing one from the left of FIG. 10A on his upper back.

Other possible uses for this attachment include positioning it over the posterior axillary fold, the grooves between the deltoid and the biceps or triceps, the antecubital fossa, the forearm, the lower limb, and the topside of the foot.

The variation illustrated in FIGS. 20A-20D is similarly constructed by sweeping one curve along another but is designed principally for use over the inguinal crease with a longer concave curve 83 that follows its bend and a shorter convex curve 84 that acts as a wedge between the upper leg and torso. Beyond compression, the larger version may be used as an anchor that pivots around two axes to position the opposing contact surface on posterior areas of the body, such as the ipsilateral buttocks, upper leg and lower back. The attachment also fits in the groin and the groove between the buttocks and leg. Other possible uses include placement over the external oblique, the superior edge of the trapezius, the pectoralis major of a man, the popliteal fossa, the upper arms and leg, and the underside of the foot.

The attachment depicted in FIGS. 21A-21H is intended for use on the lower back. The contact surface is formed by sweeping a shorter curve 93, 94 along a longer elliptical one 90. The shorter curve 93, 94 molds to one side of the lower back, beginning in the midline with a slightly convex segment 93, which mirrors the modest depression over the spine, before moving laterally and giving way to a longer concave section 94, which complements the shape of the quadratus lumborum. The concavity gets steeper as it goes, just as the back transitions to the side of the body with its surface receding anteriorly. On the other hand, the longer elliptical contour 90 approximates the normal lumbar curve of the spine in a standing neutral position. Radiographic analysis has determined that an ellipse, which is illustrated in FIG. 22, is a good fit for the sagittal concavity of the lumbar region of the back. The average lengths of the minor 95 and major 96 axes of the ellipse are known along with their ratio. The elliptical segment 97 that describes the lumbar curve lies between one end 98 of the minor ellipse, which corresponds with the position of the inferior endplate of the T12 vertebra, and a point 99 slightly less than a full quadrant of the ellipse away, which correlates with the mid-posterior body margin of the S1 vertebra. Sweeping the shorter curve along the result and then rounding all the edges (e.g. the lateral ones 88, 89) gives rise to the depicted contact surface. Said rounding 91, 92 is what disrupts the ends of the otherwise intact partial elliptical curve 90 in the figures. The entire construct is then completely rounded on the side that is placed laterally on the body to avoid impedance from the twelfth rib that lies superior to the top round 86 and the iliac crest that is inferior to the bottom one 87. Dissimilarly, the other side 85 is mostly straight to fully impact the paraspinal muscles. The illustrated attachment is for the left side of the body. The embodiment for the right side would be its mirror image. They can both be scaled in size to accommodate differing body frames.

Figure 21A:
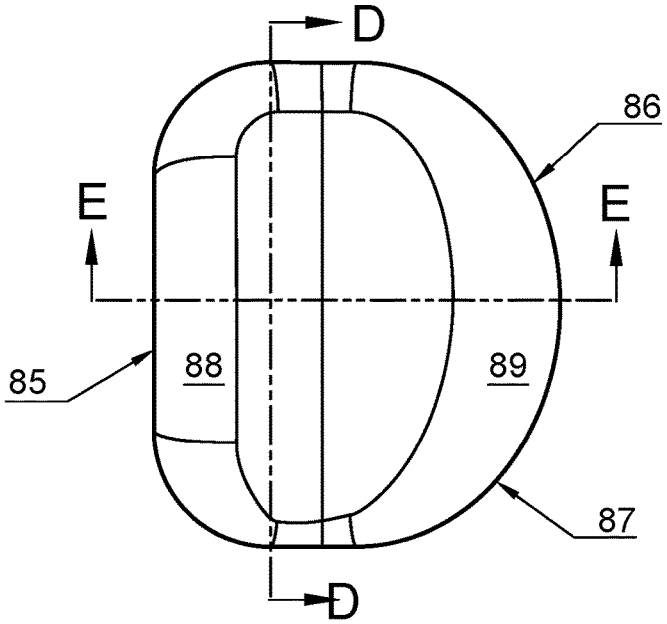
FIG. 21A is a front view of an attachment intended primarily for use on the lower back.
Figure 21B:
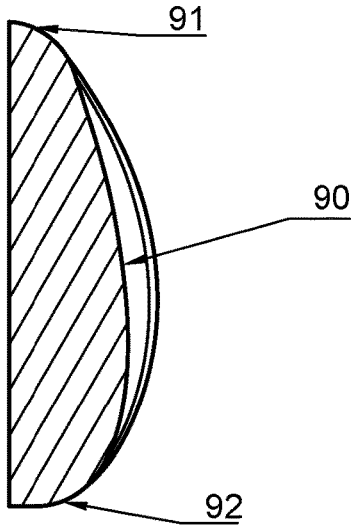
FIG. 21B is a cross-sectional view of the attachment of FIG. 21A taken along the line D-D of FIG. 21A.
Figure 21C:
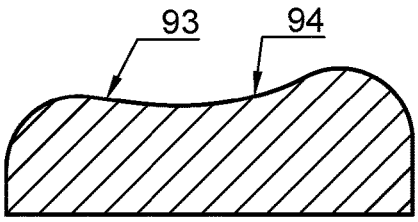
FIG. 21C is a cross-sectional view of the attachment of FIG. 21A taken along the line E-E of FIG. 21A.
Figure 21D:
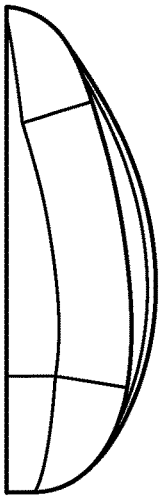
FIG. 21D is a left-side view of the attachment of FIG. 21A.
Figure 21E:
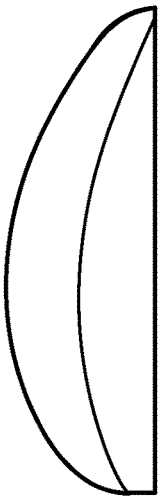
FIG. 21E is a right-side view of the attachment of FIG. 21A.
Figure 21F:
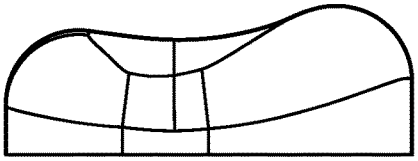
FIG. 21F is a bottom view of the attachment of FIG. 21A.
Figure 21G:
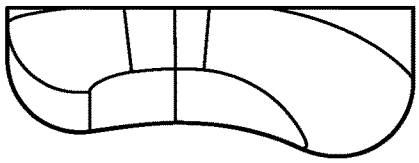
FIG. 21G is a top view of the attachment of FIG. 21A.
Figure 21H:
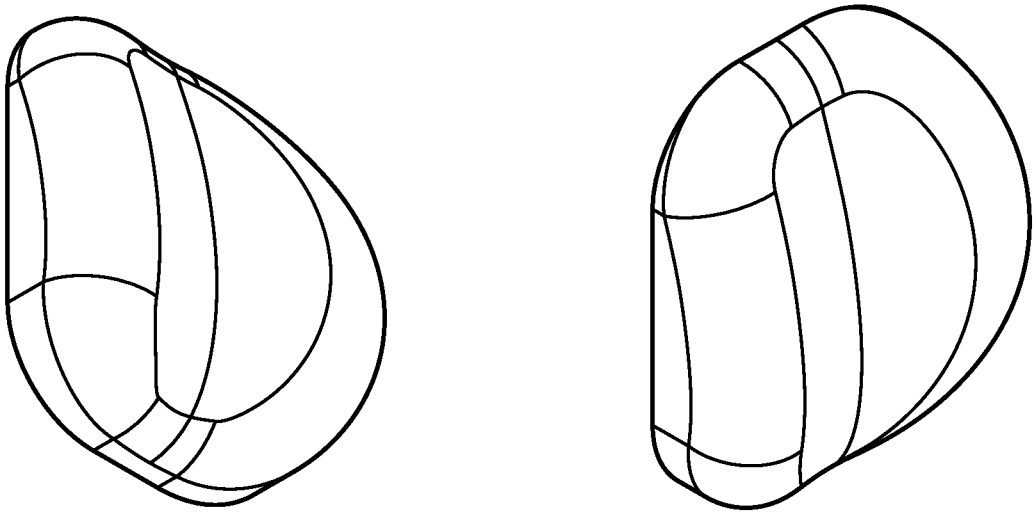
FIG. 21H is two perspective views of the attachment of FIG. 21A.
Figure 22:
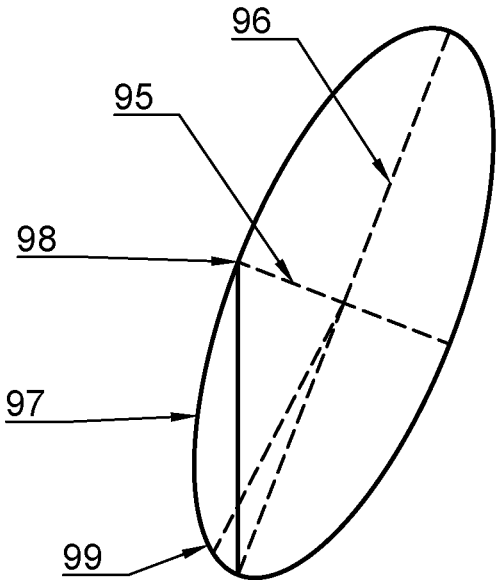
FIG. 22 is a radiographic-based construct for a convex curve used in creating the attachment of FIG. 21A.

The opposing contact surface designed to be used in conjunction with the attachment of FIG. 21A is shown in FIGS. 23A-23D and is primarily meant for placement on one side of the abdomen. Complementary to the abdominal wall, this surface is formed by taking an S-like curve, consisting of a convex segment 100 flowing smoothly through a point of inflection into a concave one 101, and sweeping it along a circular arc 102. The concavity correlates with the slight bulge of the rectus abdominus, while the convexity mirrors the external oblique. The other curve is an arc to allow the structure to be able to pivot in the sagittal plane without any undue discomfort, so that pressure can be exerted by its opposing attachment on the lower back at an angle in either the inferior or superior direction. Rather than advancing the moveable jaw with this attachment into the gut as far as tolerable, the more prudent practice is to move it only part way before inhaling and distending the abdomen to increase the pressure to the desired degree.

Figure 23A:
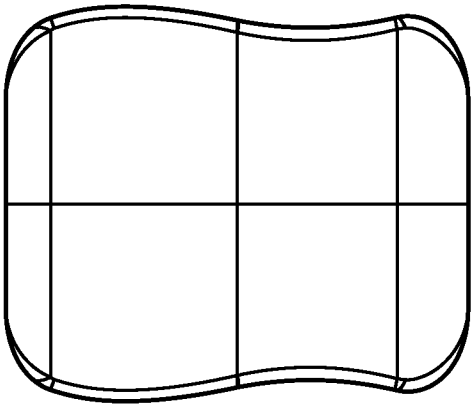
FIG. 23A is a front view of an attachment intended primarily for use on the abdomen.
Figure 23B:
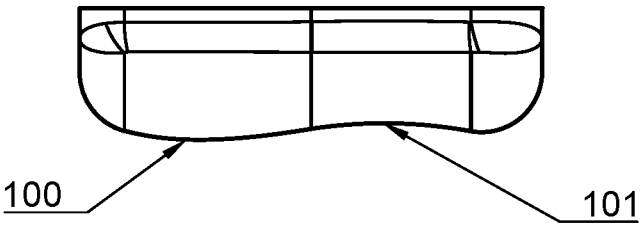
FIG. 23B is a top view of the attachment of FIG. 23A.
Figure 23C:
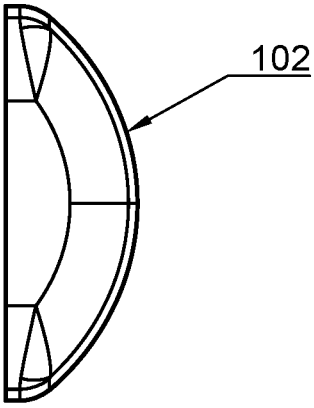
FIG. 23C is a side view of the attachment of FIG. 23A.
Figure 23D:
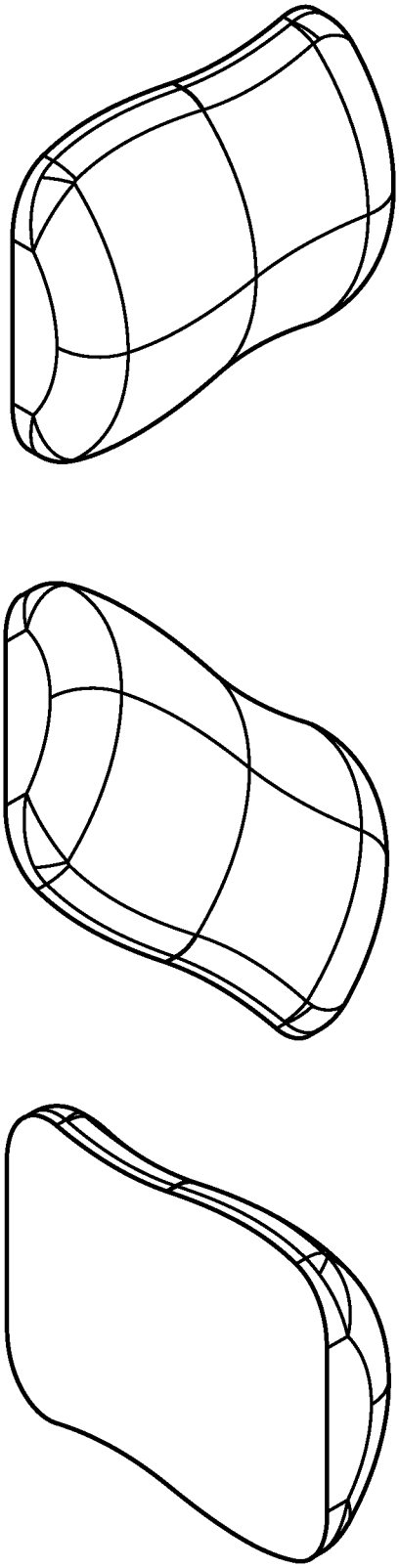
FIG. 23D is three perspective views of the attachment of FIG. 23A.

When paired together, the attachments of FIGS. 21A and 23A will compel individuals with lordosis or a sway back into a more neutral spinal curvature as the tandem pressure from the front and back impedes poor posture. This posture correction works in tandem with the pressure exerted on the soft tissue of the lower back to help mobilize it in such a way as to encourage proper spinal alignment.

The attachment featured in FIGS. 24A-24D is devised to mobilize specific spinal segments. The triangular wedge comes to a rounded edge 105 that is narrow enough to exert pressure on the soft tissue that falls within the span of the transverse processes of adjacent vertebrae. The triangular shape widens the surface contact area at more shallow depths to expand its target to the paraspinal muscles as they extend over the transverse processes. The wedge shape also enables the attachment to pivot sagittally and administer pressure at a slant, which is advantageous because vertebrae are situated at varying angles. Likewise, one can use the wedge as a fulcrum and bend a bit forward or backward over it while it applies pressure. For the sake of contrast, if the rounded edge were wide enough to span adjacent vertebrae, it would inhibit bending at that given juncture. The notch 104 in the wedge is meant to be lined up with the midline of the back that overlies the more prominent spinous processes to avoid bruising them. The slight convexities 103 of the rounded edge of the wedge are contoured to the modest depression of the back overlying the spine. The overall effect is to aid in relaxing the paraspinal muscles to restore natural spinal motion.

With the wedge repositioned on the body in order to lay its rounded edge longitudinally alongside the spine instead, it can apply paramedian pressure directed anteriorly or anteromedially toward the vertebral bodies, more effectively targeting the muscles aside and attaching to the spinous processes, such as the rotatores and multifidus. These deep back muscles help rotate the spine, and addressing their mobility issues improves problems with twisting from side to side.

When used on the thoracic spine, rather than placing an opposing surface on the chest, one can simply leave the jaws wide open and manually press the jaw in front of the body forward, driving the triangular wedge into the back. By pressing the jaw forward at an upward or downward angle, one can control the angle of compression on the paraspinal muscles.

Other potential uses for the narrow wedge include getting deep into otherwise hard-to-reach body recesses such as the deltopectoral groove and the inguinal crease, as well as under the scapular border or the pelvic brim, where often unrecognized trigger points may lie. The attachment is better suited for these purposes if the notch 104 is removed and the singular resulting top edge is replaced with a uniform curve that is slightly convex or concave.

Figure 24A:
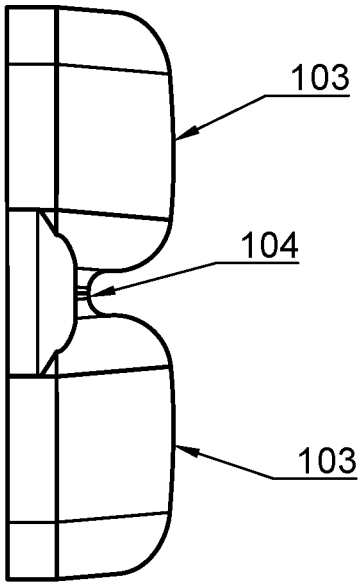
FIG. 24A is a side view of an attachment intended primarily for use on individual spinal segments.
Figure 24B:
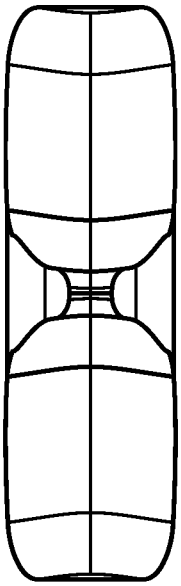
FIG. 24B is a front view of the attachment of FIG. 24A.
Figure 24C:
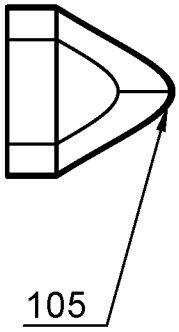
FIG. 24C is a top view of the attachment of FIG. 24A.
Figure 24D:
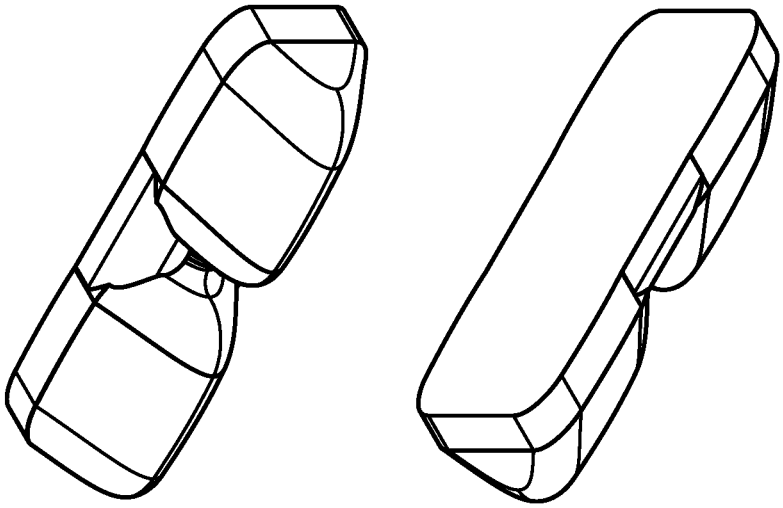
FIG. 24D is three perspective views of the attachment of FIG. 24A.
Figure 24D:
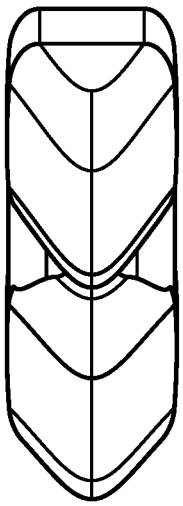
Figure 25A:
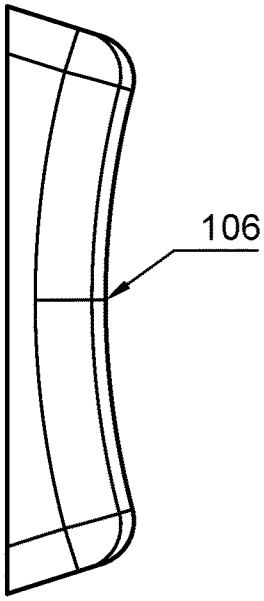
FIG. 25A is a side view of an attachment intended primarily for use on the thoracic spine.
Figure 25B:
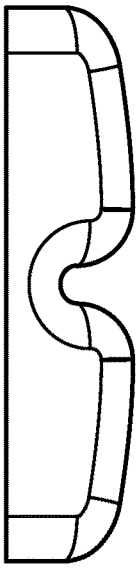
FIG. 25B is a top view of the attachment of FIG. 25A.
Figure 25C:
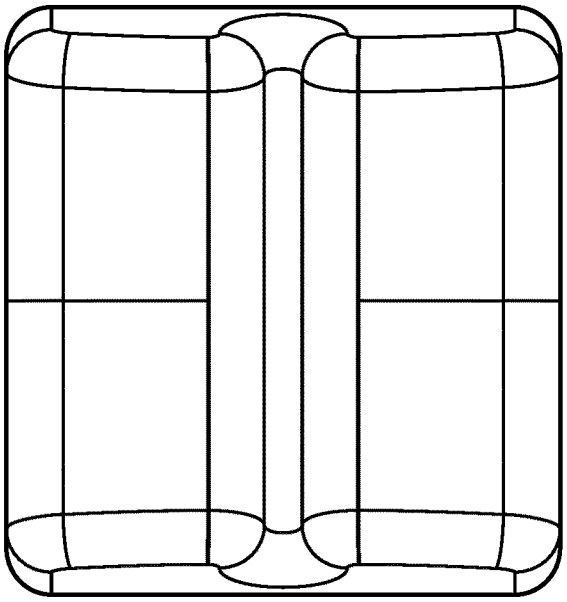
FIG. 25C is a front view of the attachment of FIG. 25A.
Figure 25D:
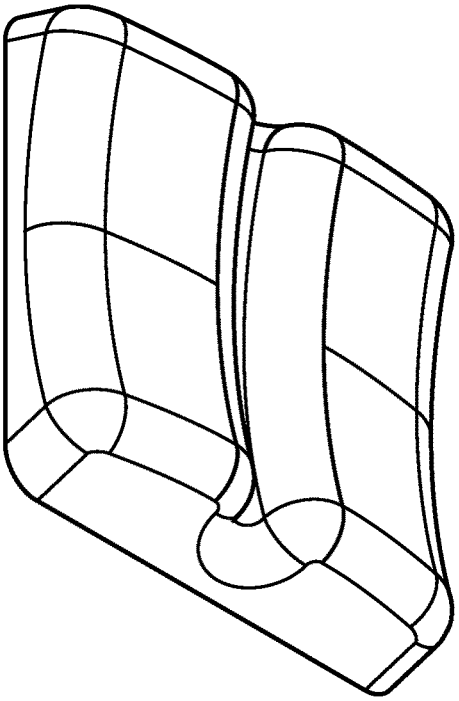
FIG. 25D is two perspective views of the attachment of FIG. 25A.
Figure 25D:
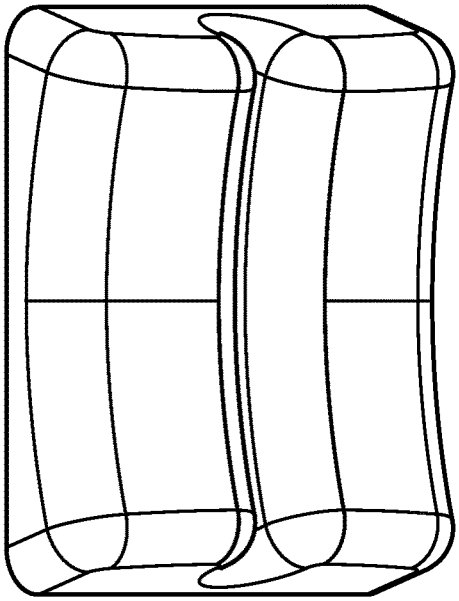
Figure 26A:
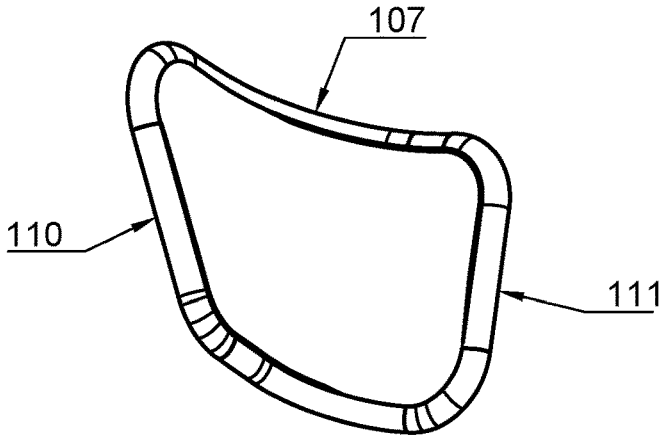
FIG. 26A is a front view of an attachment intended primarily for use on the posterior axillary fold.
Figure 26B:
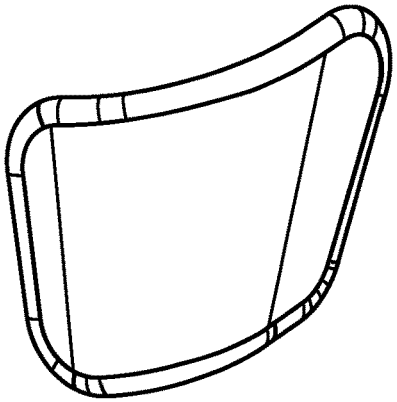
FIG. 26B is a back view of the attachment of FIG. 26A.
Figure 26C:
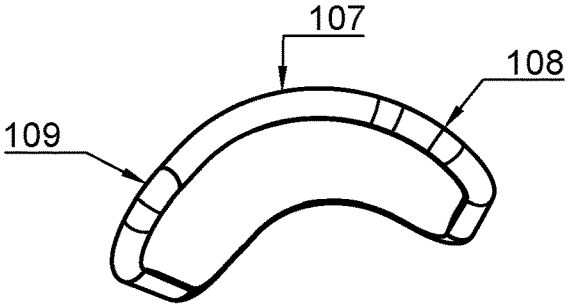
FIG. 26C is a top view of the attachment of FIG. 26A.
Figure 26D:
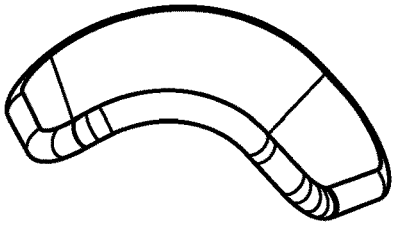
FIG. 26D is a bottom view of the attachment of FIG. 26A.
Figure 26E:
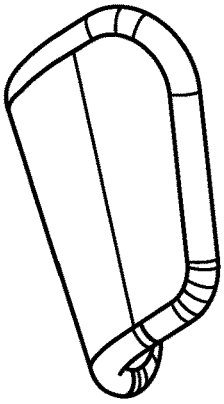
FIG. 26E is a left-side view of the attachment of FIG. 26A.
Figure 26F:
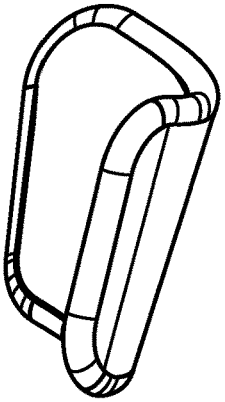
FIG. 26F is a right-side view of the attachment of FIG. 26A.
Figure 26G:
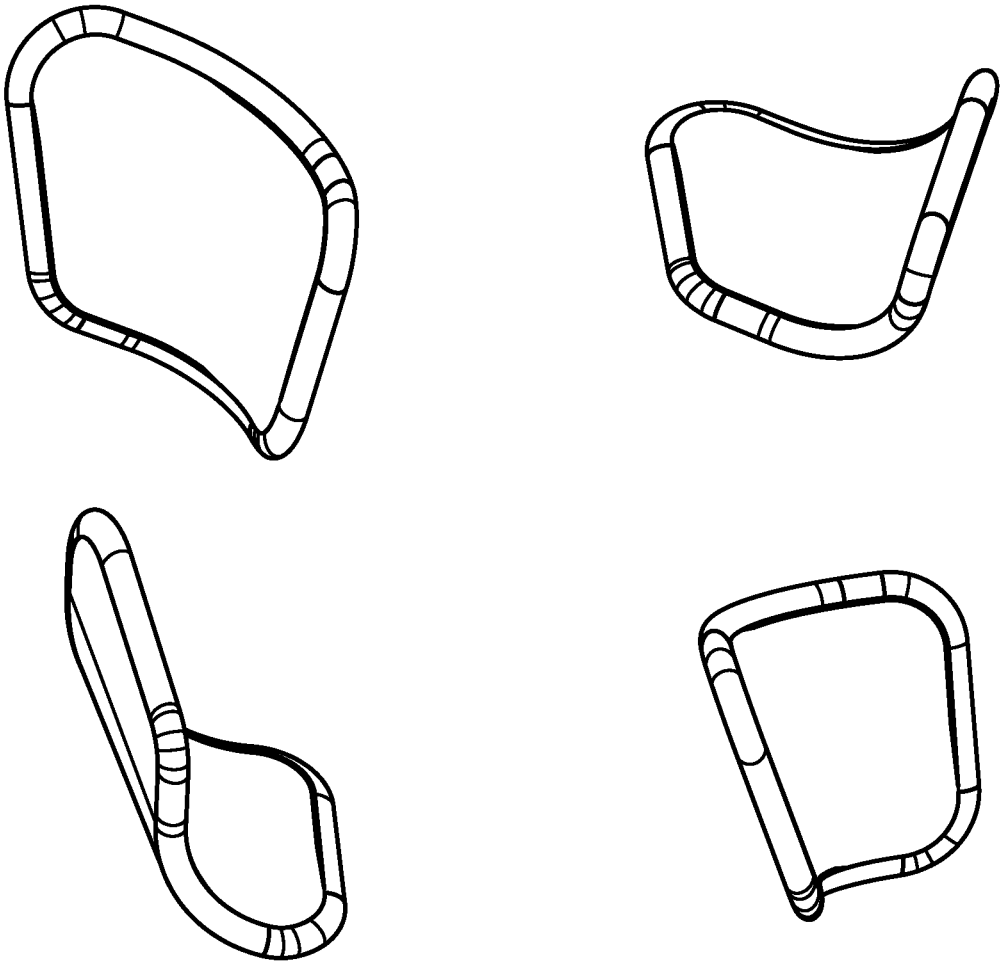
FIG. 26G is four perspective views of the attachment of FIG. 26A.

FIGS. 25A-25D feature an attachment that takes the profile outline of the narrow wedge from FIG. 24A, including both the slight convexities 103 and the notch 104 that sits between them, and sweeps it along a concave curve that fits the average normal convexity 106 of the thoracic spine. The resulting surface compels individuals with kyphosis into a more neutral spinal curvature and mobilizes the paraspinal soft tissue to encourage proper spinal alignment. An alternate embodiment, focusing on just one side of the spine, splits the contact surface and uses only the slight convexity on one side of the notch to concentrate the pressure per square inch.

The attachment depicted in FIGS. 26A-26G is intended for use on the posterior axillary fold. The soft tissue contact surface is formed by first taking an arc 107 and extending it linearly a short way 108 in one direction and a longer way 109 in the other. Using the CAD (Computer-Aided Design) drafting technique of lofting, this construct is then transitioned to a similar one that is simply scaled down in size and shifted below it and toward the side with the short linear segment 108. Doing so creates a tapered edge 110 on the contralateral side. The edges are then rounded and the whole construct is rotated a bit to arrive in the position shown in the figures. In this orientation, the attachment would then connect its backside perpendicularly to the assembly. This configuration allows for the surface to be placed on the posterior axillary fold with the slide bar extending across the body and the opposing mirror image attachment on the contralateral side. When the moveable jaw of the assembly is advanced, both sides of the body are squeezed together, just like they are in a bear hug.

When positioned this way, the non-tapered side 111 lines up with the lateral border of the posterior axillary fold, while the top edge 107 curls around it, right beneath the upper arm, with the contact surface engulfing the superior aspect of the latissimus dorsi muscle along with the *teres* major. The diagonally placed surface follows the arc of the posterior ribs as they ascend in the inferior lateral to superior medial direction. The tapering of the other side 110 makes its edge run vertically in this orientation and stops the surface from running afoul of the lateral border and inferior angle of the scapula, precluding it from interfering with the compression of the targeted muscles. When pressure is exerted, the posterior axillary fold is crushed, along with the underlying serratus anterior, against the rib cage. The benefit of doing so is primarily to improve the mobility of the upper arm, including active extension, adduction and medial rotation when the targeted muscles are exerted, as well as passive flexion, abduction and lateral rotation when they are relaxed and stretched through their range of motion.

The attachment pair on view in FIGS. 27A-27I is intended to help improve the spiraling motion of the arm muscles around the humerus that occurs during arm movements. The quality of this motion directly effects the ability to generate torque in pressing and pulling. The soft tissue contact surface is modeled by taking a convex curve 112, which is both symmetrical and somewhat flatter at either end, and sweeping it along a partial turn of a coil 113 with the convex curve 112 sustaining a fixed configuration while twisting to maintain the perpendicular orientation of the midpoint of its convexity to the center of the coil as it progresses along its path. If the path were continued farther to complete multiple turns, the result would be a helix. The produced contact surface conforms to the spiraling of many of the muscular divisions in the upper and lower arm. Some examples include between the deltoid and the biceps or triceps; the biceps and the brachialis; and the brachioradialis and the extensor muscles of the wrist.

One attachment is connected to the assembly perpendicular to the convexity at its midpoint and one third of the way down 114 to a full-height jaw, while the opposing attachment is similarly oriented but connected two thirds of the way down 115 to a jaw that is shorter by one third of the attachment's height (i.e. the same distance as the vertical displacement between the center points of 114 and 115). While there is latitude in these fractions, these numbers express the preferred embodiment. The resulting spatial relationship between the pair of attachments, as illustrated by their alignment in FIGS. 27A, 27B, 27G, 27H and 27I, is analogous to the two strands of a double helix. When the arm is threaded through the center of the helix and pressure is exerted, the contact surfaces push the soft tissue in a clockwise direction around the bone from the top view (FIG. 27G). If the attachments were connected to the jaws at their midpoints instead of farther along in opposite directions toward their respective ends, they would generate little or no torque and the tissue would not spiral much, if at all. The whole twisting effect can be enhanced by rotating the entire assembly, part way around the arm. The mirror image of this pair of attachments will help spiral the soft tissue in the opposite direction, and between the two sets of pairs either direction can be achieved in both left and right arms.

Mobilizing the soft tissue in this manner decreases its stiffness and tension as it spirals, thereby both lessening the resistance that it may have to the torque required to stabilize joints under load and also improving the quality and strength of movement. This manner of mobilizing also exerts a torsional pull on the fascia and muscles, creating a shearing force that helps to break up any adhesions between them and to restore their ability to slide over one another.

The attachment shown in FIGS. 28A-28G is closely analogous in construction to the ones in FIGS. 27A-27I but is intended primarily to work on the oblique muscles and is modified accordingly. The one in FIG. 28A utilizes a curve 116 that is much more uniform in its convexity along its length. The construct then sweeps this curve for a shorter distance along a coil 117 with both a larger radius and a shorter height. The attachment is also dissimilarly connected to the assembly at a point 118 midway down as applying direct pressure, rather than generating torque, is the objective here. The changes allow it to mold around the more even concavity of the side of the body in the space above the iliac crest and below the rib cage. The surface may be positioned to run in the inferior medial to superior lateral direction, rising alongside the path of the iliac crest and in parallel with the diagonal orientation of the underlying external oblique muscle fibers, or in the superior medial to inferior lateral direction, descending alongside the costal cartilage and in tandem with the angle of the internal oblique. The pressure from the surface effects both muscles, as they overlap each other in either position. Mobilizing these muscles helps improve the quality of bending and twisting movements for which they are responsible. The mirror image of this attachment can be used for the contralateral side of the body.

Figure 27A:
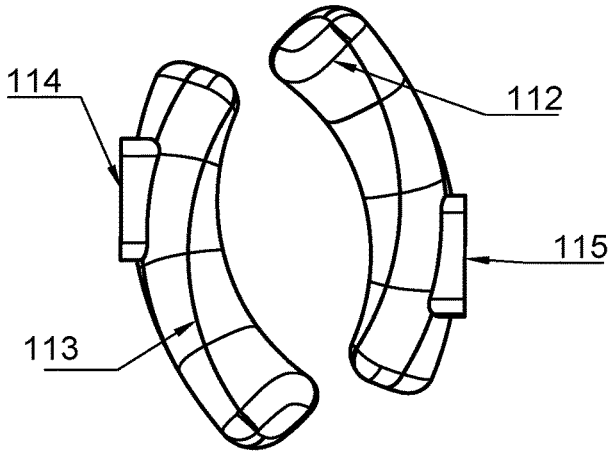
FIG. 27A is a left-side view of an aligned pair of attachments intended primarily to improve the spiraling motion of the arm muscles.
Figure 27B:
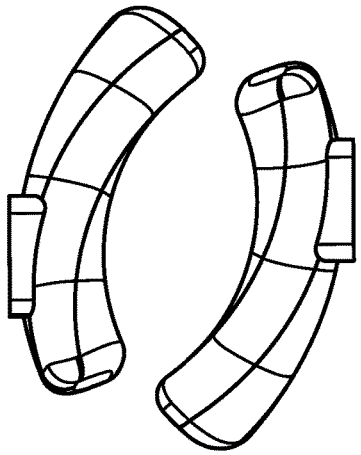
FIG. 27B is a right-side view of the aligned attachments of FIG. 27A.
Figure 27C:
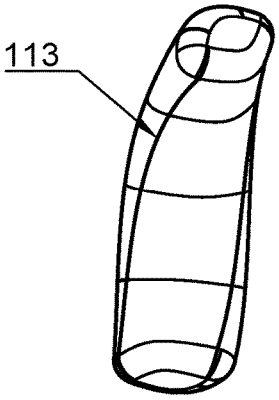
FIG. 27C is a front view of the right attachment of FIG. 27A.
Figure 27D:
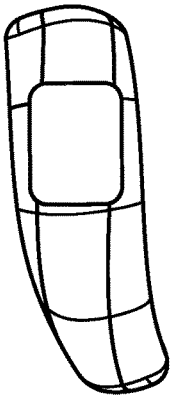
FIG. 27D is a back view of the left attachment of FIG. 27A.
Figure 27E:
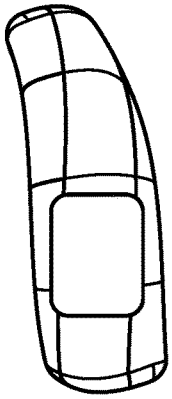
FIG. 27E is a back view of the right attachment of FIG. 27A.
Figure 27F:
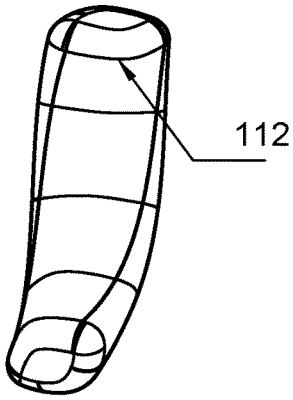
FIG. 27F is a front view of the left attachment of FIG. 27A.
Figure 27G:
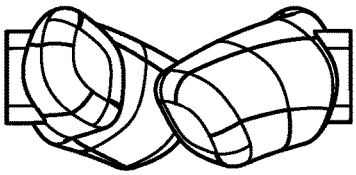
FIG. 27G is a top view of the aligned attachments of FIG. 27A.
Figure 27H:
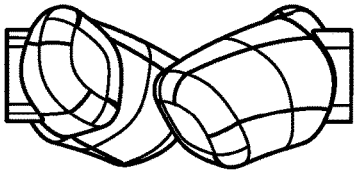
FIG. 27H is a bottom view of the aligned attachments of FIG. 27A.
Figure 27I:
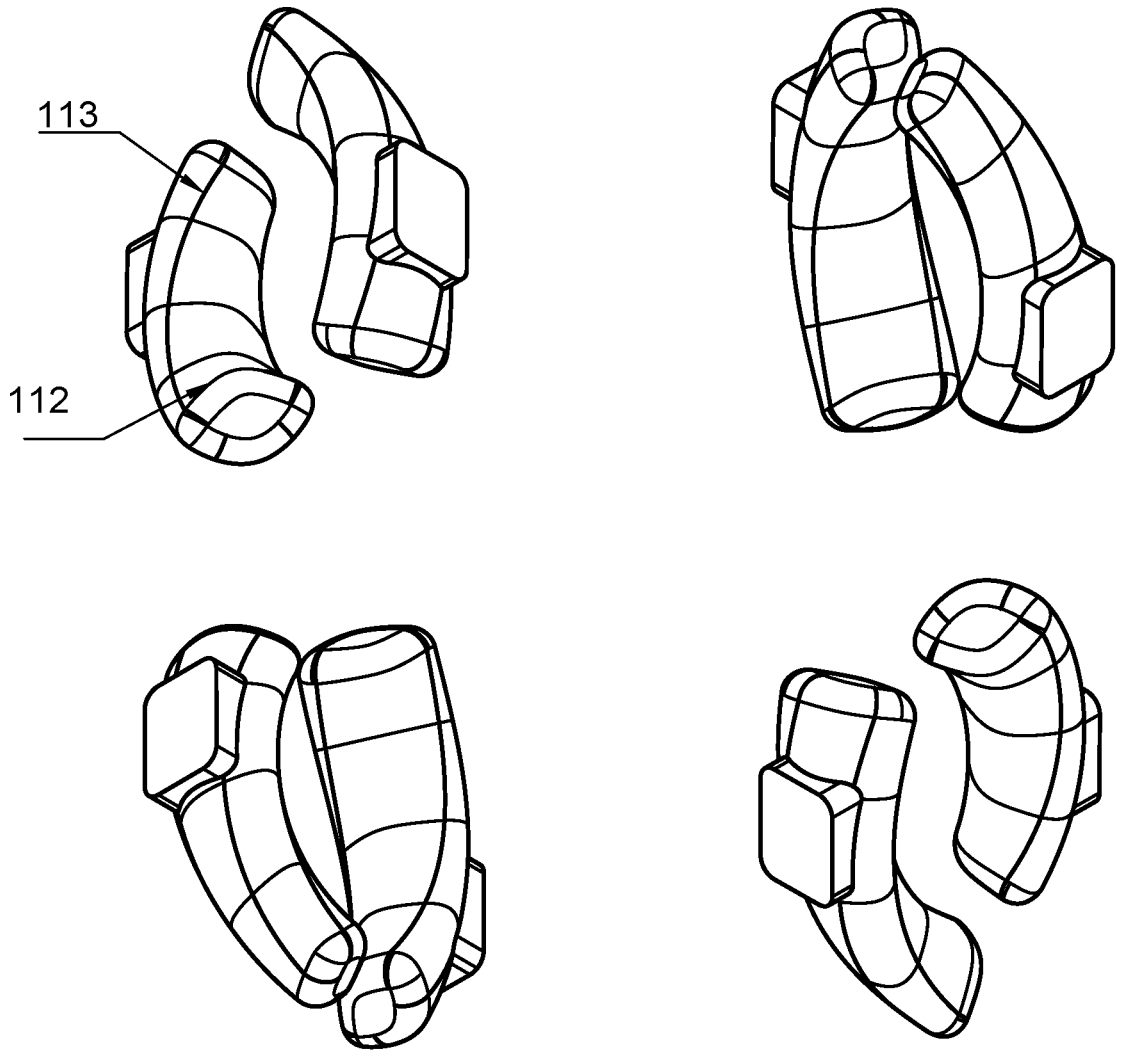
FIG. 27I is four perspective views of the aligned attachments of FIG. 27A.
Figure 28A:
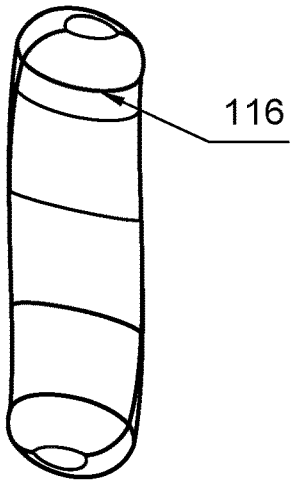
FIG. 28A is a front view of an attachment intended primarily for the oblique muscles.
Figure 28B:
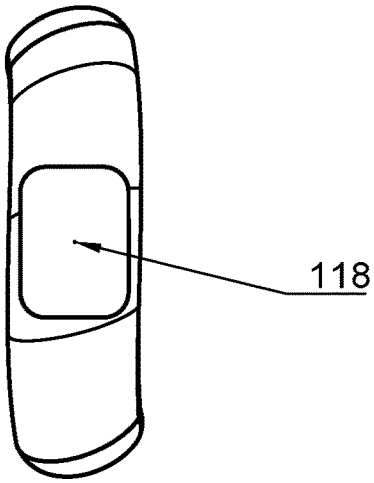
FIG. 28B is a back view of the attachment of FIG. 28A.
Figure 28C:
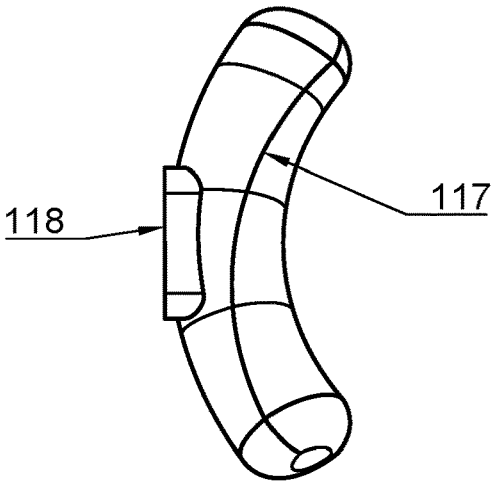
FIG. 28C is a left-side view of the attachment of FIG. 28A.
Figure 28D:
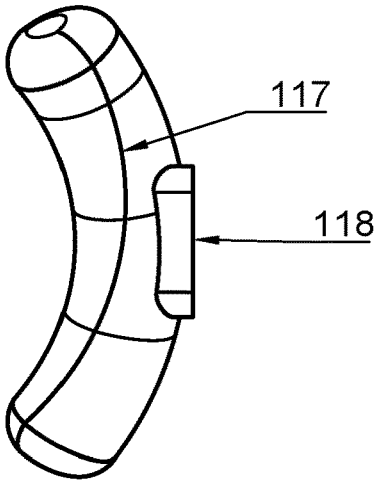
FIG. 28D is a right-side view of the attachment of FIG. 28A.
Figure 28E:
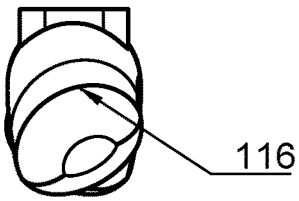
FIG. 28E is a top view of the attachment of FIG. 28A.
Figure 28F:
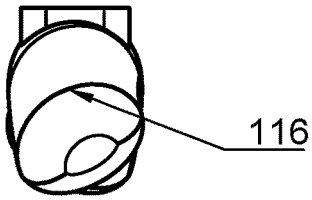
FIG. 28F is a bottom view of the attachment of FIG. 28A.
Figure 28G:
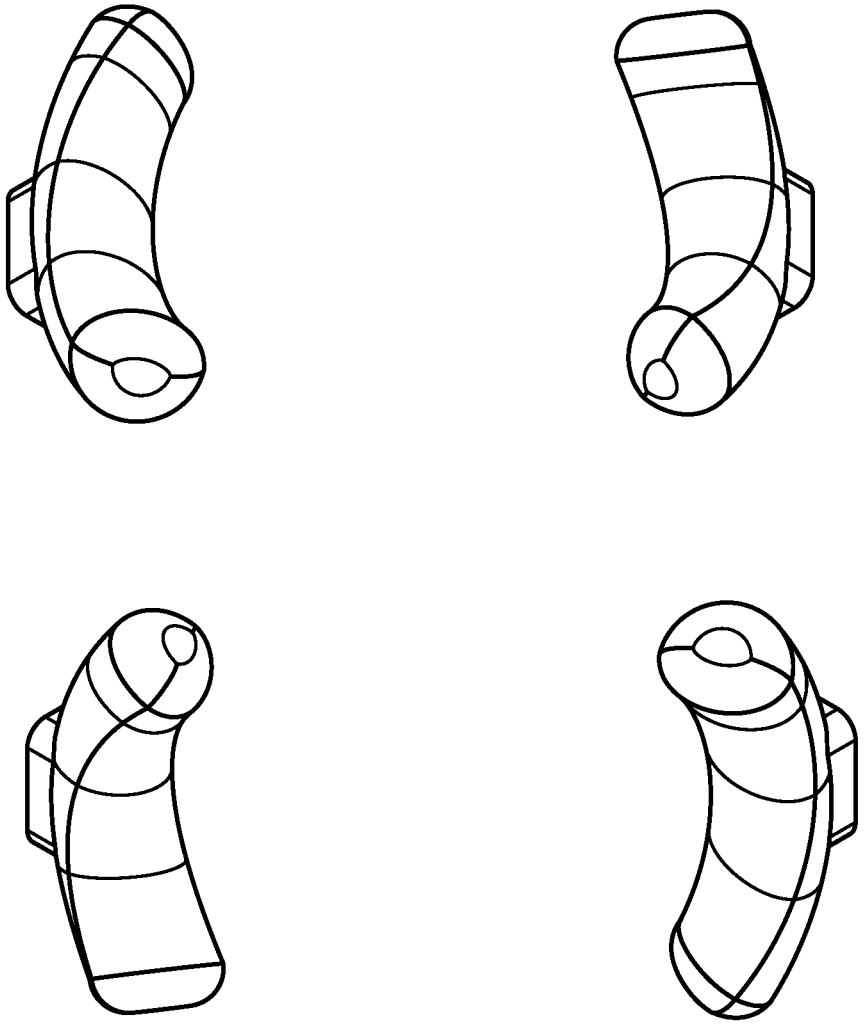
FIG. 28G is four perspective views of the attachment of FIG. 28A.

The contact surface construct that was previously employed in both FIGS. 27A and 28A is used once again in the iteration illustrated in FIGS. 29A-29D, the chief purpose of which is for use as an anchor on the upper chest for positioning the opposing surface on the upper back. Using a convex curve 119 with an almost flat midsection this time, this version sweeps it for an even shorter distance around a coil 120 that is similar in radius and height to that in FIG. 28A. The real principle difference though is that the midpoint of the convex curve 119 does not maintain its perpendicular orientation to the center of the coil as it moves along its path but rather twists around it at a faster rate than before. Doing so enables a greater angle of pivot for the new surface when it is placed on the upper chest. When the twisting surface pivots and one end of it lifts away from the soft tissue, the other end compensates by setting further down on it, leaving the same percentage of the surface in contact with the skin. By contrast, the use of a simple cylindrical shape requires a far greater curvature to achieve an equal amount of rotation at the same physical size. The increased curvature in turn causes more discomfort when firmly pressed into the soft tissue, making it a poorer choice as an anchor, which should impart as little discomfort as possible while the opposing surface presses into the actual intended target. The depicted attachment is also a better choice because of the curved nature of its coiled path that allows for a greater amount of contact than would a straight cylinder in the same bounded space. Since any given amount of pressure is divided over a greater area of contact, the coil-derived version helps dissipate the pressure and make it more comfortable as an anchor. On the other hand, the use of a bowed cylinder would also be a subpar choice as both of its ends would lift away from the soft tissue as it pivots.

Since the shape of the chest approximates a spherical cap and the partial coil of the shown attachment has a similar radius to it, they fit together well at a range of angles. With the jaw of the assembly connected to the attachment at its midpoint 121, perpendicular to the axis of its longest length, it can be maneuvered by varying that angle and its degree of pivot to position the opposing attachment almost anywhere on the ipsilateral side of the upper back. The chosen opposing attachment is not limited by the anchor and will depend upon the objective at hand.

FIGS. 30A-30F, 31A and 31B feature an attachment with two separate possibilities to pair with it to help break up myofascial adhesions and restore normal sliding surfaces. The first pairing is illustrated in FIGS. 30A-30F and does so by creating torsional pressure around the upper leg. The transverse cross-sectional shape of the upper leg can be approximated by the cross-sectional outline of an ovoid 122 with the proportionality as shown, while the femur is roughly comparable to a circle 123 that is situated closer to its smaller end, which corresponds with the anterolateral aspect of the leg. The curvature 126 of the smaller attachment matches the contour 124 of the narrower end of the ovoid cross section, while the curvature 127 of the larger attachment fits the convexity 125 of the wider end. To form the contact surfaces, the larger curvature 127 is next extended linearly 128 a short distance in one direction. Using the CAD drafting technique of extrusion, these two constructs 126, 127, 128 are then transformed into the concave, ramp-like surfaces of their respective attachments. The rounded ends 129, 130 of the surfaces fall just short of the ends 131, 132 of the dashed lines that are tangential to the circle 123 and perpendicular to the ovoid cross section's axis of symmetry. The midpoints of the flat backs 133, 134 of the attachments are connected to the jaws of the assembly in a perpendicular manner, while the jaws themselves are of unequal heights with their difference being defined by the spatial relationships shown. The whole purpose of this set up is to position the bone as the axis of rotation when pressure is exerted. With the bone positioned inside of the dashed lines and out of the direct way of the applied pressure, the contact surfaces will exert torsional forces on the soft tissue, causing it to twist around the bone. The effect can be augmented by rotating the entire assembly, part way around the leg. With the attachments moved to mirror positions across the ovoid cross section's axis of symmetry, the rotational forces that are generated will change direction from counterclockwise to clockwise. Since the more superficial layers of muscle will have a longer moment arm and twist farther than those lying deeper, the torsion will help break up myofascial adhesions between them, leading to improved movement.

Figure 30A:
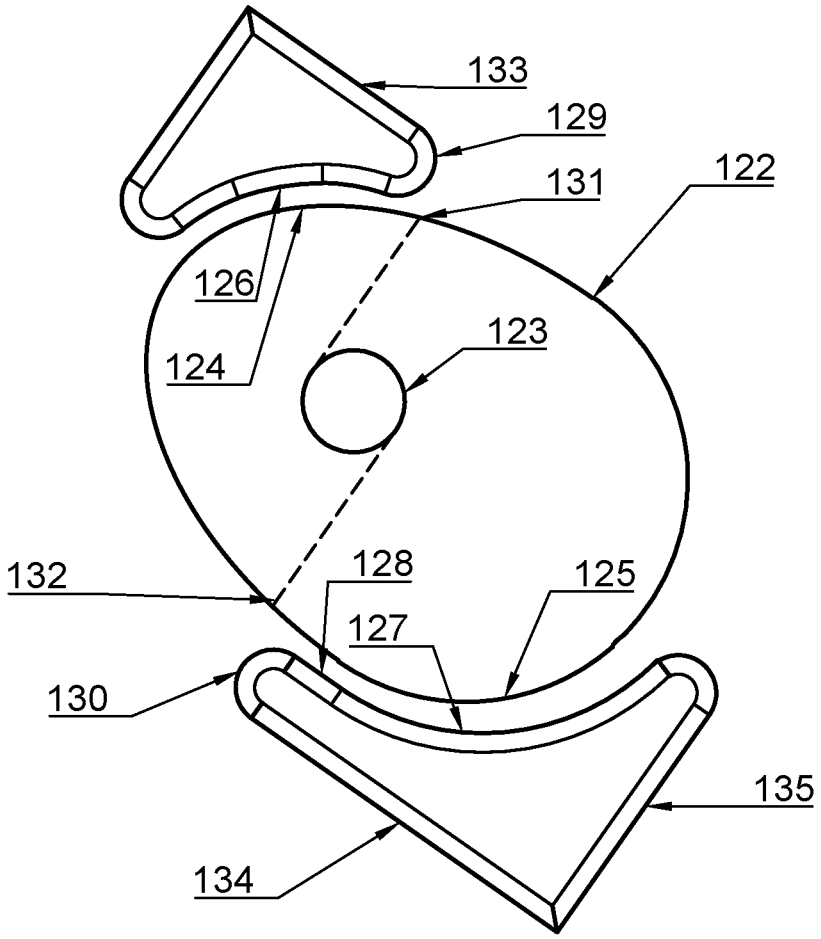
FIG. 30A is a side view of a pair of aligned attachments intended primarily for use on the upper leg, the outline of which is shown here in transverse cross section, along with the femur, between the two attachments.
Figure 30B:
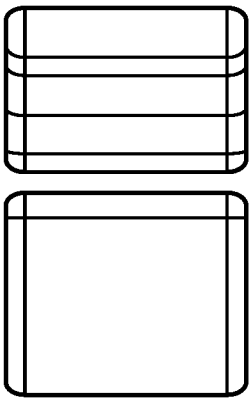
FIG. 30B is a front view of the aligned attachments of FIG. 30A.
Figure 30C:
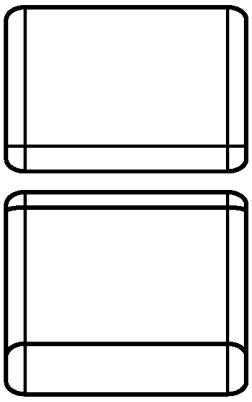
FIG. 30C is a back view of the aligned attachments of FIG. 30A.
Figure 30D:
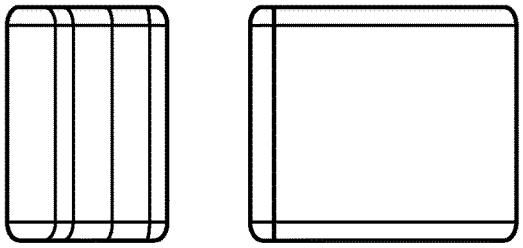
FIG. 30D is a top view of the aligned attachments of FIG. 30A.
Figure 30E:
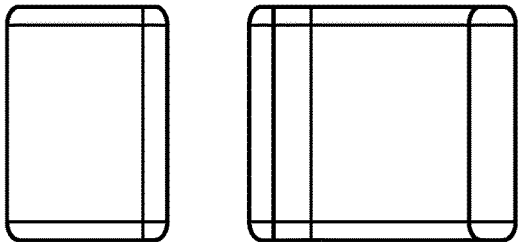
FIG. 30E is a bottom view of the aligned attachments of FIG. 30A.
Figure 30F:
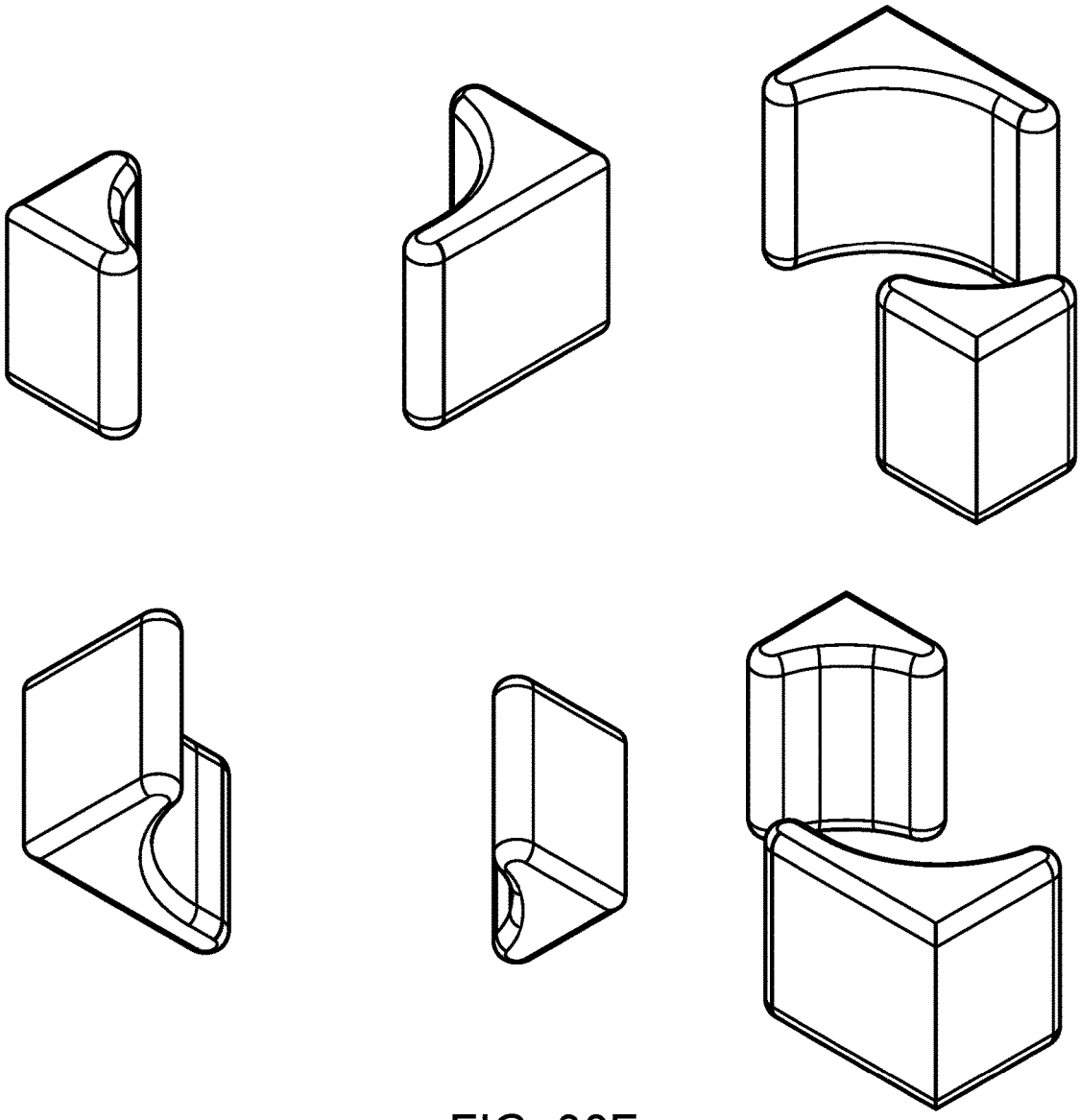
FIG. 30F is four perspective views of the aligned attachments of FIG. 30A.
Figure 31A:
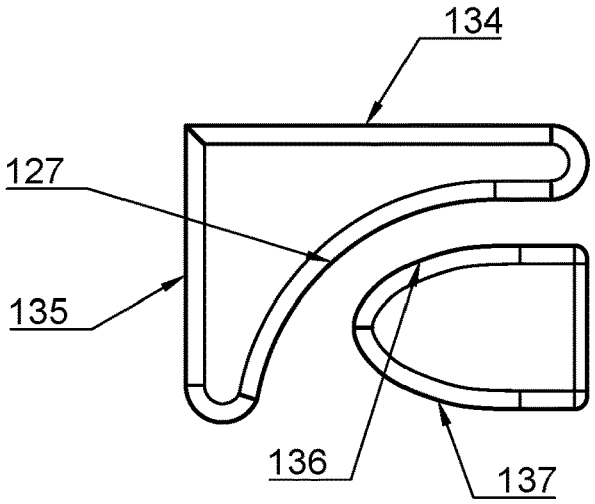
FIG. 31A is a side view of a pair of attachments intended primarily for use on the upper leg.
Figure 31B:
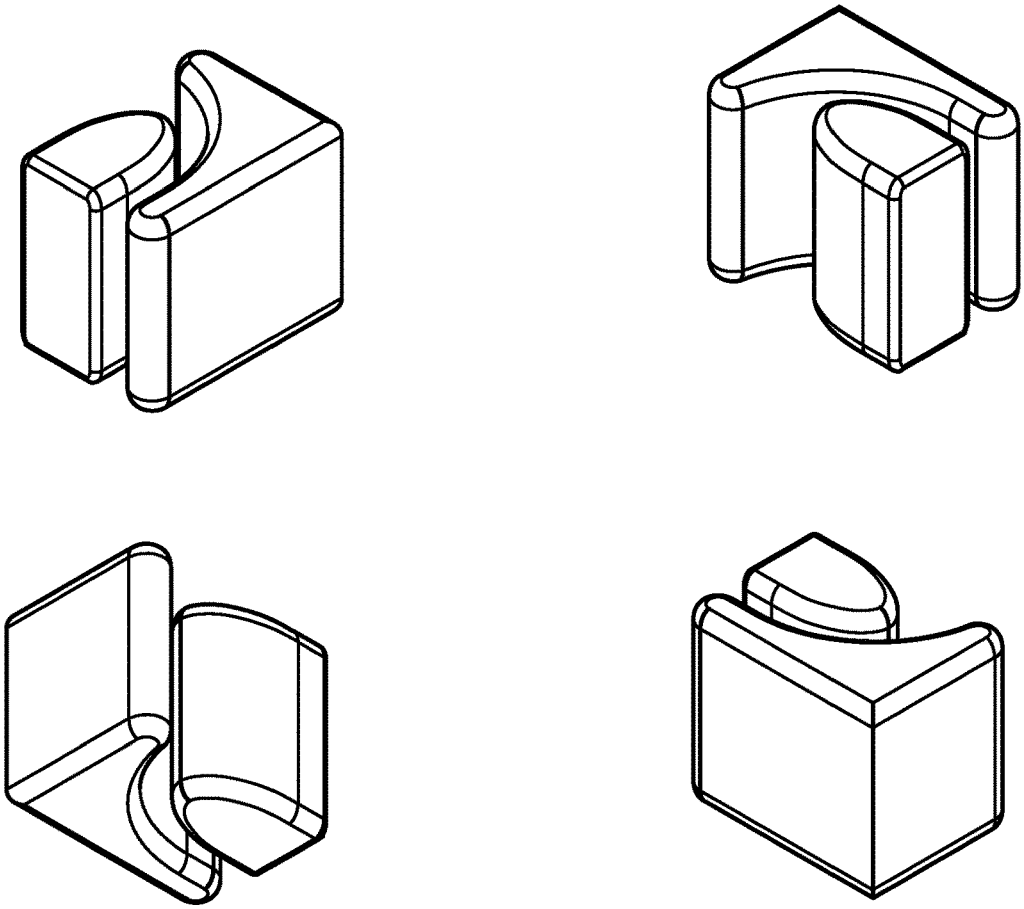
Figure 32A:
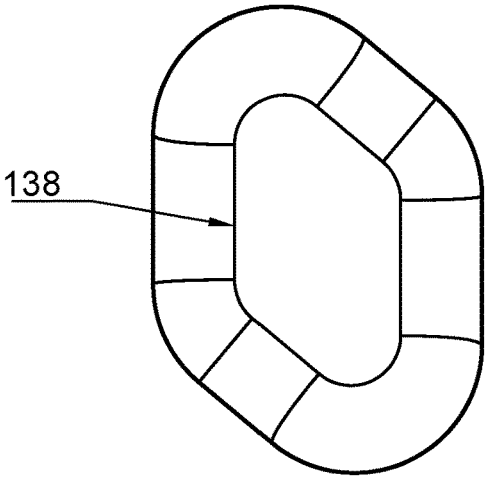
Figure 32B:
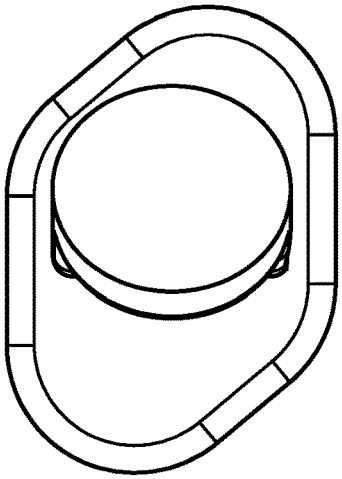
Figure 32C:
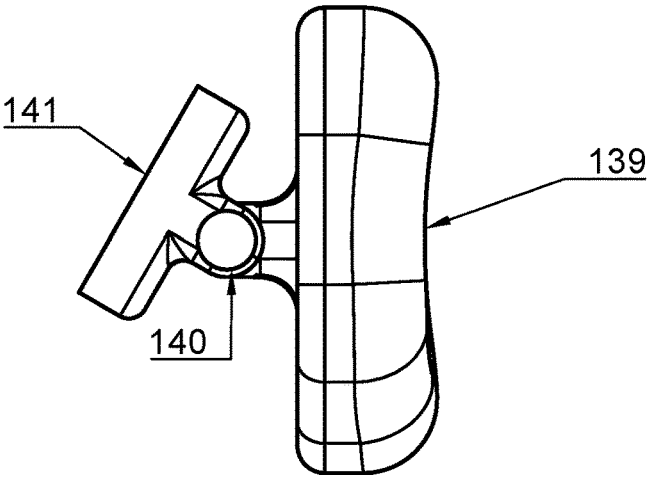
Figure 32D:
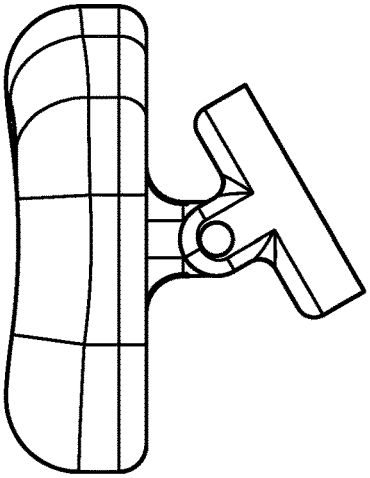
Figure 32E:
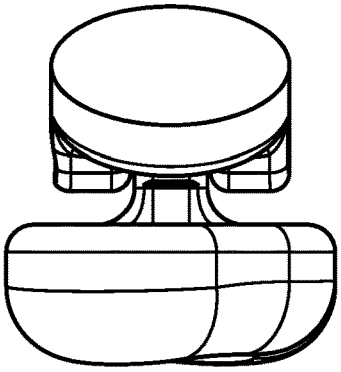
Figure 32F:
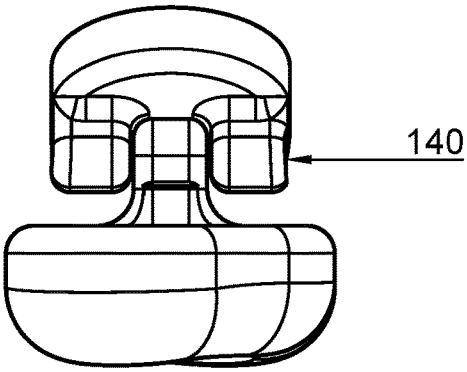
Figure 32G:
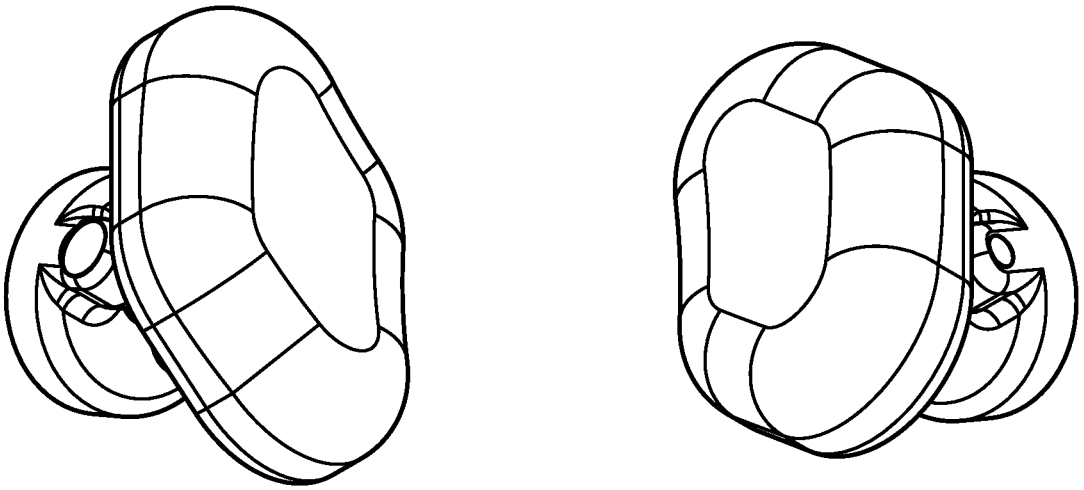

The attachment pair illustrated in FIGS. 31A and 31B combines the larger attachment on the bottom of FIG. 30A with a wedge-like attachment to generate both shearing and compressive forces. The wedge-like attachment is constructed in a similar fashion but instead starts with a parabolic curve with a top edge 136 that complements the concavity 127 of its opposing paired surface. When the concavity of the larger attachment is aligned with the round contour of the leg and the wedge is driven into the underlying soft tissue, the pressure forces the soft tissue above its top edge 136 into the space between them, heading back toward the oncoming force vector, while the tissue below its bottom edge 137 is compressed by the force vector in the opposite direction, creating a shearing force that helps separate superficial muscles from deeper ones. It is also possible to drive the wedge perpendicularly toward the long side 134 of its opposing attachment, rather than the short side 135 as shown, to limit the depth that the wedge can reach and favor the compressive nature of the driving force over its shearing ability. The parabolic wedge can additionally be used in tandem with other attachments to target such recesses as the inguinal crease. Other wedges constructed from differing curves that are substantially parabolic can also be useful.

The attachment detailed in FIGS. 32A-32G is meant for use on the upper back. The contact surface is constructed by taking the shell of a hemisphere, the inner concave surface 139 of which complements the slight convexity of most areas of the upper back, and cutting it out in the shape of a rhomboid 138 with rounded corners. Once the edges of this surface have been rounded back, the structure is mounted, either vertically or horizontally, on a stiff revolute joint 140 which connects to the stationary jaw of the assembly at 141. When this attachment is placed on the upper back, the slide bar goes over the shoulder and the opposing attachment is positioned either on the upper chest, as would be the case with the ones in FIG. 10A or 29A, or over the anterior axillary fold, as with the one in FIG. 18A. The pivotability of the rhomboid attachment allows it to lie flush against the soft tissue, no matter how high or low on the back it is situated and what corresponding angle of the slide bar is necessary for its placement. Alternative embodiments may use other types of joints, such as a ball-and-socket joint, or even a combination of joints, such as two revolute joints affixed perpendicularly to each other with one stacked on top of the other.

Figure 33:
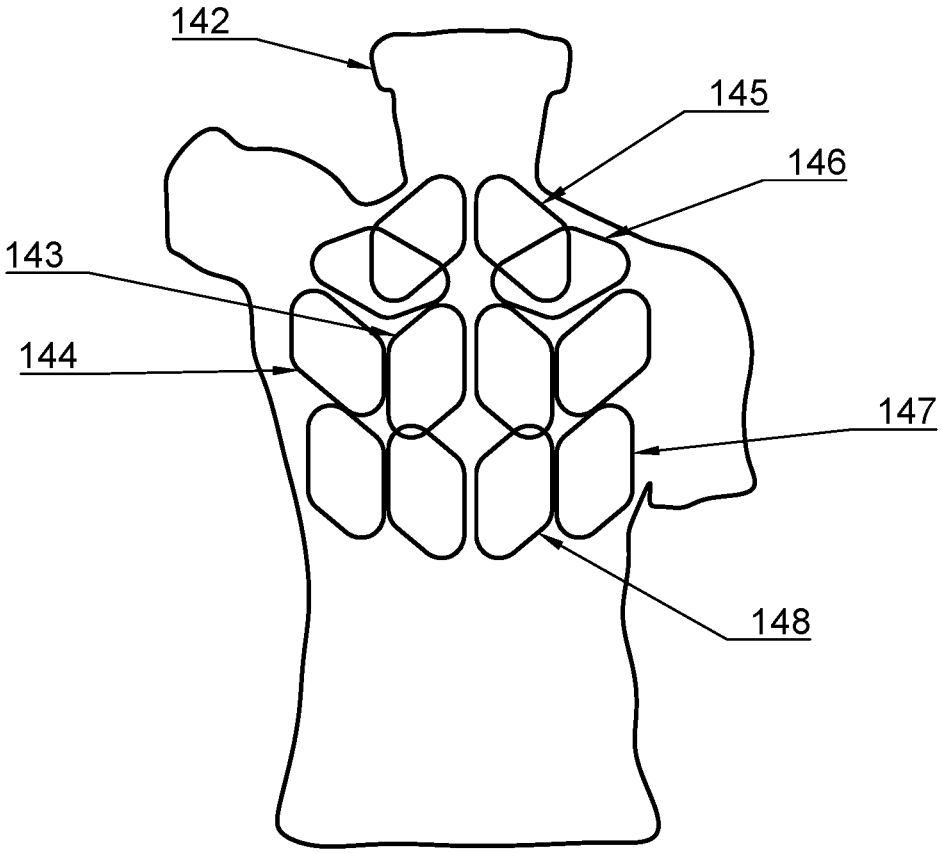

The rounded rhomboid shape lends itself to conform to the muscular terrain of the upper back, as can be seen in FIG. 33, which depicts possible positions of the attachment on it, as indicated by the outline 142 of its silhouette. With a width that is a bit narrower than the transverse distance from the spine to the medial border of the scapula, the shape makes an obvious match for the upper rhomboid muscles in position 143 without suffering obstruction from the more prominent scapula. When rotated, the contact surface fits over the infraspinatus muscle on the scapula in position 144 without colliding with the raised scapular spine. On the contralateral side, the surface can cover the levator scapulae and the upmost portion of the trapezius in position 145; the supraspinatus, without running afoul of the scapular spine, and another portion of the trapezius in position 146; the diagonally tapered latissimus dorsi in position 147, while also once again steering clear of the scapula; and the lower rhomboids along with the inferior angular portion of the trapezius in position 148. The erector spinae can be hit anywhere along the upper back by moving the surface up and down alongside the spine. The rest of the outlined-but-unnumbered positions are addressed with the mirror image of the illustrated attachment. The rhomboid shape hence effectively isolates the muscles from each other and the scapula as much as possible, given their overlying and overlapping nature. Without the encumbrance from other muscles and bone with their differing topology, vis a vis both their relative angle and elevation, this relative isolation of the upper back muscles makes their compression apt to be that much more successful and therefore helpful.

The attachment detailed in FIGS. 34A-34E is designed for use in tight bodily junctures and recesses. The soft tissue contact surface is formed by taking the shell of a hemisphere and cutting it out in the shape of a smaller oval with a semicircle for one end 149 and a semi-ellipse for the other end 150 to wind up with a surface that has a spherical curvature 151. The front 152 and back edges 153 are then rounded to form a continuous curve from front to back.

The elliptical end of the surface is well suited for targeting muscles that have tight junctures at their insertions or origins, which readily harbor trigger points that are the cause of a good deal of pain and dysfunction. Some examples include the edge of the trapezius muscle where it inserts on the clavicle, the pectoralis major from one place where it originates at the sternoclavicular joint, and the various insertions and origins on the acromion and coracoid process. In addition, the narrower end of the surface can reach into the high recess of the superior axilla and all along the rest of its deep pocket. To be able to fit and maneuver inside that space, the attachment employs a narrow stem 154 to give enough distance between the small body of the surface and the point 155 where it connects to the comparably larger and ill-fitting jaw of the assembly. To provide access to the axilla in this way, the slide bar of the assembly goes over the shoulder and the opposing attachment is positioned on the backside of the posterior axillary fold.

While the narrower elliptical end gets right into tight corners, the wider semicircular end expands the surface to include the adjacent tissue as it broadens away from them. Scaling the size of the construct up gives rise to an attachment of more general utility. The opposing attachment of either one will depend upon the location and angle where it is employed.

The pair of attachments illustrated in FIGS. 35A and 36A are intended for general use. The one shown in FIGS. 35A-35D is formed by cutting a convex cylindrical surface 156 with an oval 157, while the one in FIGS. 36A-36D cuts a concave inner pipe-like surface 158 the same way. The convexity is perfectly complementary in curvature to the concavity, and the two fit together seamlessly. The oval edges are then rounded back 159, 160 to complete the shapes. The oval shape facilitates fitting both of the attachments within tighter bodily flexures and next to other similarly unforgiving contours than more rectilinear shaped versions would allow, while the rounded edges permit greater angular freedom in their placement on the body. The two attachments may be used together or with a duplicate copy of themselves, as well as with other possibilities.

The pair of attachments featured in FIGS. 37A-37E are intended for use on the limbs. The soft tissue contact surface for the one on the left of FIG. 37A is formed by taking a convex curve 161 and revolving it around an axis, which lies parallel to the tangent at the curve's midpoint, and then rounding the circular edges at either end. The resulting roller is then connected to a cylindrical shaft 163, which runs along its axis, and mounted on a support bracket 164 that allows them to spin together. In an alternative embodiment, the roller spins around a stationary cylindrical shaft that is part of a U-shaped structure, like the construction of a paint roller, which attaches to the jaw of the bar clamp at its other end. This configuration leaves one end of the roller free and unimpeded, allowing it to press into the body. The attachment on the right of FIG. 37A is similarly constructed but starts instead with a concave curve 162. These two attachments can be used with each other or a duplicate copy of themselves. When a limb is placed between them, they can be rolled over the targeted soft tissue in a manner somewhat like kneading or rolling dough.

The attachment in FIGS. 38A-38C is a sphere with a small portion cut off. The resulting flat side 165 is where it connects to the jaw of the assembly. Since other attachments by and large provide better compression of the targeted soft tissue, this ball-like one best works as an opposing anchor, allowing for its placement at virtually any angle that is needed. A small-scaled variation though is useful for targeting discrete button-sized trigger points on the back. Both sized versions purposefully encompass the bulk of a sphere because using any smaller portion of it, such as just a hemisphere, would limit the possible angles and lessen the degree of freedom in its placement.

The attachment in FIGS. 39A-39C is an ovoid with a small portion cut off. The resulting flat side 166 is where it connects to the jaw of the assembly. The spherically shaped end 167 is similar in contour to the attachment of FIG. 38A, while the elliptically shaped end 168 provides an alternate shape with a changing radius of curvature and a narrower end. This ovoid attachment is of general utility and can also work as an anchor.

In conclusion, the foregoing attachments are most effectively utilized in conjunction with the discussed bar clamp assembly but may alternatively be used as either stand-alone devices or in tandem with any other apparatus that generates pressure and can press them into the body. When the structures supporting their contact surfaces are configured for the attachments to be used by themselves, pressure may be applied by pitting them between the body and the floor, wall or other stationary surface. Oneself or another person may also apply manual pressure if the attachments are adapted for the purpose by the addition of a handle or any other construct to make them graspable. Using different clamping devices or employing weights is also possible, as is engaging any mechanism of squeezing.

The embodiments and examples set forth herein have been presented to best explain the present invention and its practical application and thereby to enable those of ordinary skill in the art to make and use the invention. However, the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A soft tissue pressuring apparatus, comprising at least one attachment and at least one additional attachment, the at least one attachment comprising:

a substantially rigid base; and a first soft tissue contact surface, coupled to the base, that is configured with a contour to allow it to be pressed into soft tissue of specific parts of the human body, said contour not being substantially deformable in shape with the application of pressure, wherein the at least one additional attachment comprises a second soft tissue contact surface, wherein the at least one attachment and the at least one additional attachment are concurrently attached to the soft tissue pressuring apparatus on opposing sides of the soft tissue in its grasp, and wherein at least one end of the first soft tissue contact surface is offset from the opposing end of the second soft tissue contact surface.

2. The soft tissue pressuring apparatus of claim 1, wherein the first soft tissue contact surface and the second soft tissue contact surface have contours different from one another.

3. The soft tissue pressuring apparatus of claim 1, wherein the contour of the first soft tissue contact surface resembles a contour of a portion of a finger holding an object in a pincer grasp, and wherein the contour of the portion of the finger is of variable dimensions that may or may not be in proportion to the finger.

4. The soft tissue pressuring apparatus of claim 1, wherein the at least one attachment and the at least one additional attachment comprise different contoured surfaces configured to pinch soft tissue between them in a manner similar to a pincer grasp when both are concurrently attached to the soft tissue pressuring apparatus.

5. The soft tissue pressuring apparatus of claim 1, wherein the contour of the first soft tissue contact surface resembles a contour of a portion of a part of a mitten containing four fingers of a hand, and wherein the contour of the portion of the part of the mitten is of variable dimensions that may or may not be in proportion to the mitten.

6. The soft tissue pressuring apparatus of claim 1, wherein the contour of the first soft tissue contact surface resembles a contour of a portion of a tongue sticking out of a mouth, and wherein the contour of the portion of the tongue is of variable dimensions that may or may not be in proportion to the tongue.

7. The soft tissue pressuring apparatus of claim 1, wherein the at least one attachment comprises a first contoured surface and the at least one additional attachment comprises a second contoured surface that is configured in shape in relation to the first contoured surface in such a manner that when the at least one attachment and the at least one additional attachment are concurrently attached to the soft tissue pressuring apparatus and properly oriented, either one or both of the following occur:

a first end of the first contoured surface protrudes toward a first end of the second contoured surface in tandem with the first end of the second contoured surface drawing back from the first end of the first contoured surface; and a second end of the first contoured surface draws back from a second end of the second contoured surface in tandem with the second end of the second contoured surface protruding toward the second end of the first contoured surface.

8. The soft tissue pressuring apparatus of claim 1, wherein at least one attachment comprises a contoured surface that is curved along two of its central axes.

9. The soft tissue pressuring apparatus of claim 1, wherein at least one attachment comprises a contoured surface that is formed by sweeping a convex curve along a concave curve.

10. The soft tissue pressuring apparatus of claim 1, wherein at least one attachment comprises a contoured surface in the shape of a curved mound with a recess formed therein.

11. The soft tissue pressuring apparatus of claim 1, wherein at least one attachment comprises a contoured surface that is formed by taking a first curve, comprising a convex segment that is continuous with a concave segment, and sweeping the first curve along a convex second curve.

12. The soft tissue pressuring apparatus of claim 11, wherein the at least one attachment comprises:

a first round between the top edge of the contoured surface and a first side edge of the contoured surface that is next to the convex segment;

a second round between said top edge and a second side edge of the contoured surface that is next to the concave segment, the second round being larger than the first round;

a third round between the bottom edge of the contoured surface and said first side edge; and a fourth round between said bottom edge and said second side edge, the fourth round being larger than the third round.

13. The soft tissue pressuring apparatus of claim 1, wherein at least one attachment comprises a contoured surface that is curved along at least one axis and has a groove formed therein that is of variable width and depth.

14. The soft tissue pressuring apparatus of claim 1, wherein at least one attachment comprises a contoured surface that is the rounded edge of a substantially triangular wedge.

15. The soft tissue pressuring apparatus of claim 14, wherein the at least one attachment comprises a notch in the contoured surface and triangular wedge.

16. The soft tissue pressuring apparatus of claim 1, wherein at least one attachment comprises a contoured surface that is formed by taking a construct, comprising either two curves, joined by an intervening notch, or only one curve, and sweeping the construct along a concave curve that substantially complements the convexity of the thoracic spine.

17. The soft tissue pressuring apparatus of claim 1, wherein at least one attachment comprises a contoured surface that is formed by taking a first construct on a first plane, comprising an arc with a linear first extension to one end of the arc and a second linear extension to the other end of the arc, which is either the same length as the first extension or longer than the first extension, and then lofting the first construct to a similarly formed second construct that is scaled down in size in comparison to the first construct and that is on a second plane, which is both parallel to the first plane and offset from the first plane, and that is offset from the first construct in the general direction of either the first or second extension.

18. The soft tissue pressuring apparatus of claim 1, wherein at least one attachment comprises a contoured surface approximately resembling the shape of a portion of a *Bacillus* or *Spirillum bacterium*.

19. The soft tissue pressuring apparatus of claim 1, wherein at least one attachment comprises a contoured surface that substantially has the shape of a twisted, spiraled or coiled convex contour.

20. The soft tissue pressuring apparatus of claim 1, wherein at least one attachment comprises a contoured surface that is formed by taking a convex curve and sweeping it along a path, comprising a partial turn of a coil, with the convex curve either maintaining the perpendicular orientation of the midpoint of its convexity to the center of the coil as it progresses along the path or alternatively twisting around the path, with the degree of twisting advancing at a faster rate than if the perpendicular orientation of the midpoint of its convexity to the center of the coil were to be maintained.

21. The soft tissue pressuring apparatus of claim 1, wherein at least one first attachment comprises a first contoured surface that is formed by extruding a substantially parabolic curve.

22. The soft tissue pressuring apparatus of claim 21, wherein at least one second attachment comprises a second contoured surface with a concavity that complements the convexity of a portion of the first contoured surface when both the first and second attachments are concurrently attached to the soft tissue pressuring apparatus and properly oriented.

23. The soft tissue pressuring apparatus of claim 1, wherein at least one attachment comprises a contoured surface that is formed by taking either the concave or convex side of the shell of a hemisphere of variable radius and cutting it out in the substantial shape of a rhomboid with or without rounded corners.

24. The soft tissue pressuring apparatus of claim 1, wherein at least one attachment comprises one or more mechanical joints.

25. The soft tissue pressuring apparatus of claim 1, wherein at least one attachment comprises a contoured surface approximately resembling a portion of a used bar of soap that is bowed with rounded corners.

26. The soft tissue pressuring apparatus of claim 1, wherein at least one attachment comprises a contoured surface that is formed by taking either a spherical, convex or concave surface and cutting it out in the shape of an oval.

27. The soft tissue pressuring apparatus of claim 1, wherein at least one attachment comprises a roller and a shaft.

28. The soft tissue pressuring apparatus of claim 1, wherein at least one attachment comprises a contoured surface in the substantial shape of a greater portion of a sphere, all of an ovoid, or part of an ovoid.

29. The soft tissue pressuring apparatus of claim 1, wherein at least one first attachment comprises a first contoured surface and at least one second attachment comprises a second contoured surface that is substantially complementary in shape to the first contoured surface.

30. The soft tissue pressuring apparatus of claim 1, wherein at least one attachment comprises a contoured surface that substantially conforms in shape to a specific contour of the human body.

31. The soft tissue pressuring apparatus of claim 1, wherein the attachment stands alone with no attachment feature and the base is configured either to be manually graspable or to be used while positioned against a separate surface.

32. The soft tissue pressuring apparatus of claim 1, wherein an end of the attachment comprises a stem that terminates in an insert in a shape that allows for it be coupled in any one of multiple possible orientations to the soft tissue pressuring apparatus.

33. A soft tissue pressuring apparatus comprising:

a slide bar;

a first jaw coupled, proximate a first end of the first jaw, to the slide bar in a substantially stationary manner, the first jaw having an aperture through which the slide bar is received, the first jaw having coupled thereto a first attachment, the first attachment comprising:

a substantially rigid first base, and a first soft tissue contact surface, coupled to the first base, that is configured with a curved contour to allow it to be pressed into soft tissue of specific parts of the human body, said contour not being substantially deformable in shape with the application of pressure;

a handgrip configured with the ability to slide along the slide bar and coupled to the slide bar, the handgrip having a second aperture through which the slide bar is received; and a second jaw coupled, proximate a first end of the second jaw, to the handgrip and movable with the handgrip, the second jaw having coupled thereto a second attachment, the second attachment comprising:

a substantially rigid second base, and a second soft tissue contact surface, coupled to the second base, that is configured with a curved contour to allow it to be pressed into soft tissue of specific parts of the human body, said contour not being substantially deformable in shape with the application of pressure, wherein the first attachment and the second attachment are concurrently attached to the soft tissue pressuring apparatus on opposing sides of the soft tissue in its grasp.

34. The soft tissue pressuring apparatus of claim 33, wherein the first soft tissue contact surface and the second soft tissue contact surface have contours different from one another.

35. The soft tissue pressuring apparatus of claim 33, wherein the contour of the first soft tissue contact surface resembles a contour of a portion of a finger holding an object in a pincer grasp, and wherein the contour of the portion of the finger is of variable dimensions that may or may not be in proportion to the finger.

36. The soft tissue pressuring apparatus of claim 33, wherein the first attachment and the second attachment comprise the same or different contoured surfaces configured to pinch soft tissue between them in a manner similar to a pincer grasp when both are concurrently attached to the soft tissue pressuring apparatus.

37. The soft tissue pressuring apparatus of claim 33, wherein the contour of the first soft tissue contact surface resembles a contour of a portion of a part of a mitten containing four fingers of a hand, and wherein the contour of the portion of the part of the mitten is of variable dimensions that may or may not be in proportion to the mitten.

38. The soft tissue pressuring apparatus of claim 33, wherein the contour of the first soft tissue contact surface resembles a contour of a portion of a tongue sticking out of a mouth, and wherein the contour of the portion of the tongue is of variable dimensions that may or may not be in proportion to the tongue.

39. The soft tissue pressuring apparatus of claim 33, wherein at least one end of the first soft tissue contact surface is offset from the opposing end of the second soft tissue contact surface.

40. The soft tissue pressuring apparatus of claim 33, wherein the first attachment comprises a first contoured surface and the second attachment comprises a second contoured surface that is configured in shape in relation to the first contoured surface in such a manner that when the first attachment and the second attachment are concurrently attached to the soft tissue pressuring apparatus and properly oriented, either one or both of the following occur:

a first end of the first contoured surface protrudes toward a first end of the second contoured surface in tandem with the first end of the second contoured surface drawing back from the first end of the first contoured surface; and a second end of the first contoured surface draws back from a second end of the second contoured surface in tandem with the second end of the second contoured surface protruding toward the second end of the first contoured surface.

41. The soft tissue pressuring apparatus of claim 33, wherein at least one of the first attachment or the second attachment comprises a contoured surface that is curved along two of its central axes.

42. The soft tissue pressuring apparatus of claim 33, wherein at least one of the first attachment or the second attachment comprises a contoured surface that is formed by sweeping a convex curve along a concave curve.

43. The soft tissue pressuring apparatus of claim 33, wherein at least one of the first attachment or the second attachment comprises a contoured surface in the shape of a curved mound with a recess formed therein.

44. The soft tissue pressuring apparatus of claim 33, wherein at least one of the first attachment or the second attachment comprises a contoured surface that is formed by taking a first curve, comprising a convex segment that is continuous with a concave segment, and sweeping the first curve along a convex second curve.

45. The soft tissue pressuring apparatus of claim 44, wherein the at least one of the first attachment or the second attachment comprises:

a first round between the top edge of the contoured surface and a first side edge of the contoured surface that is next to the convex segment;

a second round between said top edge and a second side edge of the contoured surface that is next to the concave segment, the second round being larger than the first round;

a third round between the bottom edge of the contoured surface and said first side edge; and a fourth round between said bottom edge and said second side edge, the fourth round being larger than the third round.

46. The soft tissue pressuring apparatus of claim 33, wherein at least one of the first attachment or the second attachment comprises a contoured surface that is curved along at least one axis and has a groove formed therein that is of variable width and depth.

47. The soft tissue pressuring apparatus of claim 33, wherein at least one of the first attachment or the second attachment comprises a contoured surface that is the rounded edge of a substantially triangular wedge.

48. The soft tissue pressuring apparatus of claim 47, wherein the at least one of the first attachment or the second attachment comprises a notch in the contoured surface and triangular wedge.

49. The soft tissue pressuring apparatus of claim 33, wherein at least one of the first attachment or the second attachment comprises a contoured surface that is formed by taking a construct, comprising either two curves, joined by an intervening notch, or only one curve, and sweeping the construct along a concave curve that substantially complements the convexity of the thoracic spine.

50. The soft tissue pressuring apparatus of claim 33, wherein at least one of the first attachment or the second attachment comprises a contoured surface that is formed by taking a first construct on a first plane, comprising an arc with a linear first extension to one end of the arc and a second linear extension to the other end of the arc, which is either the same length as the first extension or longer than the first extension, and then lofting the first construct to a similarly formed second construct that is scaled down in size in comparison to the first construct and that is on a second plane, which is both parallel to the first plane and offset from the first plane, and that is offset from the first construct in the general direction of either the first or second extension.

51. The soft tissue pressuring apparatus of claim 33, wherein at least one of the first attachment or the second attachment comprises a contoured surface approximately resembling the shape of a portion of a *Bacillus* or *Spirillum bacterium*.

52. The soft tissue pressuring apparatus of claim 33, wherein at least one of the first attachment or the second attachment comprises a contoured surface that substantially has the shape of a twisted, spiraled or coiled convex contour.

53. The soft tissue pressuring apparatus of claim 33, wherein at least one of the first attachment or the second attachment comprises a contoured surface that is formed by taking a convex curve and sweeping it along a path, comprising a partial turn of a coil, with the convex curve either maintaining the perpendicular orientation of the midpoint of its convexity to the center of the coil as it progresses along the path or alternatively twisting around the path, with the degree of twisting advancing at a faster rate than if the perpendicular orientation of the midpoint of its convexity to the center of the coil were to be maintained.

54. The soft tissue pressuring apparatus of claim 33, wherein one of the first attachment or the second attachment comprises a first contoured surface that is formed by extruding a substantially parabolic curve.

55. The soft tissue pressuring apparatus of claim 54, wherein the other of the first attachment or the second attachment comprises a second contoured surface with a concavity that complements the convexity of a portion of the first contoured surface when both the first and second attachments are concurrently attached to the soft tissue pressuring apparatus and properly oriented.

56. The soft tissue pressuring apparatus of claim 33, wherein at least one of the first attachment or the second attachment comprises a contoured surface that is formed by taking either the concave or convex side of the shell of a hemisphere of variable radius and cutting it out in the substantial shape of a rhomboid with or without rounded corners.

57. The soft tissue pressuring apparatus of claim 33, wherein at least one of the first attachment or the second attachment comprises one or more mechanical joints.

58. The soft tissue pressuring apparatus of claim 33, wherein at least one of the first attachment or the second attachment comprises a contoured surface approximately resembling a portion of a used bar of soap that is bowed with rounded corners.

59. The soft tissue pressuring apparatus of claim 33, wherein at least one of the first attachment or the second attachment comprises a contoured surface that is formed by taking either a spherical, convex or concave surface and cutting it out in the shape of an oval.

60. The soft tissue pressuring apparatus of claim 33, wherein at least one of the first attachment or the second attachment comprises a roller and a shaft.

61. The soft tissue pressuring apparatus of claim 33, wherein at least one of the first attachment or the second attachment comprises a contoured surface in the substantial shape of a greater portion of a sphere, all of an ovoid, or part of an ovoid.

62. The soft tissue pressuring apparatus of claim 33, wherein the first attachment comprises a first contoured surface and the second attachment comprises a second contoured surface that is substantially complementary in shape to the first contoured surface.

63. The soft tissue pressuring apparatus of claim 33, wherein at least one of the first attachment or the second attachment comprises a contoured surface that substantially conforms in shape to a specific contour of the human body.

64. The soft tissue pressuring apparatus of claim 33, wherein an end of at least one of the first attachment or the second attachment comprises a stem that terminates in an insert in a shape that allows for it be coupled in any one of multiple possible orientations to the soft tissue pressuring apparatus.

* * * * *